US012796874B2

(12) United States Patent
Hamberger et al.

(10) Patent No.: US 12,796,874 B2
(45) Date of Patent: Nov. 17, 2026

(54) TOILET SYSTEM AND BUILDING WITH SUCH A TOILET SYSTEM

(71) Applicant: NAVEGA LIMITED, Ardee County Louth (IE)

(72) Inventors: Rudolf Hamberger, Stephanskirchen (DE); Gerd Aulinger, Stephanskirchen (DE)

(73) Assignee: NAVEGA LIMITED, Ardee County Louth (IE)

( * ) Notice: Subject to any disclaimer, the term of this patent is extended or adjusted under 35 U.S.C. 154(b) by 106 days.

(21) Appl. No.: 18/832,070

(22) PCT Filed: Jan. 19, 2023

(86) PCT No.: PCT/EP2023/051294
§ 371 (c)(1),
(2) Date: Jul. 22, 2024

(87) PCT Pub. No.: WO2023/139180
PCT Pub. Date: Jul. 27, 2023

(65) Prior Publication Data

US 2025/0098910 A1 Mar. 27, 2025

(30) Foreign Application Priority Data

Jan. 21, 2022 (DE) ..... 10 2022 000 216.7

(51) Int. Cl.
*A47K 13/10* (2006.01)
*A47K 13/12* (2006.01)
(Continued)

(52) U.S. Cl.
CPC ..... *A47K 13/10* (2013.01); *A47K 13/12* (2013.01); *A47K 13/242* (2013.01); *A47K 13/245* (2013.01); *E03D 1/38* (2013.01)

(58) Field of Classification Search
CPC ..... A47K 13/10; A47K 13/12; A47K 13/242; A47K 13/245; E03D 1/38
See application file for complete search history.

(56) References Cited

U.S. PATENT DOCUMENTS 4,433,442 A 2/1984 Liou
6,907,621 B2 * 6/2005 Stemen ..... A47K 13/10 4/246.1

(Continued)

FOREIGN PATENT DOCUMENTS

AU 7776687 A 5/1988
AU 596693 B2 5/1990

(Continued)

OTHER PUBLICATIONS

International Search Report for PCT/EP2023/051294, mailed Apr. 12, 2023, 7 pages.

(Continued)

*Primary Examiner* — Janie M Loeppke
(74) *Attorney, Agent, or Firm* — Nixon & Vanderhye P.C.

(57) ABSTRACT

The toilet system (1) comprises a toilet bowl (2). An inlet pipe (12) is provided, wherein a first end (12*a*) of the inlet pipe (12) is connected to the toilet bowl (2) and wherein a second end (12*b*) of the inlet pipe (12) can be connected directly or indirectly to a pressurized water supply line. A toilet seat (13) is provided, wherein the toilet seat (13) comprises a seat ring (14) alone or a toilet lid (16) and a seat ring (14). An actuator arrangement (55), a valve device (30) and a hose system (45) are provided. The actuator arrangement (55) can be connected to the water supply line via the valve device (30) and the hose system (45). The valve device (30) is designed to supply the pressurized water from the water supply line to the actuator arrangement (55), wherein the actuator arrangement (55) is designed to raise the toilet (Continued)

Figure 1:
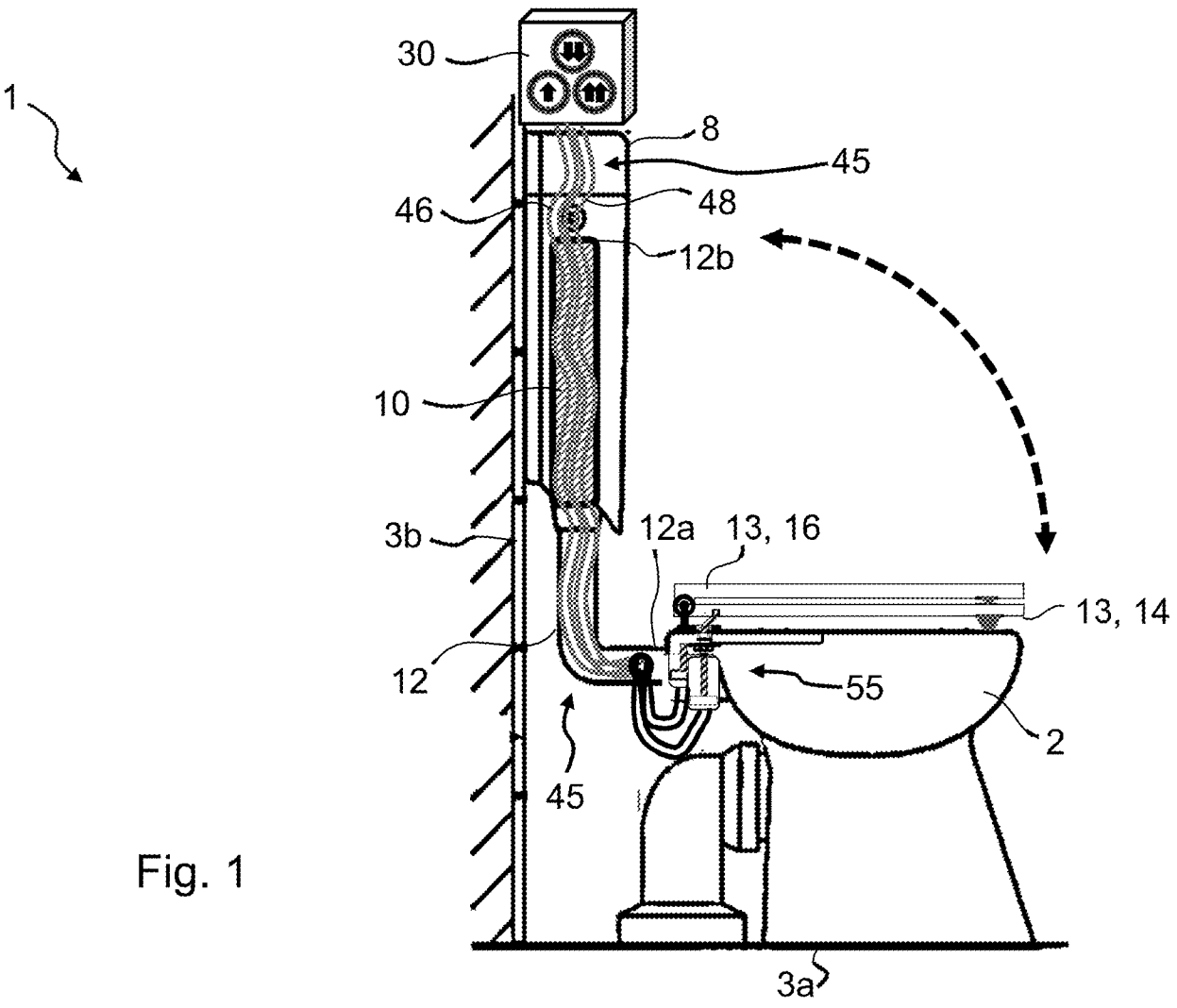

seat (13) by means of the pressurized water. The hose system (45) runs inside the inlet pipe (12) and through the overflow pipe (10).

21 Claims, 29 Drawing Sheets

(51) Int. Cl.
*A47K 13/24* (2006.01)
*E03D 1/38* (2006.01)

(56) References Cited

U.S. PATENT DOCUMENTS

| | | | | |
|---|---|---|---|---|
| 9,687,126 | B2 * | 6/2017 | Waikas, II | A47K 13/10 |
| 2013/0160196 | A1 | 6/2013 | Gomez | |
| 2013/0340155 | A1 | 12/2013 | Gomez | |

FOREIGN PATENT DOCUMENTS

| | | |
|---|---|---|
| CN | 201071539 | 6/2008 |
| CN | 101322623 | 12/2008 |
| DE | 6948417 | 4/1970 |
| WO | 2005102136 | 11/2005 |
| WO | 2007111701 | 10/2007 |

OTHER PUBLICATIONS

Written Opinion of the ISA for PCT/EP2023/051294, mailed Apr. 12, 2023, 7 pages.

* cited by examiner

TOILET SYSTEM AND BUILDING WITH SUCH A TOILET SYSTEM

This application is the U.S. national phase of International Application No. PCT/EP2023/051294 filed Jan. 19, 2023 which designated the U.S. and claims priority to DE 10 2022 000 216.7 filed Jan. 21, 2022, the entire contents of each of which are hereby incorporated by reference.

The invention relates to a toilet system and a building with such a toilet system.

Toilet systems, in particular those that are accessible to several people (for example in offices or public buildings) have the disadvantage that in order to operate (e.g. open and close) the toilet seat (toilet lid and/or seat ring), the seat must be touched. However, such "touching" is not hygienic.

Toilet systems that enable the user to automatically raise the toilet seat by pressing a button are state of the art. The force for the lifting is provided, for example, by the water pressure in water distribution networks. In this context, reference is made to US 2013/0340155A1, DE6948417U, AU001987077766A1, US2013/0160196A1 and WO2005/102136A1.

A disadvantage of the state of the art is complexity of the system.

It is therefore the object of the present invention to create a toilet system in which the raising and lowering of the toilet seat is more hygienic and easier.

The objective is achieved by the toilet system according to independent claim 1. Advantageous further developments of the toilet system are specified in claims 2 to 19. Claim 20 describes a building in which the toilet system according to the invention is installed.

The toilet system according to the invention comprises a (preferably conventional) toilet bowl that can be mounted on a floor or on a wall (e.g. freely suspended). A cistern and an inlet pipe are also provided, with a first end of the inlet pipe being connected to the toilet bowl and a second end being indirectly connected, i.e. via the cistern, to the pressurized water supply (of the building). Water for flushing the toilet bowl can be drawn from this pressurized water supply line. The cistern also comprises an overflow pipe, with the overflow pipe extending the inlet pipe in the inoperative state (no flushing) of the toilet system in such a way that no water flows from the cistern into the inlet pipe (12). A toilet seat is also provided. This comprises a seat ring and a toilet lid or a seat ring alone. An actuator arrangement, a valve device and a hose system are also provided. The actuator arrangement can be connected to the water supply line via the valve device and the pipe system. The valve device is designed to supply the pressurized water from the water supply line to the actuator arrangement, wherein the actuator arrangement is designed to raise the toilet seat using the pressurized water. The hose system also runs inside the inlet pipe and through the overflow pipe.

It is particularly advantageous that the seat ring alone, if no toilet lid is provided, can be raised by the pressure in the water supply line. Alternatively, it is also advantageous that the toilet lid can be raised by the pressure in the water supply line. Alternatively, it is also advantageous that both the toilet lid and the seat ring can be raised together by the pressure in the water supply line. In conventional water supply lines, the water pressure is 2 to 4 bar. This is sufficient to raise the toilet seat using only water power, without the use of an electric motor or similar. It is therefore particularly advantageous that the toilet system is free of an electric motor. This makes subsequent installation in existing toilet systems particularly easy.

Furthermore, it is particularly advantageous that the hose system runs through the inlet pipe and through the overflow pipe. The extension through the overflow pipe extends above the filling level of the cistern. In particular, the pipe system runs at least partially or predominantly, but in particular not exclusively, within the inlet pipe. This ensures that the hose system, which in particular consists of hoses, is not visible from the outside. This increases acceptance for the installation of such a toilet system and in particular standard components (conventional inlet pipe, toilet bowl, etc.) can be used. This also keeps costs low. The valve device is arranged in particular in the area of the cistern, so that part of the hose system runs from the actuator arrangement to the valve device through the inlet pipe.

In an advantageous development, the toilet bowl comprises a flushing channel. The first end of the inlet pipe is connected to the flushing channel. The actuator arrangement and the toilet seat are arranged on an upper side of the toilet bowl. At least one through hole is provided in the toilet bowl, wherein the through hole extends from the top of the toilet bowl into the flush channel. The hose system exits the inlet pipe in the region of the first end of the inlet pipe and enters the flush channel and is guided via the flush channel and the at least one through hole to the actuator arrangement. This ensures that the hose arrangement is arranged invisibly for the user of the toilet system. The actuator arrangement preferably covers the through hole. The through hole is preferably sealed. The inlet pipe is preferably free of openings, such as bores, for the line arrangement to pass through. This significantly reduces the likelihood of leaks. The hose system exits from the through hole in the toilet bowl directly below the actuator arrangement, so that it is invisible to a user of the toilet when the actuator arrangement is installed.

In an advantageous development, the actuator arrangement is designed to redirect water back towards the valve device in order to lower the toilet seat. The valve device is designed to direct water that comes from the actuator arrangement into the cistern. It is particularly advantageous that the water that is used to raise the toilet seat and is pressed into the actuator arrangement is not simply poured into the toilet bowl when the toilet seat is closed, but is returned to the cistern. As a result, no water is spoiled to lift and lower the toilet seat. The lowering is done particularly silent.

In an advantageous development, the valve device is arranged inside the cistern. This ensures that water that may escape from the valve device in the event of a defect flows into the cistern.

In an advantageous development, the hose system comprises a supply hose that can be connected to the water supply line and that is connected to the valve device. The supply hose is arranged in and/or above the cistern so that if the supply hose leaks, water flows from the supply hose into the cistern. This prevents flooding.

In an advantageous development, the valve device is arranged closer to the second end of the inlet pipe than to the first end of the inlet pipe. The pipe system connects the valve device to the actuator arrangement. This makes it possible to operate the lifting and lowering mechanism at a sufficient height. Bending over is not necessary.

In an advantageous development, the actuator arrangement comprises an automatic lowering mechanism which is designed to lower the toilet seat in a braking manner. The automatic lowering mechanism comprises a return spring arrangement which is designed to press the water out of the actuator arrangement, whereby the braked lowering can be initiated. The speed at which the toilet seat can be lowered is determined in particular by the strength of the return spring arrangement and the hose diameter and thus by the resistance of the hose system.

In an advantageous development, the toilet system comprises a return device. The return device has at least one spring in an opening of the lid of the toilet seat. The axis of rotation of the toilet lid preferably runs through this opening. One end of the spring protrudes from the lid of the toilet seat in the direction of the actuator arrangement. The one spring is designed to come into contact with a prolongation on the actuator arrangement, in particular on a base plate of the actuator arrangement, when the toilet lid is opened, whereby the return device can be pre-tensioned. In this case, a spring force acts in the closing direction of the toilet lid. The return device is designed in particular to rotate the toilet seat into a position such that the angle between the toilet seat and the surface of the toilet bowl is less than 90° or less than 80°. As soon as such an angle is reached, gravity acts to support the closing process. Preferably, the return device is designed to rotate the toilet seat from an angle of approximately 115° through 90° towards 80°. It is clear that the actuator arrangement must apply a force in the opening direction of the toilet lid that is greater than the spring force.

In an advantageous development, the actuator arrangement comprises a pressure relief valve which is designed to drain water from the actuator arrangement when a certain (water) pressure value within the actuator arrangement is reached or exceeded. This prevents damage to the actuator arrangement if a user wants to close the toilet seat with force.

In an advantageous development, the toilet bowl comprises several through holes (preferably in the ceramic) which emerge on an upper side of the toilet bowl on which the toilet lid is arranged. The actuator arrangement is attached to these through holes. This attachment can take place on the top or bottom. Such through holes are already provided in conventional toilet bowls for attaching the hinge feet of the toilet seat, so that existing toilet systems can be particularly easily retrofitted with the actuator arrangement.

In an advantageous development, the actuator arrangement is positioned on the top of the toilet bowl. The hose system is guided through at least one hole or through the multiple through holes to the actuator arrangement. In this case, the pipe system is guided from the underside of the toilet bowl to the actuator arrangement on the top of the toilet bowl, so that the hose system is invisible when the toilet system is in use.

In an advantageous development, the actuator arrangement is attached to these through holes. For this purpose, the actuator arrangement comprises several fitting perforations through which the actuator arrangement can be attached to the toilet bowl via the multiple through holes. In particular, the attachment can be made using a screw connection that passes through the through holes and the fitting perforations. The fitting perforations on the actuator arrangement are elongated holes, so that the actuator arrangement can be attached to the toilet bowl even if the through holes are at different distances from one another. This means that conventional toilet systems that already have appropriately drilled through holes can be easily retrofitted. No new through holes need to be created. The toilet seat can in turn be attached to the actuator arrangement.

In an advantageous development, the actuator arrangement comprises two hinge feet. Each hinge foot is guided through a through hole or dips through a through hole or into a through hole. The hinge feet are hollow so that the pipe system is guided through one or both hinge feet. In this case, the pipe system is invisible on the top of the toilet bowl. In another embodiment, the pipe system is not guided through the hinge feet, but is guided via a separate through hole that extend from the top of the toilet bowl into the flush channel.

In an advantageous development, the actuator arrangement comprises a first actuator in the form of a hydraulic cylinder that is designed to lift the toilet lid. In addition or alternatively, the actuator arrangement comprises a second actuator in the form of a hydraulic cylinder that is designed to lift the seat ring.

In an advantageous development, the actuator arrangement comprises a base plate. The base plate is screwed and/or locked to the toilet bowl. The first actuator and the second actuator are connected to the base plate via a pin-secured holder or locked via a snap connection. Alternatively, a common housing is provided which surrounds the first actuator and the second actuator, the common housing being connected to the base plate via a pin-secured holder or locked via a snap connection. This makes it very easy txo replace the first and second actuator.

In an advantageous development, the first actuator comprises a first end and a second end, with the toilet lid being attached to the second end of the first actuator. The second actuator comprises a first end and a second end, with the seat ring being attached to the second end of the second actuator. Furthermore, a distribution device, in particular a cylindrical one, is provided. The first actuator is arranged with its first end on a first side of the distribution device and the second actuator is arranged with its first end on a second side of the distribution device. The distribution device comprises two connections, each connection being connected to the hose system, water that is supplied to the first connection being supplied to the first actuator at its first end via the distribution device, and water that is supplied to the second connection being supplied to the second actuator at its first end via the distribution device. The mirror-inverted arrangement of the first and second actuator, both of which are separated from one another by the distribution device, enables a very compact structure. Water for the first actuator is supplied to a first connection of the distribution device, which raises the toilet lid. Furthermore, water for the second actuator can be supplied to a second connection of the distribution device, which raises the seat ring. As a result, the actuator arrangement has an elongated, in particular partially cylindrical shape, and can be installed in the toilet seat particularly easily.

In an advantageous development, the actuator arrangement comprises a common housing in the form of a tube, with the first actuator, the second actuator and the distribution device being arranged in this common housing. The shared housing creates an optimal overall aesthetic impression while simultaneously reducing leaks to a minimum. The pistons of the first and second actuators move along the same axis but in different directions during the opening process of the toilet seat.

In an advantageous development, the actuator arrangement is designed to rotate the toilet seat around a rotation axis in an opening movement using the pressurized water, whereby the toilet seat rotates from a closed position in which it rests on the toilet bowl to an open position. In the opening movement, torque is only transmitted from the actuator arrangement to the toilet seat and not from the toilet seat in the direction of the actuator arrangement, so that a manual opening movement of the toilet seat does not lead to any rotation of the actuator arrangement, whereby freewheeling of the toilet seat is possible at least in the opening movement. It is particularly advantageous that this makes it possible for a user of the toilet system to manually lift the toilet seat very quickly. He therefore does not have to apply any force that counteracts the actuator arrangement. The user may only have to overcome the force of the return device, which moves the toilet seat from the open position to the closed position when it is released. This of course only applies if the actuator arrangement has not been actuated. Otherwise, the actuator arrangement ensures that the toilet seat remains in the open position until the actuator arrangement has been released at the valve system by the user and returns to the initial state by lowering.

In a preferred embodiment, the first actuator comprises a fastening section. The toilet lid comprises a first hinge joint which is arranged on the fastening section. When the first actuator is actuated, the fastening section rotates about an axis of rotation. The fastening section has a driver which comes into contact with a projection on the first hinge arm, whereby a torque can be transferred from the first actuator to the toilet lid. A rotation of the fastening section (during the opening movement) leads to a rotation of the first hinge arm (about the axis of rotation) of the toilet lid and thus to a lifting of the toilet lid. Preferably, the first driver only comes into contact with the projection on the first hinge arm when rotating in one direction of rotation, so that only a torque can be transferred from the first actuator to the toilet lid during the opening movement. This allows the user to lift the toilet lid manually. A first hinge arm of the seat ring is only supported on the fastening section of the first actuator.

In a preferred embodiment, the second actuator comprises a fastening section. The seat ring comprises a second hinge arm which is arranged on the fastening section. When the second actuator is actuated, the fastening section rotates about an axis of rotation. The fastening section has a driver which comes into contact with a projection on the second hinge arm, whereby a torque can be transmitted from the second actuator to the seat ring. A rotation of the fastening section (during the opening movement) leads to a rotation of the second hinge arm (about the axis of rotation) of the seat ring and thus to a lifting of the seat ring. Preferably, the first driver only comes into contact with the projection on the second hinge arm when rotating in one direction of rotation, so that only a torque can be transmitted from the second actuator to the seat ring during the opening movement. This allows the user to lift the seat ring manually. A second hinge arm of the toilet lid is only mounted on the fastening section of the second actuator.

In an advantageous development, the actuator arrangement comprises a first actuator in the form of a hydraulic cylinder. The first actuator comprises a connection that is connected to the hose system. This connection is preferably made via a hydraulic quick connector or plug-in connector. This means that the first actuator can be separated from the line system very quickly (e.g. when replacing it). The first actuator comprises an outer housing, an inner housing and a piston. The outer housing and the inner housing can preferably each be constructed in one piece and can further preferably consist of plastic or comprise a plastic. The inner housing is arranged in the outer housing and the piston is arranged in the inner housing. The first actuator is designed so that when the piston moves, the inner housing is rotated relative to the outer housing, with a first hinge arm of the toilet lid or the seat ring (if the toilet seat only comprises a seat ring) being attached to the inner housing in a rotationally fixed manner. A rotation of the inner housing therefore causes a rotation of the first hinge arm of the toilet lid or the seat ring. This results in the toilet lid or seat ring being raised (rotated in a first direction) or lowered (rotated in an opposite second direction). The inner housing is rotated about an axis of rotation, which is in particular a longitudinal axis of the outer housing.

In an advantageous development, the outer housing comprises a first end which is closed with a base. Pressurized water can flow in between the base of the outer housing and the piston, whereby the piston can be moved along a longitudinal axis of the first actuator in the direction of a second end of the outer housing. The piston comprises a piston head and a piston rod. The piston rod is arranged (at least partially) within the inner housing, wherein the piston head preferably rests against the inner wall of the outer housing and seals the area between the piston head and the inner wall of the outer housing. The piston is guided through both the outer housing and the inner housing. The outer housing is arranged stationary and is screwed to the toilet bowl, for example. A first guide on the inner housing is curved (the guide preferably extends in the longitudinal direction of the inner housing and in the circumferential direction of the inner housing). The first guide on the inner housing is in particular spiral-shaped, which is why an axial movement of the piston along the longitudinal axis of the first actuator is converted into a rotary movement of the inner housing. The piston is axially movable, but its angular position is fixed against rotation. It is particularly advantageous here that the piston is guided on both the inner housing and the outer housing, because an axial movement of the piston causes the inner housing to rotate.

In an advantageous further development, a first guide on the outer housing is formed on an inner wall of the outer housing. This first guide can be a projection or a groove. The first guide on the inner housing is an opening that completely passes through the wall of the inner housing. A first sliding element on the piston passes through the opening on the inner housing and rests on the wall on the inner housing and also on the projection or groove on the outer housing.

In an advantageous development, the first sliding element comprises a roller or several rollers. If only one roller is used, it could be so wide that it rests or is guided accordingly on both the inner housing and the outer housing. If several rollers are used, one roller can rest or be guided accordingly on the inner housing and one roller on the outer housing. They preferably share a common axis. The roller can consist of or comprise polytetrafluoroethylene, for example. The first sliding element can also comprise one or several sliding blocks, the edges preferably being rounded or beveled.

In an advantageous development, the first actuator comprises a return spring. The return spring is arranged on the piston and on the inner housing and is designed to exert a force on the piston so that it moves to an initial position. In this initial position, the toilet lid or the seat ring (if the toilet seat only comprises a seat ring) is lowered so that the toilet bowl is covered at the end. The water pressure must exert more force than the return spring so that the toilet seat can be raised. If the water can flow out of the actuator arrangement, for example back into the cistern (by adjusting the valve device accordingly), the return spring, possibly together with gravity, ensures that the toilet seat is lowered again. In particular, it is ensured that the toilet seat is pivoted out of the stable open "rest position", in which it is preferably opened by more than 90°, until the lowering movement is carried out by gravity.

In an advantageous further development, a locking device is provided. The locking device is designed to prevent movement of the inner housing relative to the outer housing in the longitudinal direction of the outer housing. This movement is prevented in particular when the first actuator raises or lowers the toilet lid or the seat ring (if the toilet seat only comprises a seat ring). This prevents the inner housing from being pushed out of the outer housing. However, it is ensured that the inner housing can be rotated relative to the outer housing (around the longitudinal axis of the outer housing).

In an advantageous development, the return spring (which is arranged in particular on the piston and on the inner housing) exerts a force to push the inner housing out of the outer housing. The outer housing comprises a first opening on the peripheral wall, with a groove extending on the inner wall of the outer housing starting from the first opening (which is not accessible from the outside) that runs in the longitudinal direction of the outer housing (preferably in the direction of the base). The inner housing comprises a first groove that extends in the peripheral direction. In an assembly position, the inner housing is pressed further into the outer housing against the spring force of the return spring in such a way that the first opening of the outer housing lies above the first groove of the inner housing in order to insert at least a first spherical locking element via the first opening in the outer housing. In a locking position, the inner housing is pressed further out of the outer housing relative to the outer housing by the return force of the spring. As a result, the first spherical locking element rests in the first groove of the outer housing and in the first groove of the inner housing, with the spherical locking element rolling in the first groove of the inner housing when the inner housing rotates. In the locking position, the first opening in the outer housing is no longer above the first groove of the inner housing. The spherical locking element can therefore no longer fall out of the first actuator. The spherical locking element therefore acts as a bearing and is arranged between the inner housing and the outer housing.

In an advantageous development, the inner housing of the first actuator comprises a fastening section. This fastening section protrudes from an opening in the outer housing. The opening in the outer housing is preferably arranged in the region of a first end of the outer housing, which is arranged opposite the bottom of the outer housing. The toilet seat is attached to this fastening section. The second actuator preferably also comprises a fastening section.

In an advantageous further development, the fastening section (together with the inner housing) can be pressed into the outer housing, which means that the toilet seat can be removed from the fastening section without tools. This makes it very easy to replace, clean and reinstall the toilet seat. Removal, especially in the radial direction to the longitudinal axis of the outer housing, only takes a few seconds.

In an advantageous development, the inner housing is pre-tensioned (in relation to the outer housing), whereby the fastening section (together with the inner housing) is pressed out of the outer housing after being released and can be locked into a (replaced) toilet seat. The pre-tensioning can be achieved by the return spring.

In an advantageous development, the first actuator comprises an opening accessible from outside the first actuator. A locking means, in particular a pin-shaped locking means, can be inserted into this opening when the fastening section is pressed into the outer housing, wherein the locking means is designed so that the fastening section remains in the pressed-in position. The locking means is inserted in particular transversely to the longitudinal direction along which the piston of the first actuator moves. The opening passes through the outer housing of the first actuator, wherein the locking means blocks movement of the inner housing in at least one direction. This ensures that the toilet lid can be removed more easily from the first actuator. The same can of course also apply to the second actuator with the seat ring.

In an advantageous development, a first hinge arm of the toilet lid is arranged in a rotationally fixed manner on the fastening section. The seat ring also comprises a first hinge arm, whereby the first hinge arm of the seat ring is only mounted on the fastening section, whereby when the first actuator is actuated, only the toilet lid is raised or lowered and not the seat ring. The torque from the first actuator is only transmitted to the toilet lid, but not to the seat ring.

In an advantageous development, the fastening section of the inner housing of the first actuator in the area where the first hinge arm of the seat ring is mounted has a circular cross-section, the first hinge arm of the seat ring having a corresponding circular opening. In addition or as an alternative to this, the fastening section of the inner housing in the area where the first hinge arm of the toilet lid is arranged in a rotationally fixed manner has a cross-section that deviates from a circular cross-section. The first hinge arm of the toilet lid has a shape that corresponds to this. It would also be possible for the first hinge arm of the toilet lid to be screwed to the fastening section and/or locked to form a plug connection. This then results in a transmission of the torque.

In an advantageous development, the actuator arrangement comprises a second actuator in the form of a hydraulic cylinder. The second actuator comprises a connection that is connected to the hose system. This connection is preferably made via a hydraulic quick connector or plug connector. This means that the second actuator can be separated from the hose system very quickly (e.g. when replacing it). The second actuator comprises an outer housing, an inner housing and a piston. The inner housing and/or the outer housing are preferably designed in one piece and preferably consist of or further comprise plastic. The second actuator is preferably constructed in principle in the same way as the first actuator. The inner housing is arranged in the outer housing and the piston is arranged in the inner housing. The second actuator is designed so that when the piston moves, the inner housing is rotated relative to the outer housing, with a second hinge arm of the seat ring (if the toilet seat includes a toilet lid) being attached to the inner housing in a rotationally fixed manner. A rotation of the inner housing therefore causes a rotation of the second hinge arm of the seat ring, which causes the seat ring to be raised or lowered. It is therefore very advantageous overall that the first actuator is only used for lifting and lowering the toilet lid and the second actuator is only used for lifting and lowering the seat ring. This means that the toilet lid can be lifted and lowered independently of the seat ring.

In an advantageous further development, the first actuator and the second actuator are arranged one on top of the other, rotated by 180°. The first actuator and the second actuator are penetrated by a common longitudinal axis. It can also be said that the first actuator and the second actuator are arranged anti-coaxially to each other. This means that the actuator arrangement is very space-saving.

In an advantageous development, the outer housing of the first actuator and the outer housing of the second actuator are manufactured in a common manufacturing process (in particular in a common plastic injection molding process) as a one-piece outer housing. A receiving space, which is delimited by the outer housing of the first actuator and in which the inner housing of the first actuator is arranged, is separated from a receiving space, which is delimited by the outer housing of the second actuator and in which the inner housing of the second actuator is arranged, by a common base. Pressurized water cannot therefore circulate back and forth between the two receiving spaces.

In an advantageous development, the valve device comprises a hose connection that can be connected to the pressurized water supply line. The valve device also comprises an output connection, which is connected, for example, to the cistern or the toilet bowl. The valve device also comprises at least one first actuator connection, which is connected to the actuator arrangement. The valve device is designed in a neutral position to separate all connections from one another. In this neutral position, neither water can flow into the actuator arrangement nor water can flow out of the actuator arrangement. In a first lifting position, the valve device is designed to connect the first actuator connection to the supply line connection. The first actuator connection is connected in particular to the connection of the first actuator. In the first lifting position, pressurized water is therefore directed from the water line to the actuator arrangement and thus to the first actuator. In a lowering position, the valve device is designed to connect the first actuator connection to the output connection. In this case, the water flows from the actuator arrangement via the valve device to the output connection of the valve device and thus preferably back into the cistern. The toilet lid or the seat ring (if the toilet seat does not have a toilet lid) begins to lower. Preferably, a return device is also provided for this purpose, which serves to bring the toilet lid or the seat ring into a position so that an angle between the toilet lid or the seat ring and the (supporting surface of the) toilet bowl is less than 90°, so that the further sinking of the toilet lid or the seat ring and thus the displacement of the water from the actuator arrangement takes place (also) by means of gravity.

In an advantageous development, the valve device comprises a reset device which is designed to move the valve device into the neutral position. This prevents the actuator arrangement from being permanently connected to the line connection. The toilet lid and/or seat ring remain in the current position when the neutral position is selected. The toilet lid or the seat ring can then be completely open or rest on the toilet bowl. Intermediate positions are also conceivable in this case.

In an advantageous development, the actuator arrangement comprises a first actuator and a second actuator, the first actuator being designed to raise and lower the toilet lid and the second actuator being designed to raise and lower the seat ring. The first actuator connection is connected to the first actuator. The valve device also comprises a second actuator connection which is connected to the second actuator. In a second lifting position, the valve device is designed to connect the first actuator connection to the supply line connection and to also connect the second actuator connection to the supply line connection. The connection to the supply line connection can be made directly or indirectly. An indirect connection could be made by connecting the second actuator connection to the line connection via the first actuator connection or by connecting the first actuator connection to the line connection via the second actuator connection. The valve device is designed in a lowered position to connect the second actuator connection to the output connection. In this position, the water from the second actuator is directed either into the toilet bowl or back into the cistern.

In an advantageous development, the valve device comprises a ball valve. This ball valve has four connections offset from one another (line connection, first actuator connection, second actuator connection, output connection) which are connected to one another or just not connected to one another via the channel or channels (first channel, second channel) in the ball depending on the selected position (neutral position, first lifting position, second lifting position, lowered position).

In an advantageous development, the valve device comprises a first, second and third valve unit. The respective valve units can be accommodated in a common valve block or in different, separate housings. Each valve unit comprises a piston, wherein the respective pistons are movable in a receiving chamber within the first, second and third valve unit. The respective pistons are movable in the axial direction. The first, second and third valve units each comprise an actuating element. These actuating elements are connected to the respective piston, so that pressing the actuating element results in the respective piston being displaced within the respective receiving chamber of the valve unit. There is preferably a rigid connection between the actuating element and the respective piston. The receiving chamber of the first valve unit is connected to the supply line connection and the first actuator connection. The receiving chamber of the second valve unit is connected to the second actuator connection and connected to the supply line connection via the receiving chamber of the first valve unit. The receiving chamber of the third valve unit is connected to the output connection. The valve unit is designed so that when the first actuating element of the first valve unit is actuated, the first actuator connection can be connected to the supply line connection, as a result of which the toilet lid is raised. In this case, the first lifting position is assumed. The valve unit is also designed so that when the actuating element of the first valve unit is actuated, the first actuator connection can be connected to the supply line connection and when the actuating element of the second valve unit is actuated, the second actuator connection can be connected to the supply line connection. As a result, the toilet lid and the seat ring are raised. In this case, the second lifting position is assumed. The valve unit is also designed so that if the actuating element of the first valve unit is not actuated and if the actuating element of the third valve unit is actuated, the first and second actuator connections can be connected to the output connection, as a result of which the toilet lid and the seat ring are lowered.

In an advantageous development, the first, second and third valve units comprise separate housings. The respective housings are connected to one another via hoses. The modular design allows the valve device to be manufactured particularly inexpensively.

In an advantageous development, the valve device comprises a control device. The control device comprises a first, second and third button. The first button comprises a touch panel and a transmission rod, wherein the touch panel is arranged at one end of the transmission rod and wherein the transmission rod is designed to actuate the actuating element of the first valve unit when the touch panel is pressed. The second button comprises a touch panel and a transmission rod, wherein the touch panel is arranged at one end of the transmission rod and wherein the transmission rod is designed to actuate the actuating element of the second valve unit when the touch panel is pressed. The third button comprises a touch panel and a transmission rod, the touch panel being arranged at one end of the transmission rod and the transmission rod being designed to actuate the actuating element of the third valve unit when the touch panel is pressed. The second button is designed to also actuate the actuating element of the first valve unit when it is actuated. The third button is designed to only actuate the actuating elements of the second and third valve units when it is actuated and to leave the actuating element of the first valve unit unactuated. The buttons preferably protrude from a cover of the toilet system, in particular from a cover of the cistern. The buttons are further preferably pre-tensioned by a spring force so that when the button is not actuated, no actuating element of the corresponding valve unit is actuated. It is particularly advantageous that when the second button is actuated, the actuating element of the first valve unit is also actuated because this reliably raises the toilet seat, which in this case comprises the toilet lid and the seat ring. Furthermore, it is particularly advantageous that when the third button is pressed, only the actuating element of the second valve unit is actuated and not the actuating element of the first valve unit. This ensures that the water can flow out of the respective valve units and that no new water flows in via the first valve unit. In this case, the toilet seat lowers safely.

In an advantageous development, the valve device comprises a control device. The control device comprises an actuating element, in particular in the form of a handle, and a transmission rod. The actuating element is connected to one end of the transmission rod. First, second and third actuating devices are formed on the transmission rod. These are preferably arranged axially offset along the transmission rod. They extend radially outwards. In a first rotational angle position of the transmission rod, the first actuating device contacts the actuating element of the first valve unit. In a second rotational angle position of the transmission rod, the first actuating device contacts the actuating element of the first valve unit and the second actuating device contacts the actuating element of the second valve unit. In a third rotational angle position of the transmission rod, the actuating element of the first valve unit is out of contact with the first actuating device, the second actuating device contacts the actuating element of the second valve unit and the third actuating device contacts the actuating element of the third valve unit. The adjustment device is introduced in particular into a cover of the toilet system, in particular into a cover of the cistern. Depending on the rotation of the actuating element, only the toilet lid is raised, or both the toilet lid and the seat ring are raised, or both the toilet lid and the seat ring are lowered. The adjustment device is preferably pre-tensioned by a spring force so that when the adjustment device is not actuated, no actuating element of the corresponding valve unit is actuated.

In an advantageous development, the valve device comprises a control device. The control device comprises a dial that is arranged adjacent to the actuating elements of the first, second and third valve units. The dial comprises elevations that are directed in the direction of the actuating elements of the first, second and third valve units and can be brought into contact with these actuating elements. The elevations can also be connected to form a common elevation. Depending on the angular position of the dial, all actuating elements are arranged without contact with the elevations, whereby the neutral position is assumed. In this case, no piston is moved within the respective receiving chamber. In another angular position, only the actuating element of the first valve unit comes into contact with an elevation, whereby only the piston in the receiving chamber of the first valve unit is moved. In this case, the first lifting position is assumed. In another angular position, only the actuating elements of the first and second valve units come into contact with the elevations, whereby the second lifting position is assumed. In a different angular position, only the actuating element of the third valve unit comes into contact with a raised area, whereby the lowering position is assumed. This is a particularly simple way of avoiding impermissible states (all actuating elements are actuated at the same time).

In an advantageous development, the valve device comprises a valve housing which surrounds a receiving space in which a piston is arranged so as to be displaceable in the longitudinal direction of the receiving space. The supply line connection, the first actuator connection and the output connection are connected to the receiving space, with the connections opening into the receiving space offset from one another in the longitudinal direction. The piston has thickenings on its circumference which are arranged at a distance from one another in the longitudinal direction. These thickenings lie flush against an inner wall of the valve housing, whereby the receiving space is divided into different chambers. In the neutral position, the piston is arranged in such a way that the line connection, the first actuator connection and the output connection open into separate chambers or are separated from one another. This means that no water can circulate between the respective connections. In the first lifting position, the piston is arranged such that the line connection and the first actuator connection open into the same chamber. Therefore, water flows from the line connection to the first actuator connection and the toilet lid or the seat ring (if the toilet seat does not include a toilet lid) rises. In the lowering position, the piston is arranged such that the first actuator connection and the output connection open into the same chamber. In this case, water flows from the first actuator connection to the output connection and the toilet lid or the seat ring (if the toilet seat does not include a toilet lid) lowers.

In an advantageous development, the second actuator connection is connected to the receiving space, with all connections opening into the receiving space offset in the longitudinal direction (and optionally at least partially or completely offset in the circumferential direction) from one another. In the second lifting position, the piston is arranged such that the line connection, the first actuator connection and the second actuator connection open into the same chamber. As a result, water flows from the line connection to the first actuator connection and to the second actuator connection. In this case, the toilet lid and the seat ring are raised.

In an advantageous development, the valve device comprises a reset device (e.g. a spring) which is designed to move the valve device into the neutral position. The valve device comprises a pre-tensioned locking device with a latching element (e.g. a ball). In the neutral position, the latching element engages in a groove on the circumference of the piston in such a way that the force of the reset device is not sufficient to bring the latching element of the locking device out of engagement with the groove. The piston remains in the neutral position and is not pushed further out of the valve housing.

The building according to the invention comprises a toilet system as described at the beginning. The toilet bowl is mounted on the wall or on the floor of the building. The building comprises a pressurized water supply line. A second end of the inlet pipe is connected to the pressurized water supply line directly or indirectly (for example via a cistern).

Figure 2:
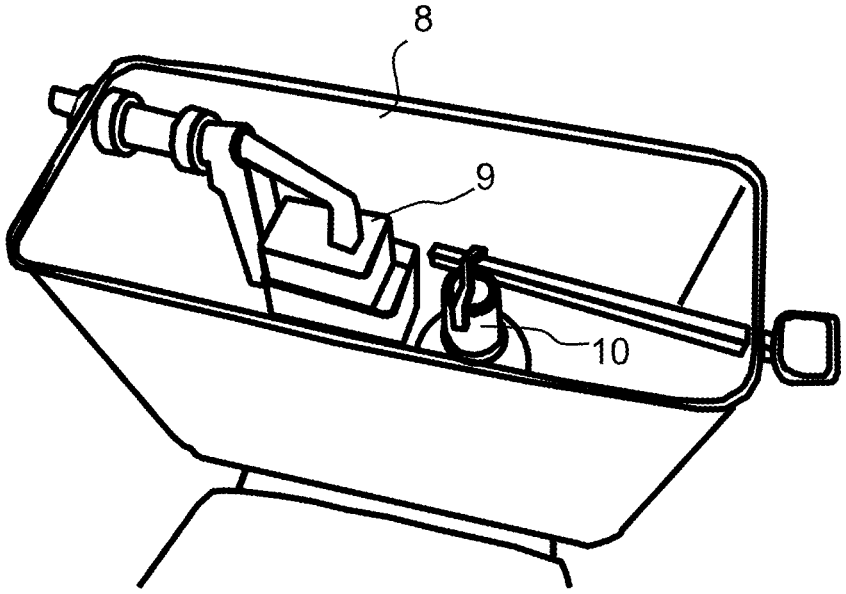
Figure 3:
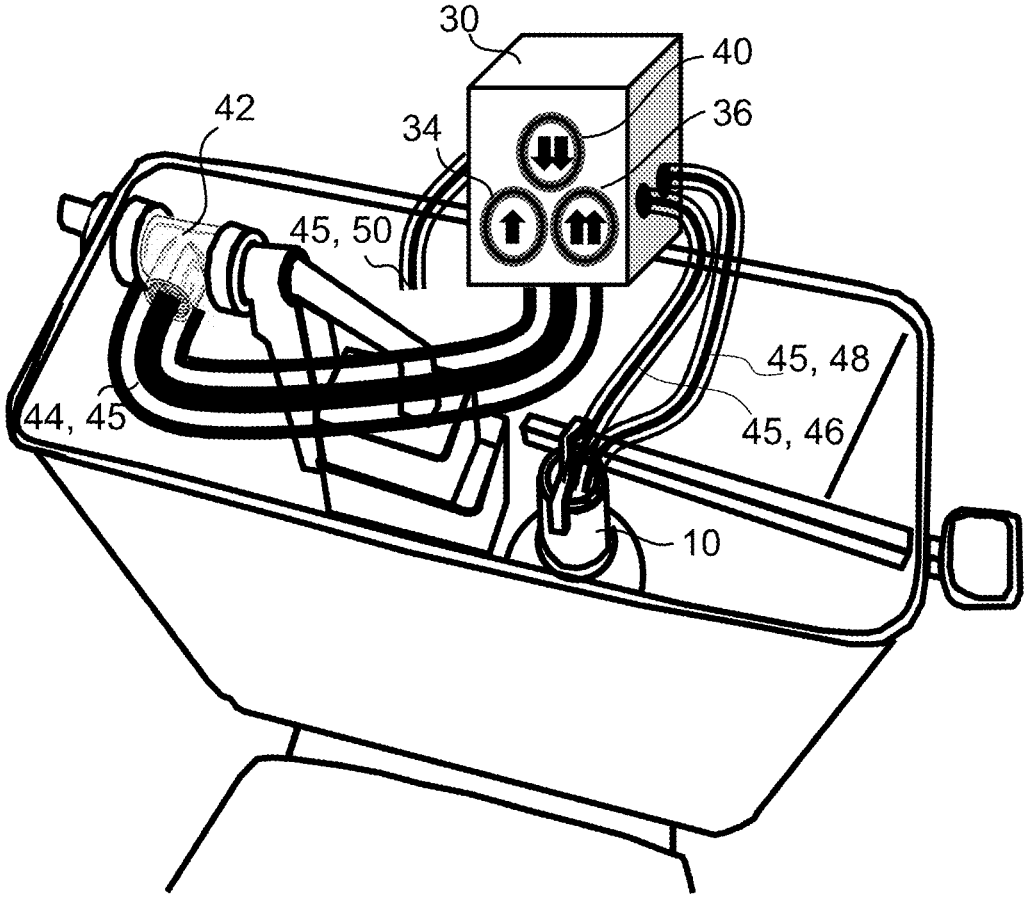
Figure 4:
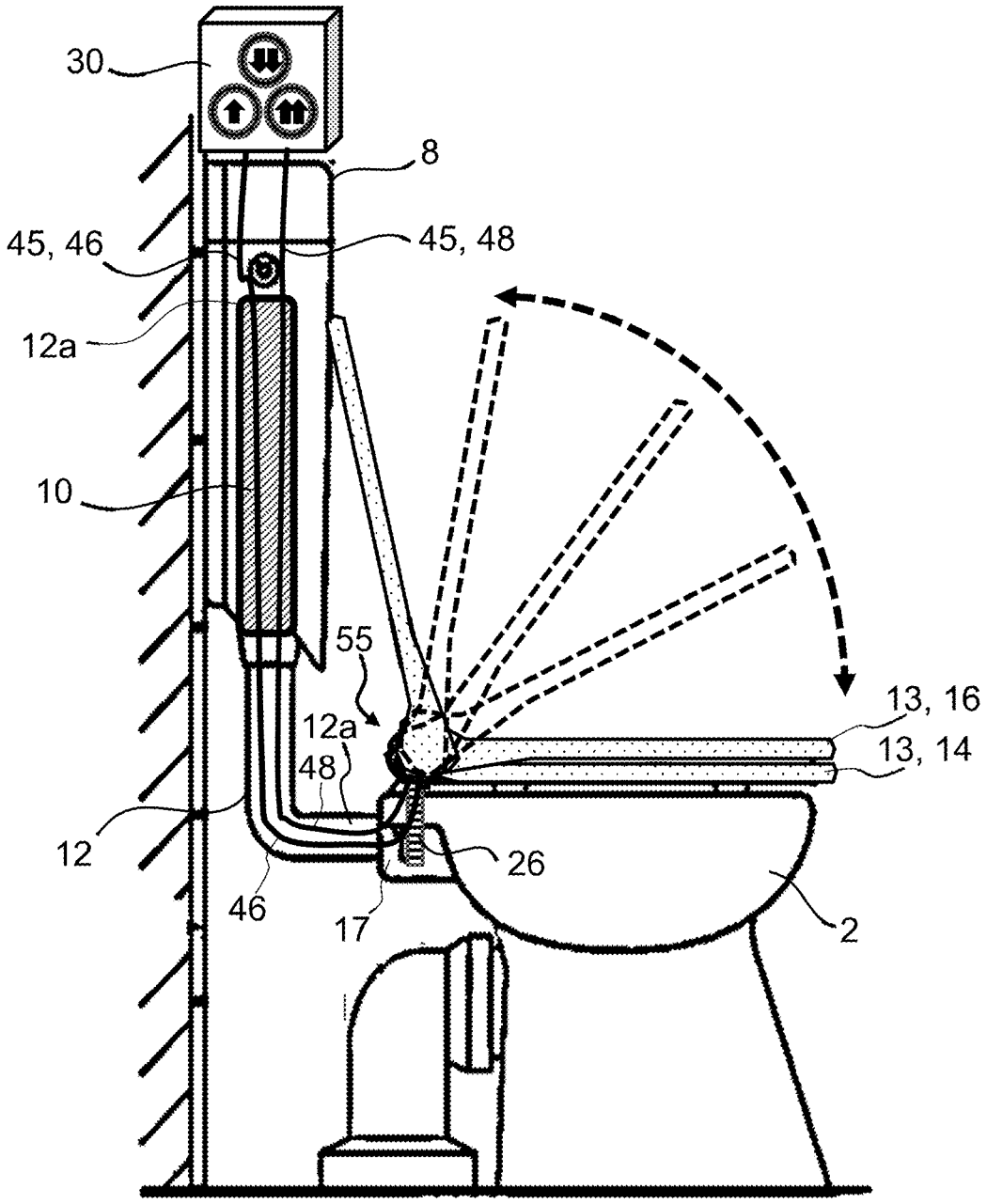
Figure 5:
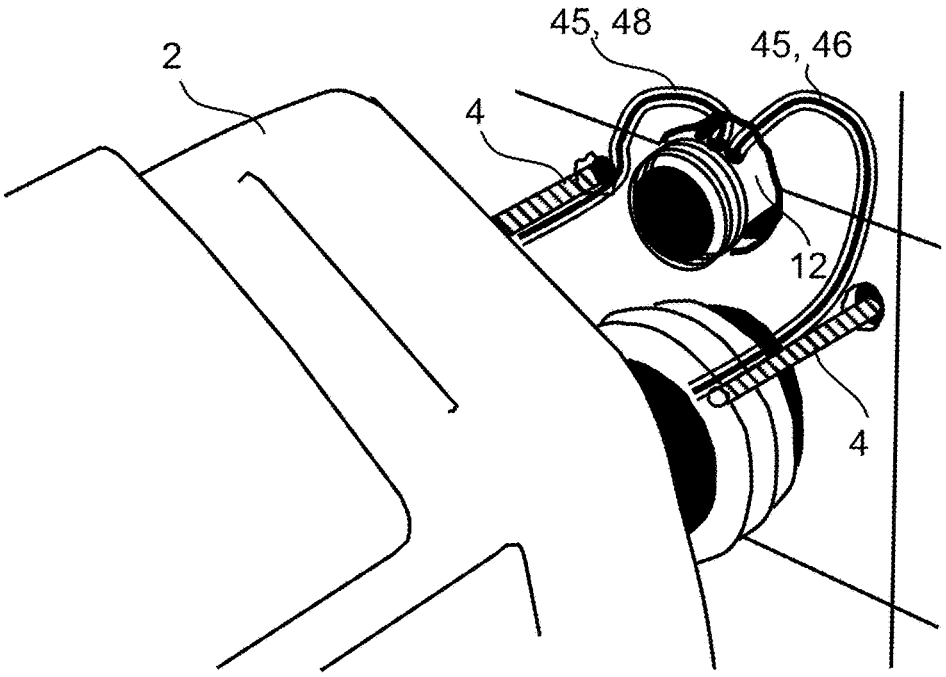
Figure 6:
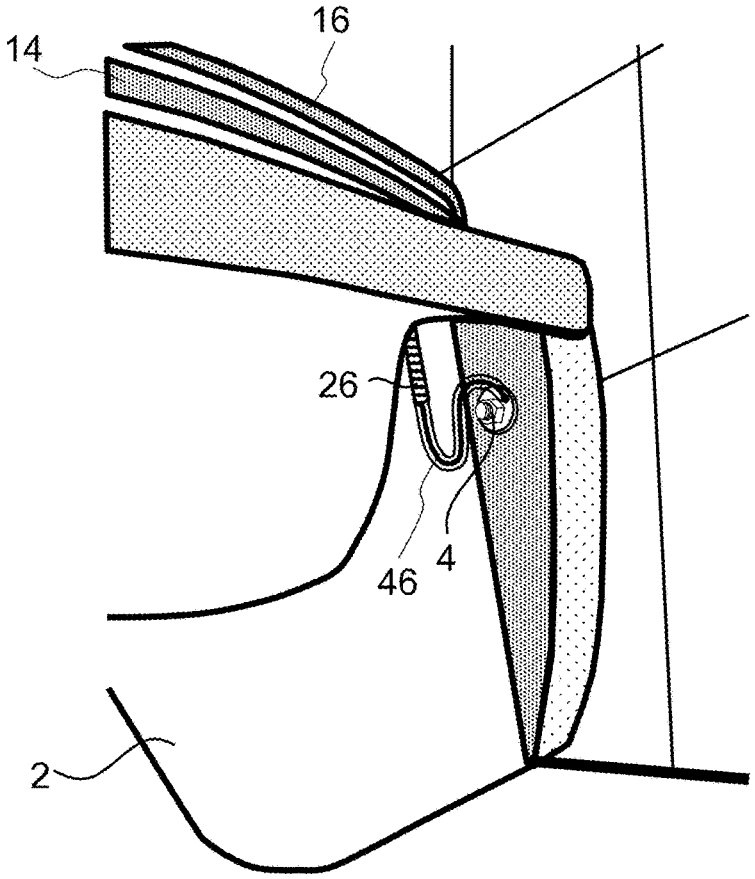
Figure 7:
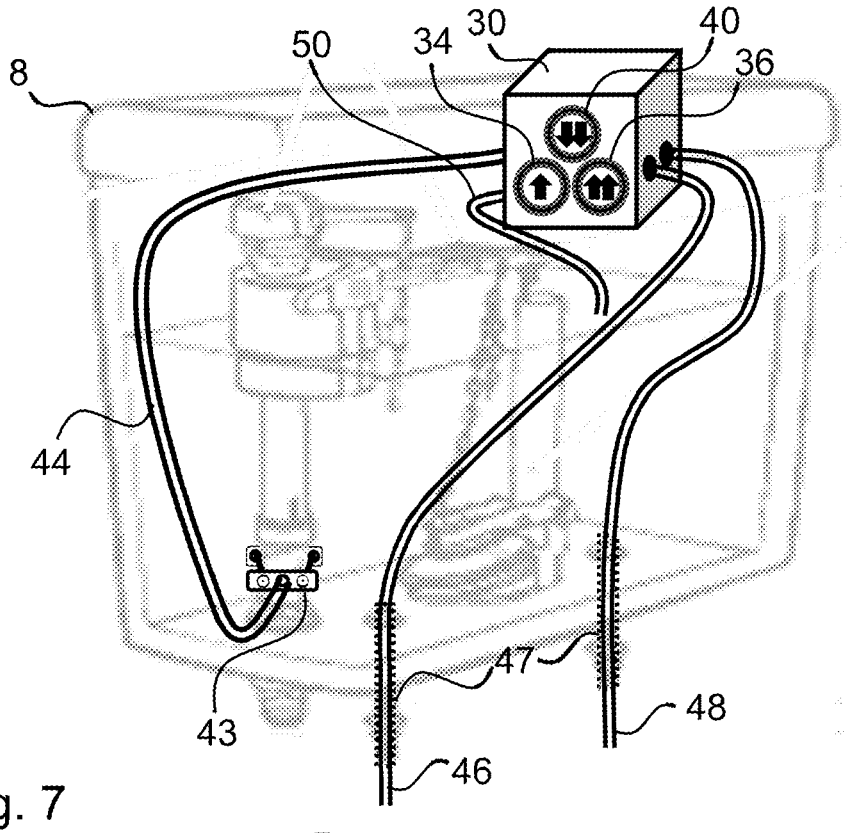
Figure 8:
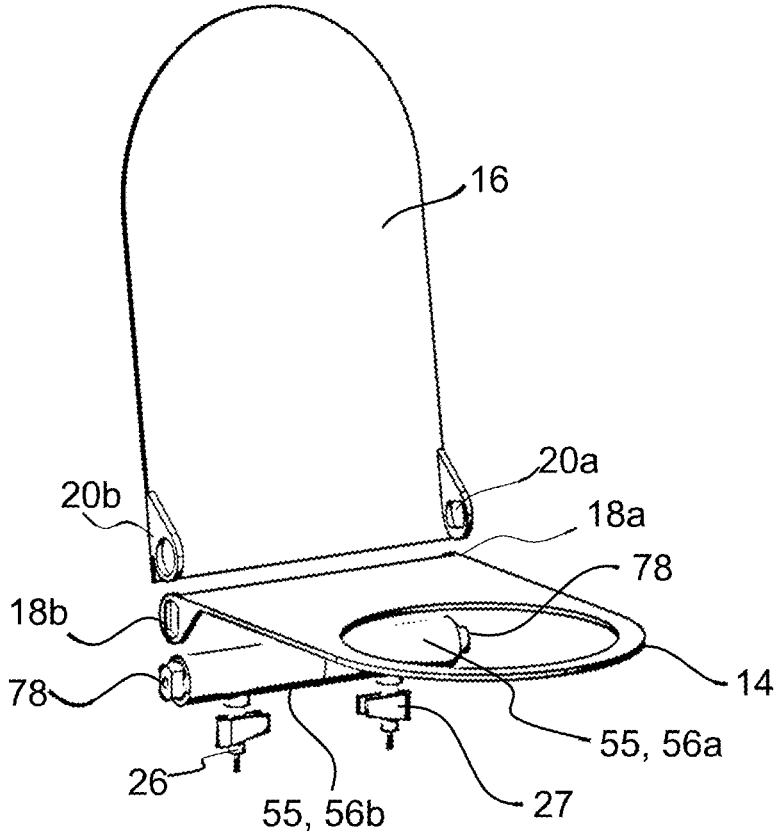
Figure 9:
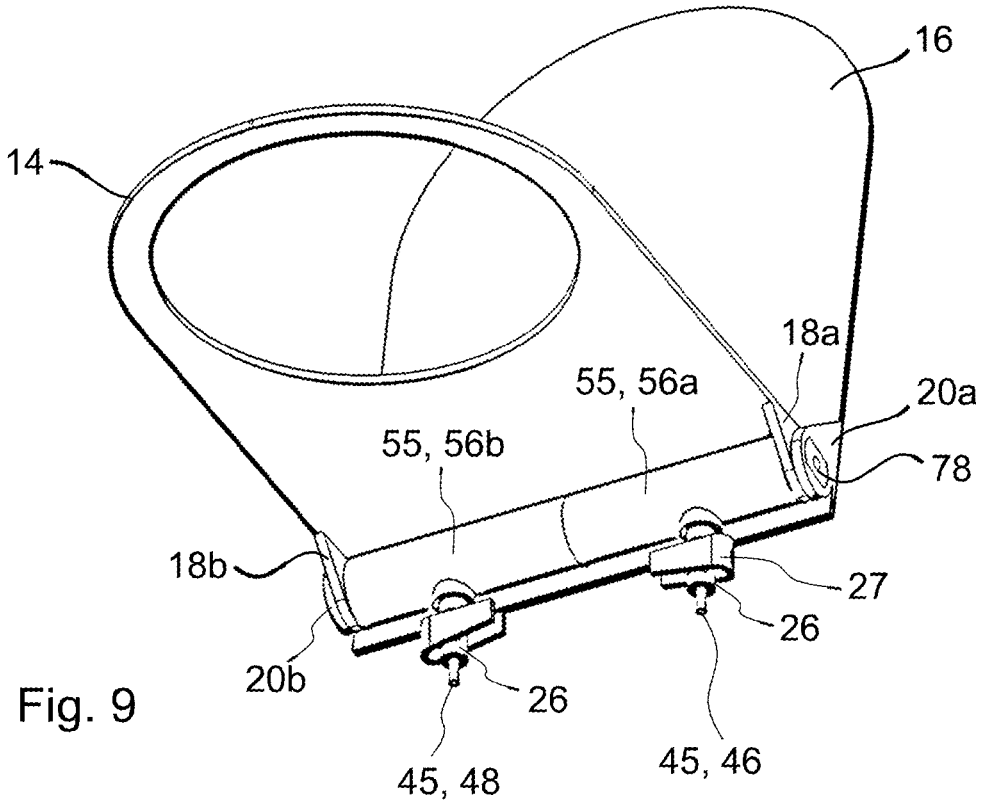
Figure 10:
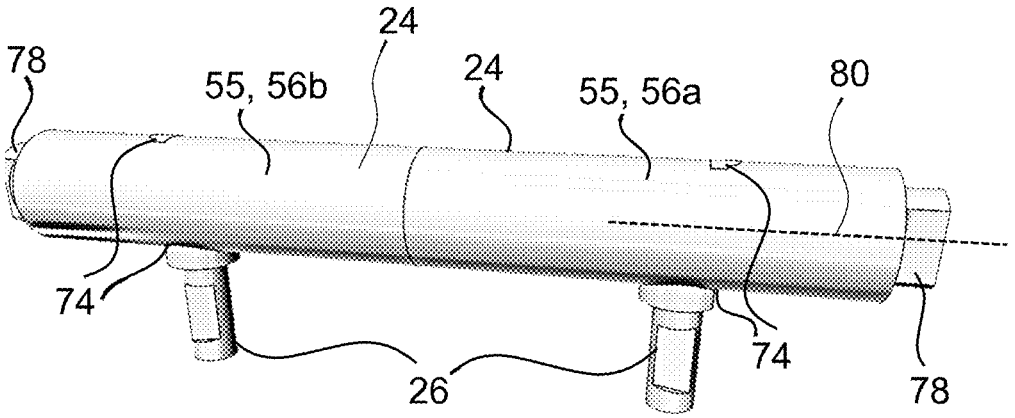
Figure 11:
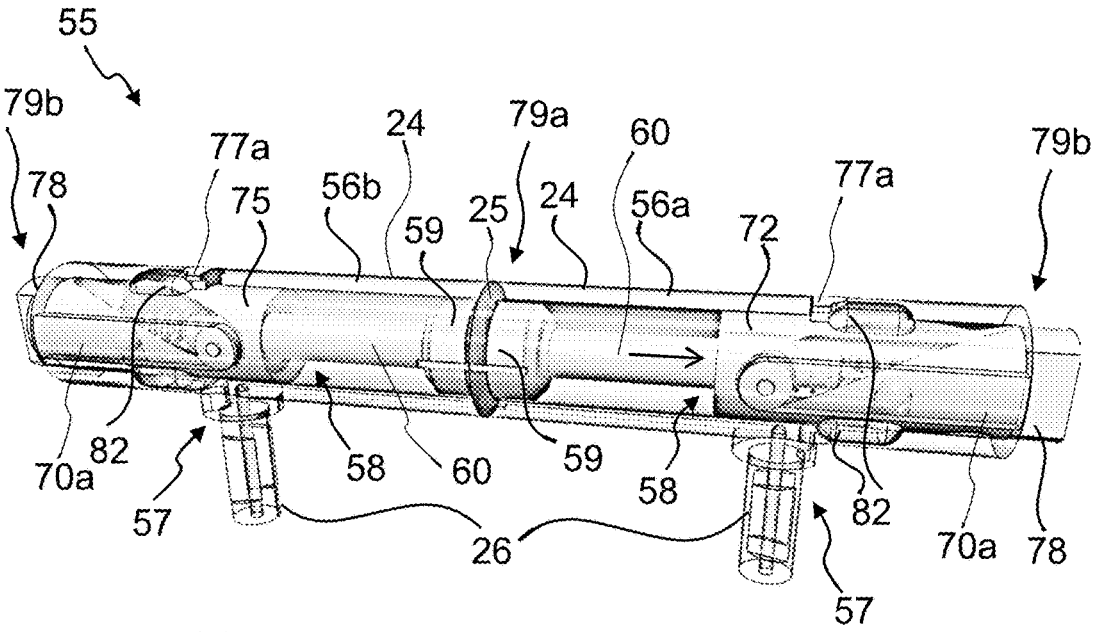
Figure 12:
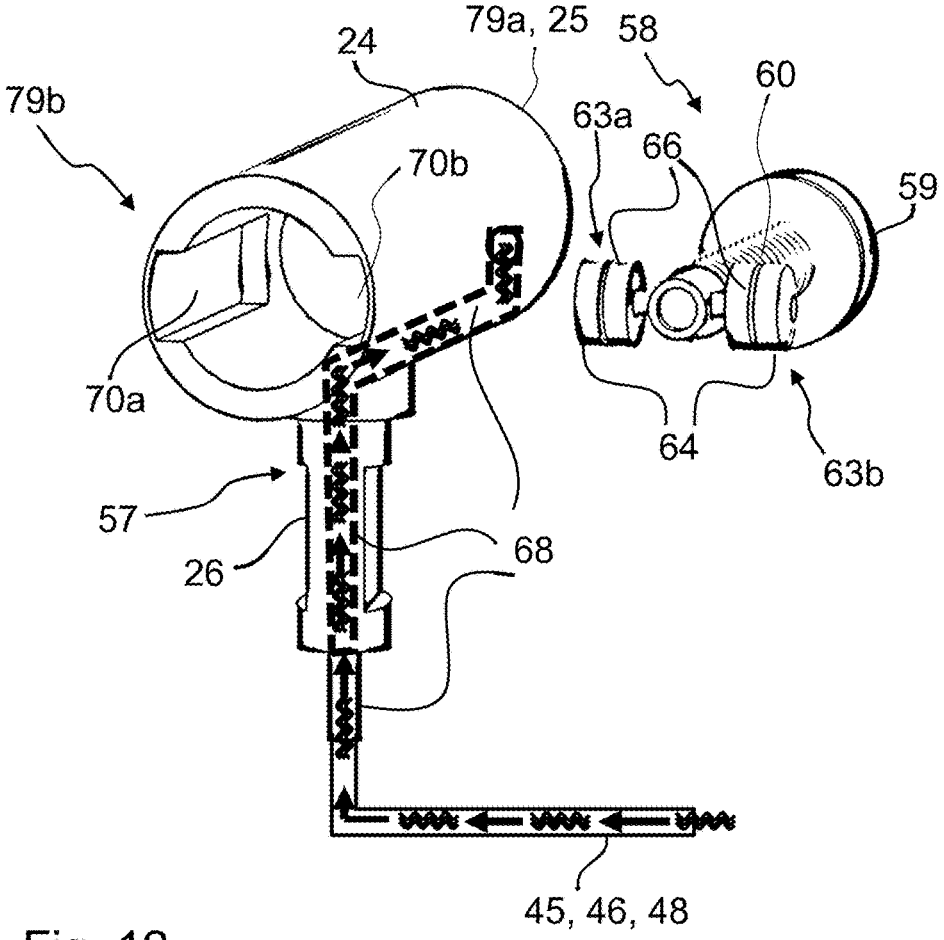
Figure 13:
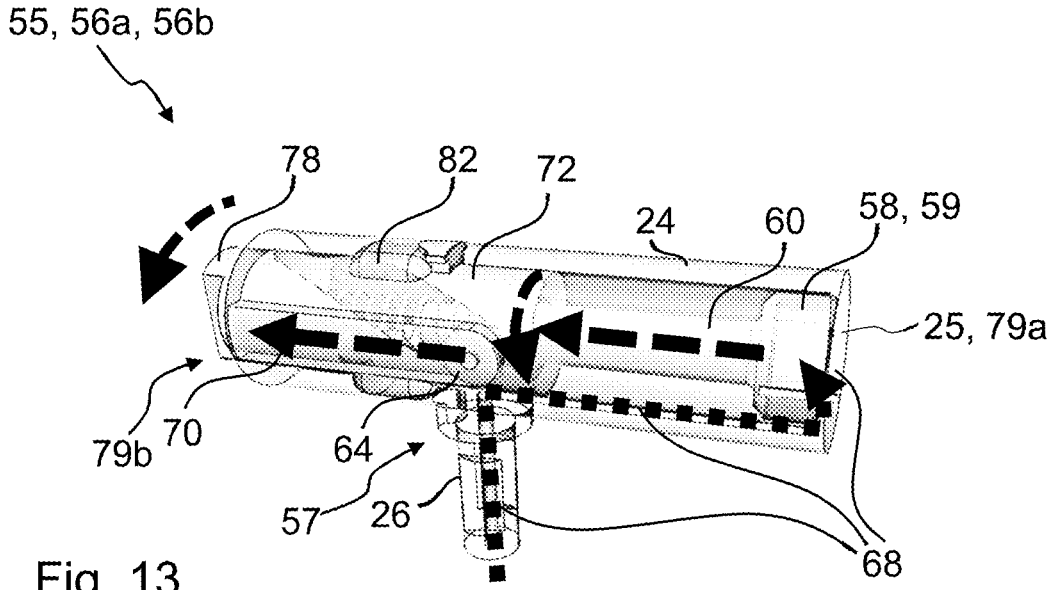
Figure 14:
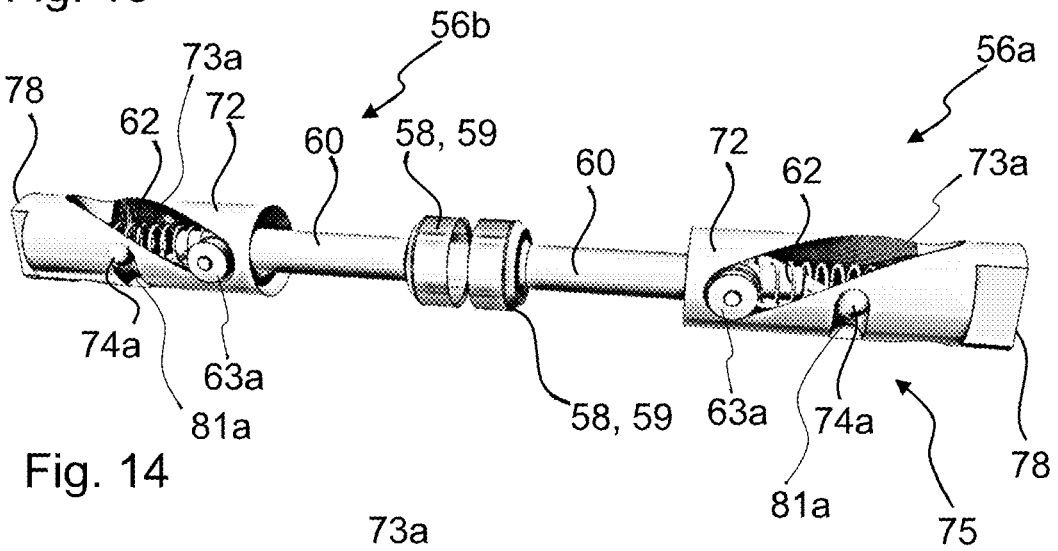
Figure 15:
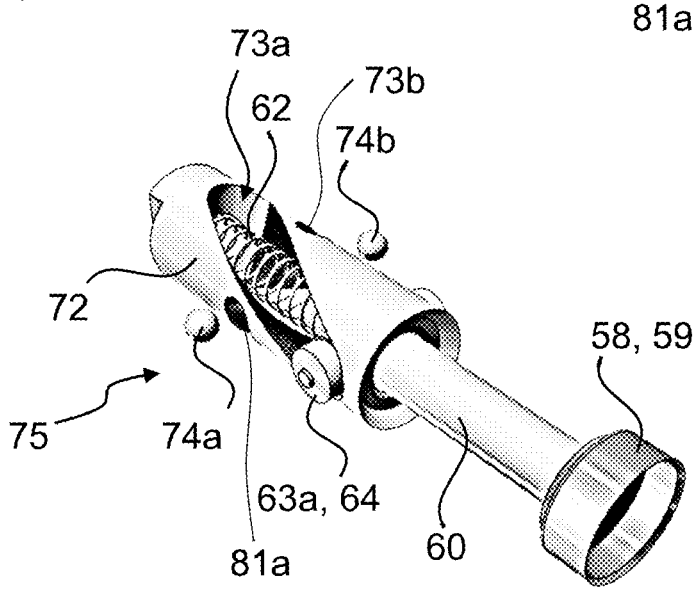
Figure 16:
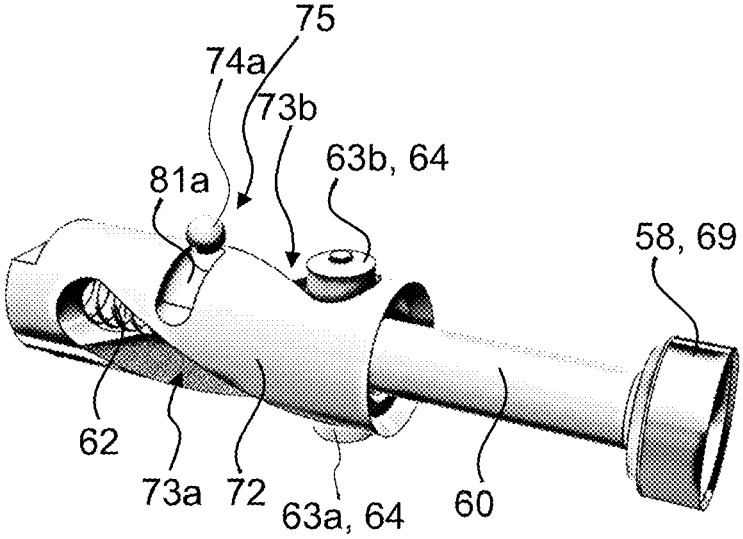
Figure 17:
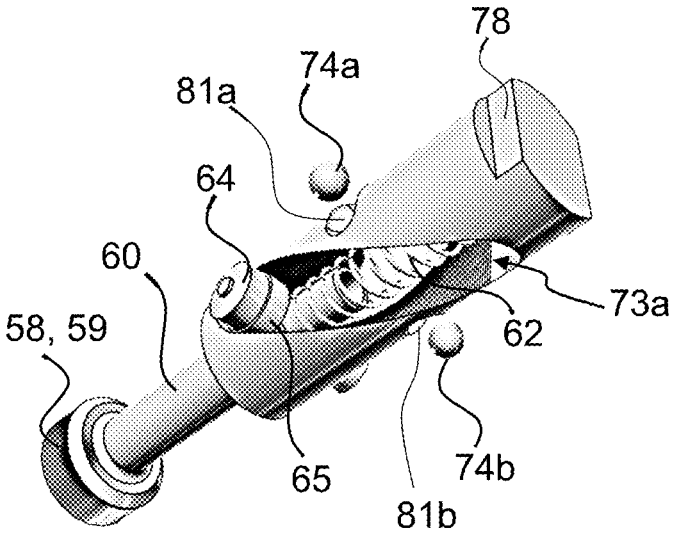
Figure 18:
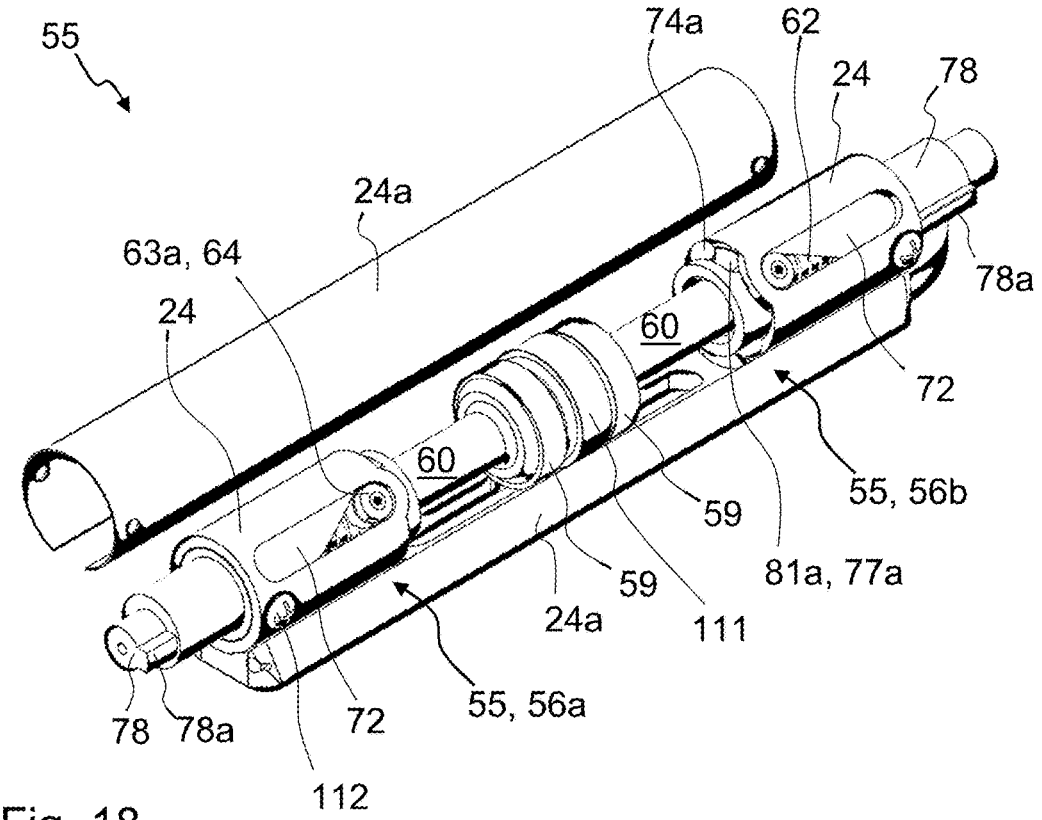
Figure 19:
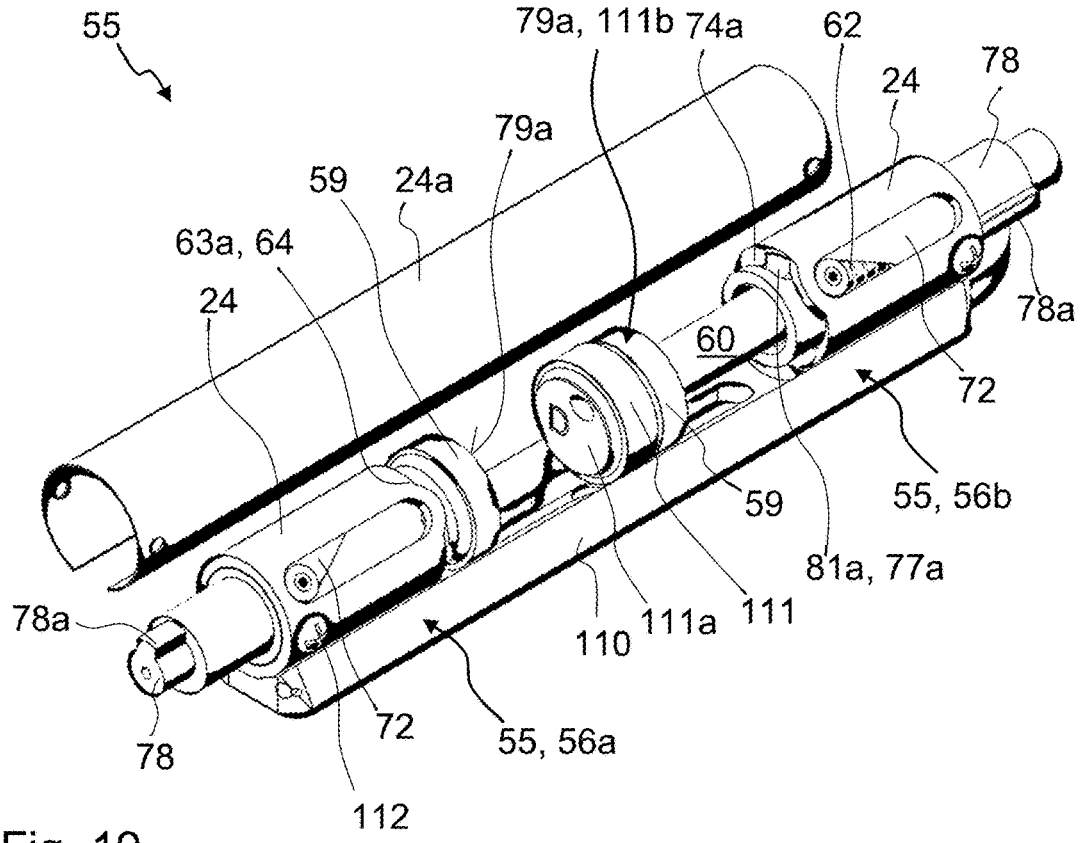
Figure 20:
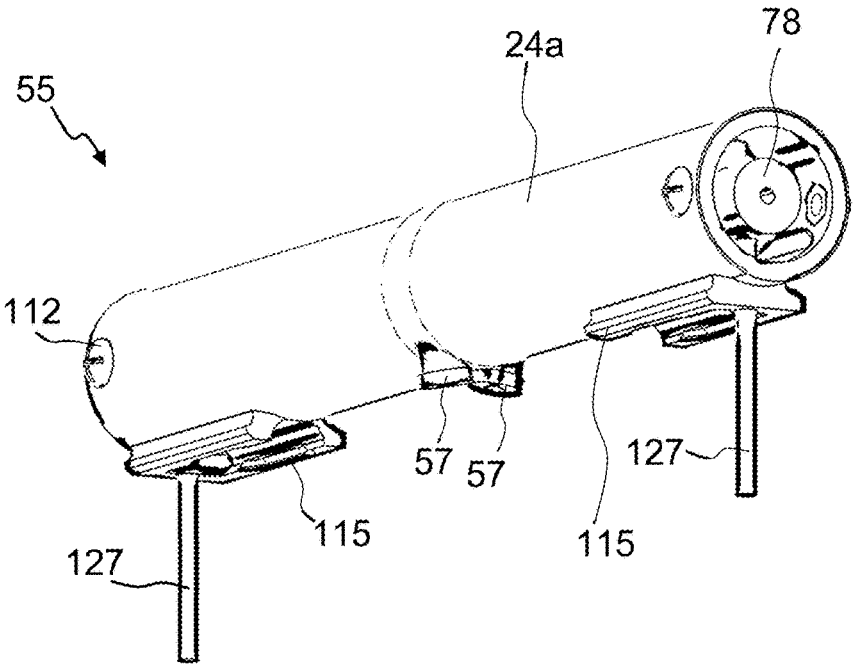
Figure 21:
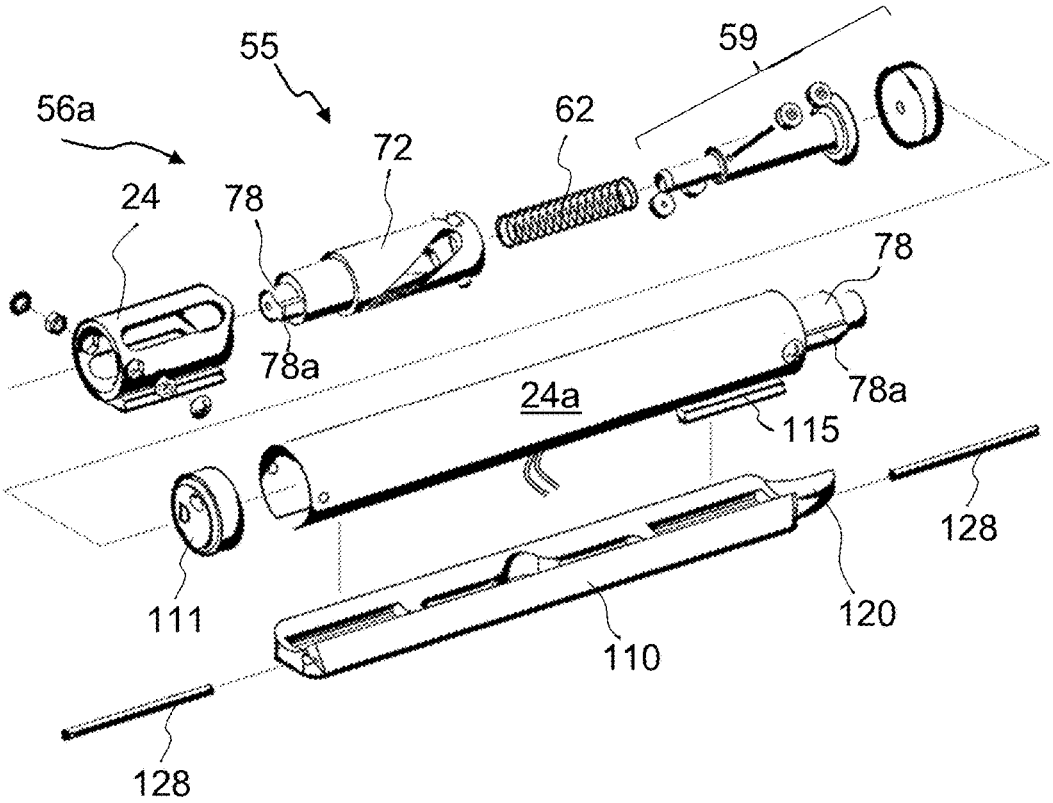
Figure 22:
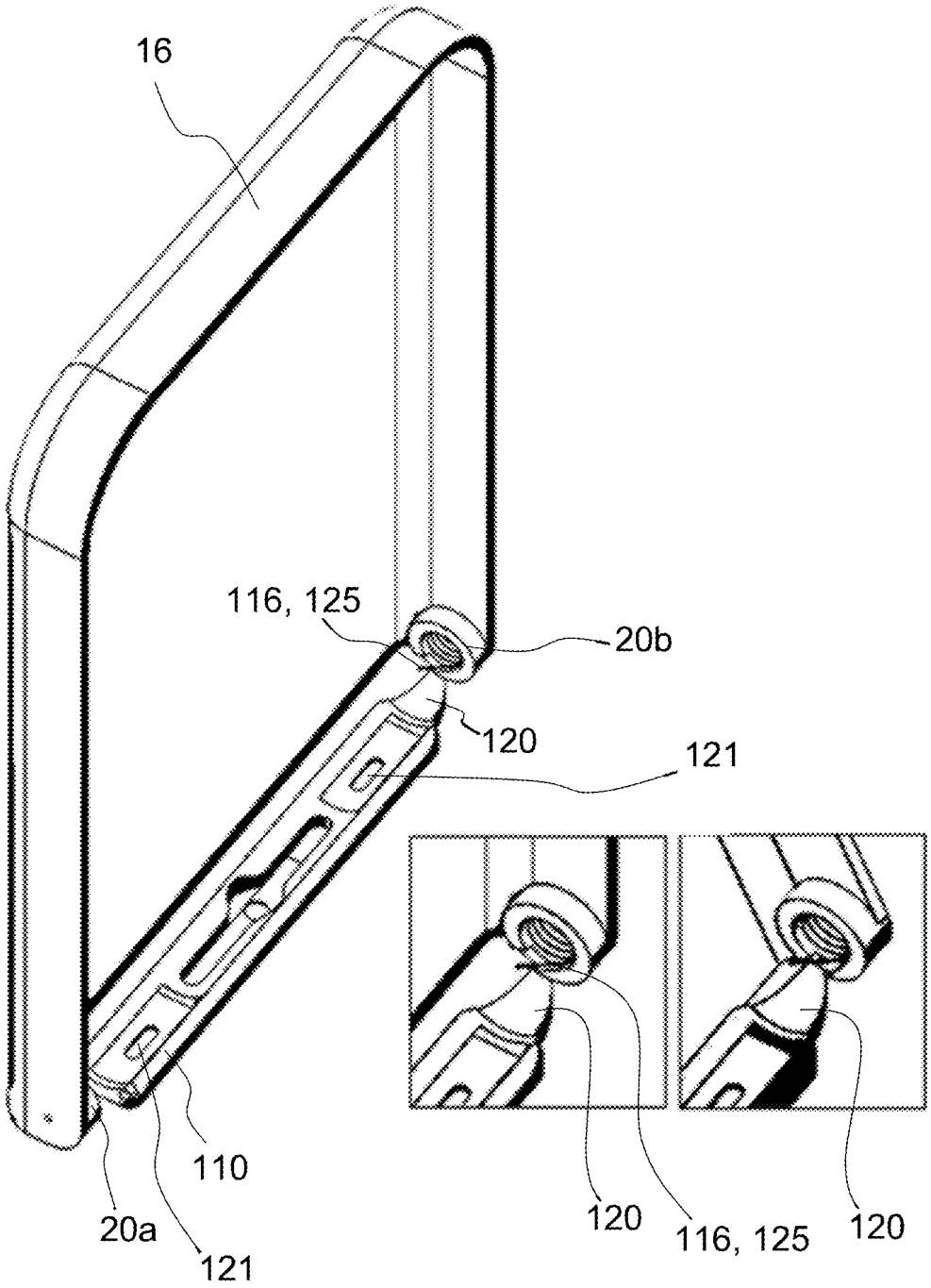
Figure 23:
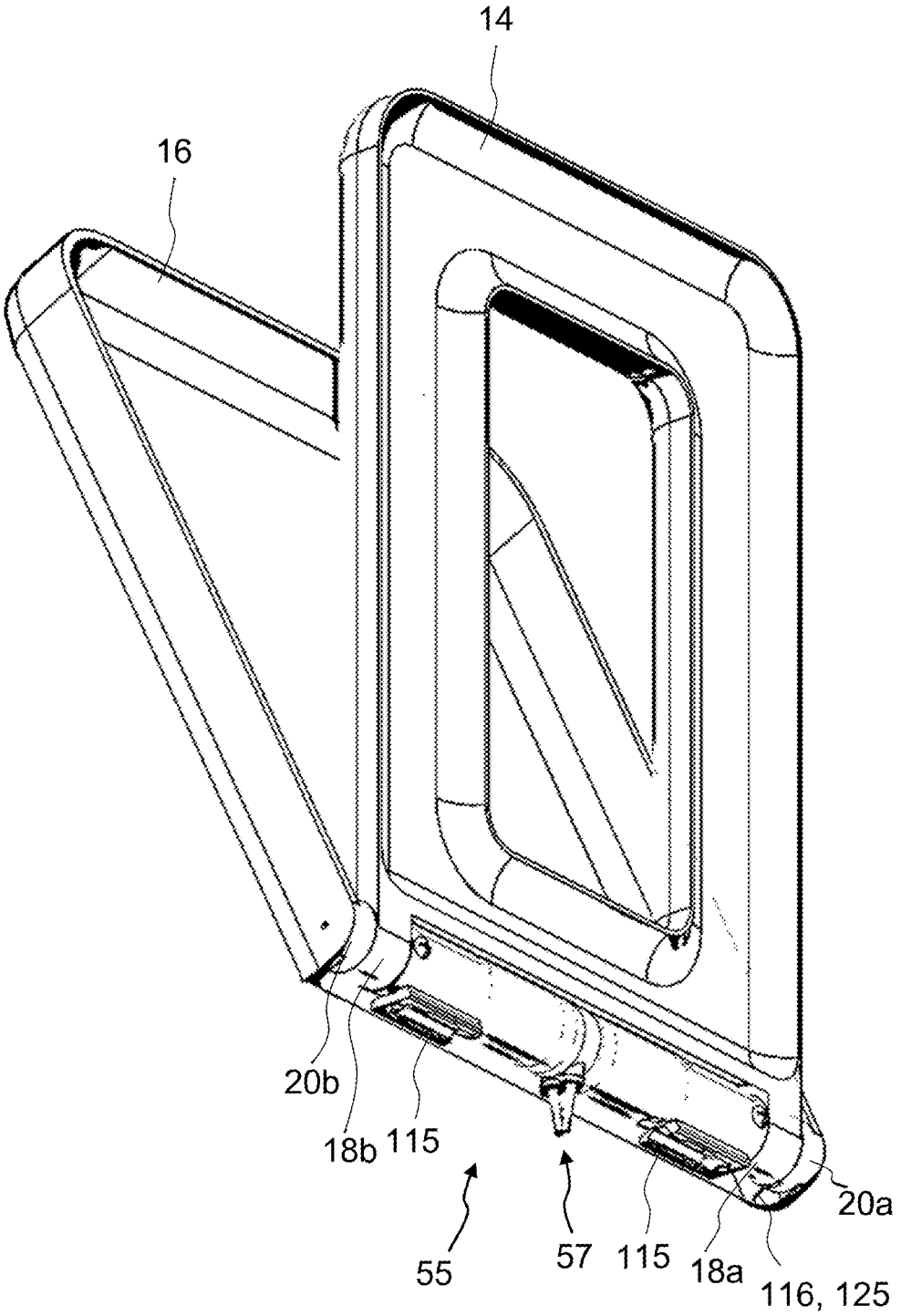
Figure 24:
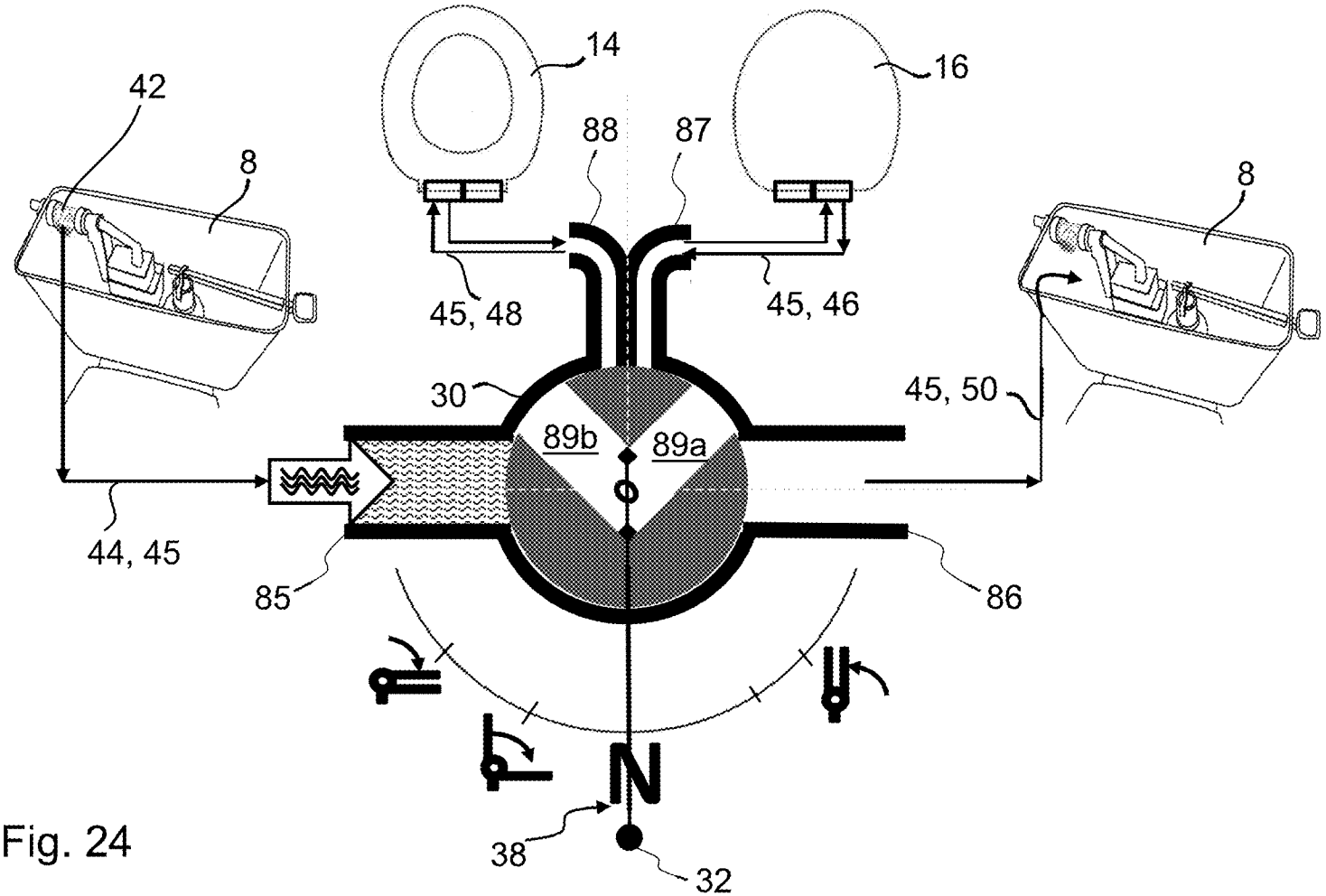
Figure 29:
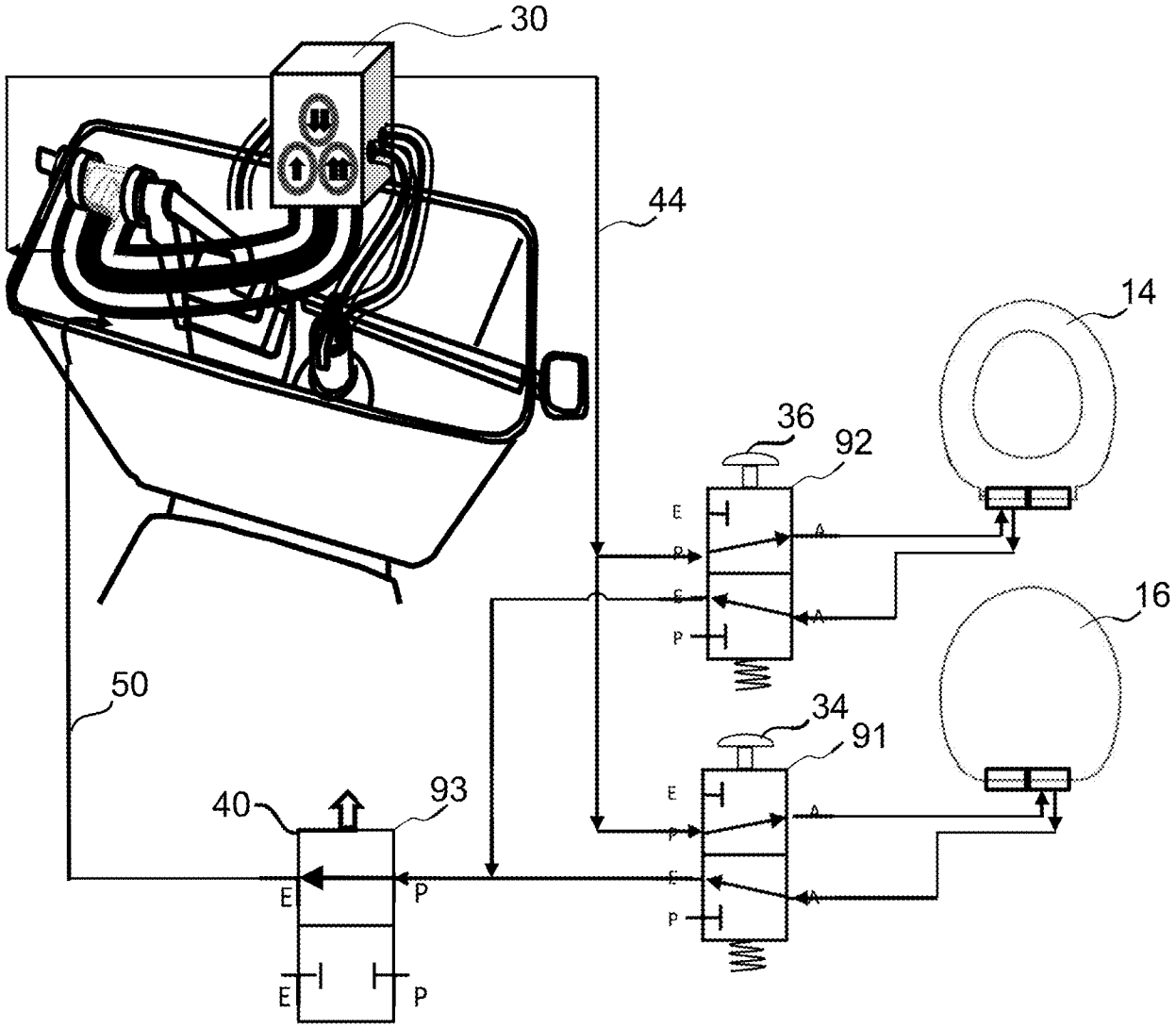
Figure 32:
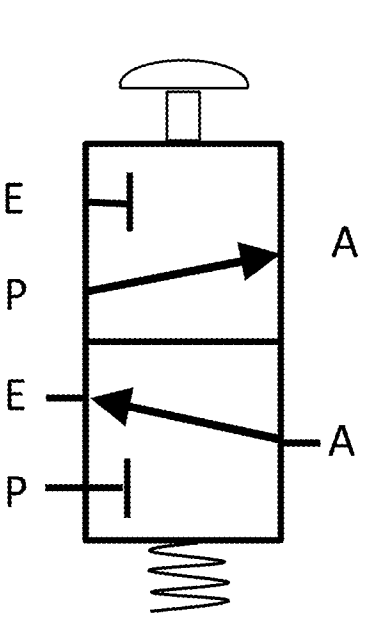
Figure 31:
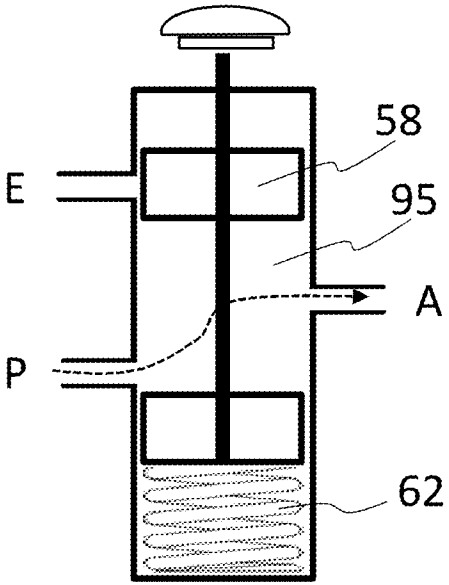
Figure 30:
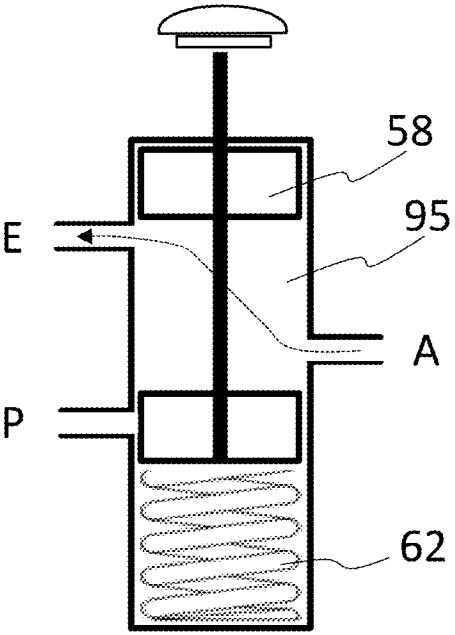
Figure 51:
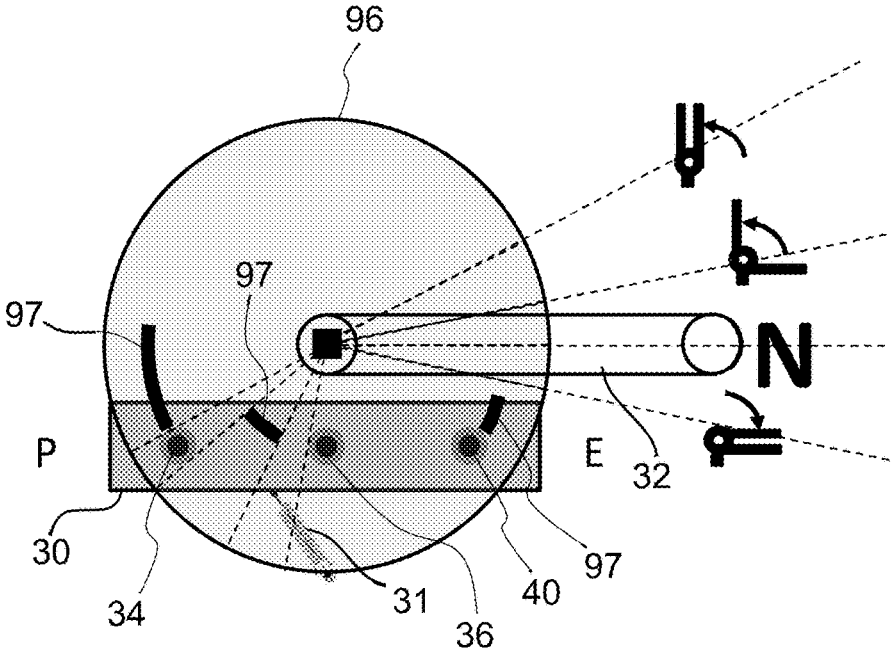
Figure 53:
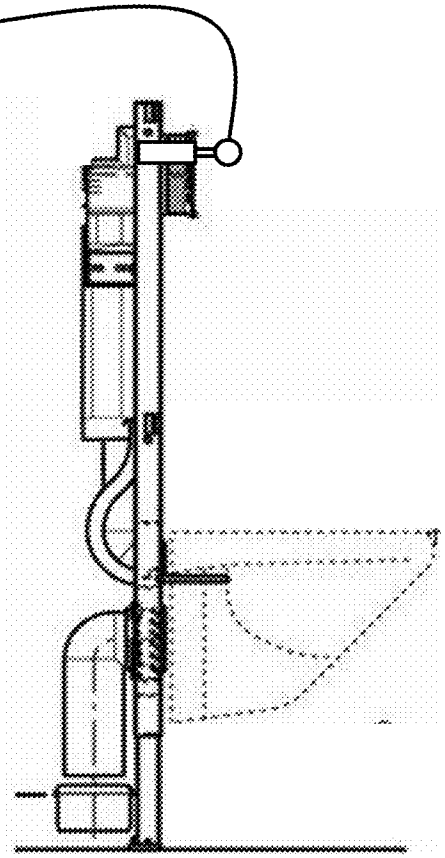
Figure 52:
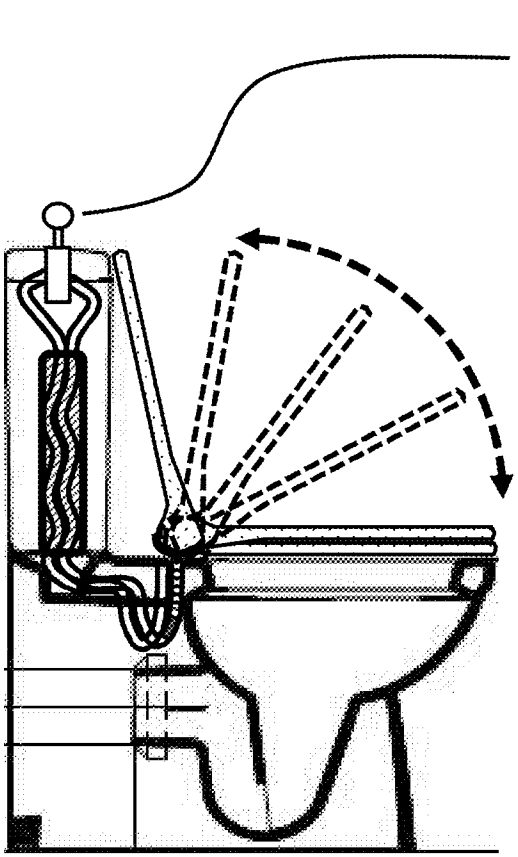
Figure 54:
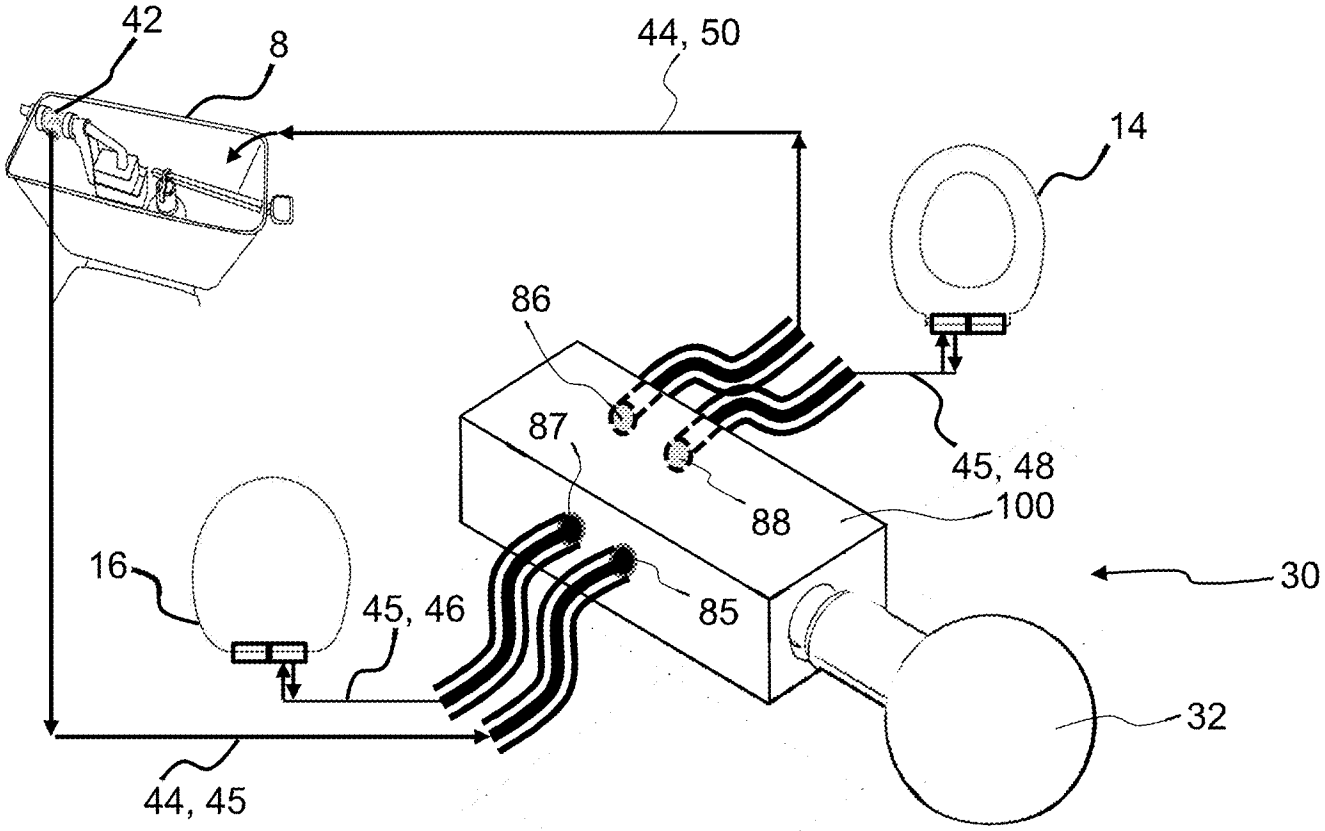
Figure 55:
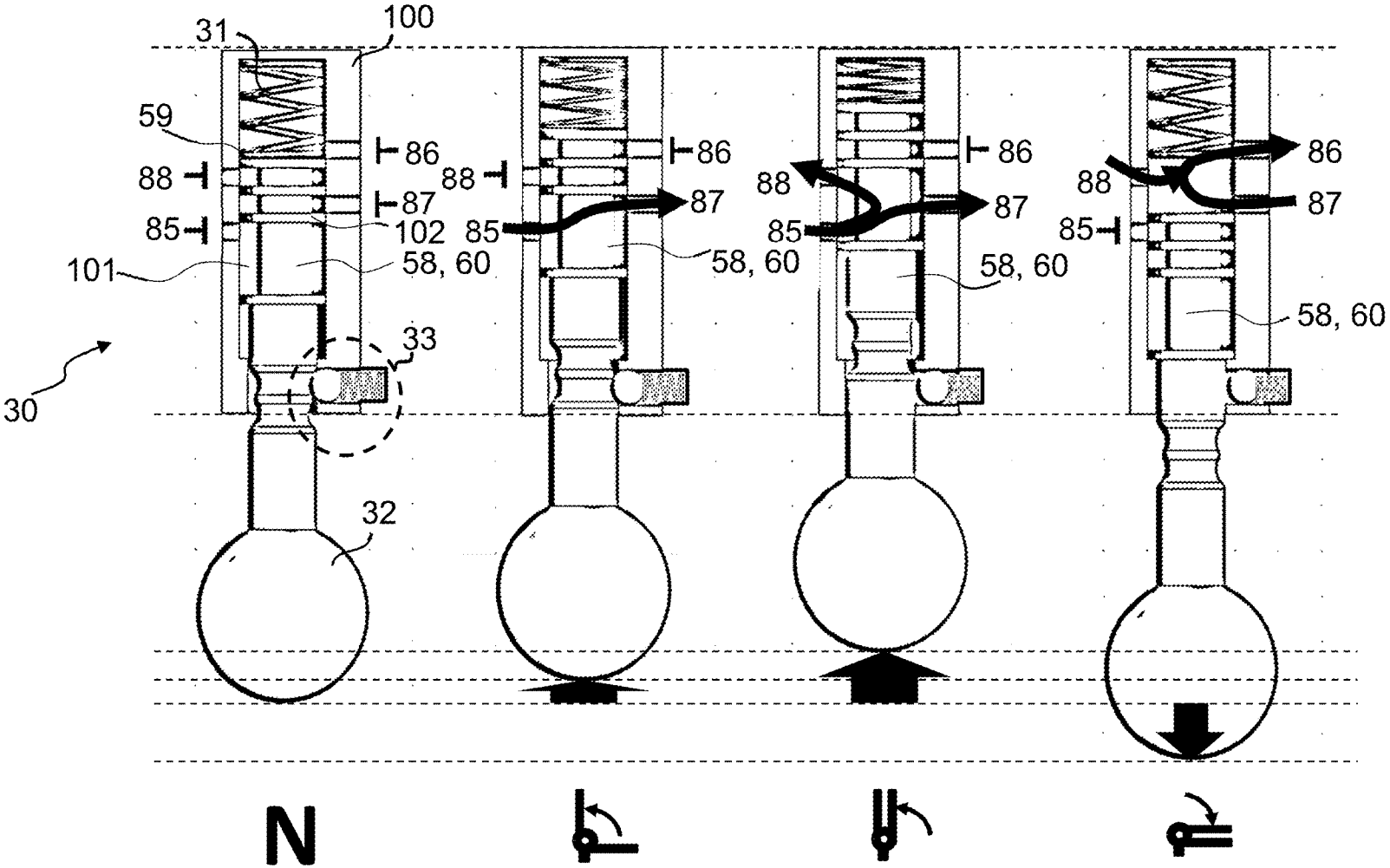

Various embodiments of the invention are described below by way of example with reference to the drawings. Identical objects have the same reference signs. The corresponding figures of the drawings show in detail:

FIG. 1: an embodiment of the toilet system according to the invention;

FIG. 2: a conventional cistern;

FIG. 3: a cistern with a valve device;

FIG. 4: another embodiment of the toilet system according to the invention;

FIG. 5: a possibility of how a hose system is guided through the inlet pipe and exits therefrom;

FIG. 6: a possibility of how the hose system is guided through hinge feet of an actuator arrangement;

FIG. 7: a cistern with a valve device, wherein a connection piece of the cistern, via which it can be connected to a pressurized water pipe, is attached to the bottom of the cistern;

FIG. 8: a toilet lid and seat ring together with an actuator arrangement in the dismantled state;

FIG. 9: the toilet lid and the seat ring together with the actuator arrangement in the assembled state;

FIGS. 10, 11: various representations of the actuator arrangement according to a first embodiment;

FIG. 12: an outer housing and a piston of an actuator according to the first embodiment;

FIG. 13: an actuator with an outer housing, an inner housing and a piston according to the first embodiment;

FIG. 14: an actuator arrangement comprising two actuators which are arranged offset by 180° from one another, with only the respective inner housing with the respective piston being shown;

FIGS. 15, 16, 17:

a structure and a mode of operation of an actuator according to the first embodiment;

FIGS. 18, 19: a structure and a mode of operation of an actuator according to a second embodiment;

FIG. 20: an embodiment of the assembled actuator arrangement from FIGS. 18, 19;

FIG. 21: an embodiment of the actuator arrangement from FIGS. 18, 19 in a partially exploded view;

FIG. 22: an embodiment which explains how a return device is used to close the toilet seat;

FIG. 23: shows a mounted toilet seat on the actuator arrangement from FIGS. 18 to 21;

FIG. 24: a structure of a valve device in the form of a ball valve;

FIGS. 25, 26, 27, 28: a mode of operation of the valve device in the form of the ball valve;

FIG. 29: a structure of a valve device in the form of a hydraulic valve;

FIGS. 30, 31, 32: a function of the valve device in the form of the hydraulic valve;

FIGS. 33, 34, 35, 36, 37, 38: a function of the valve device in the form of hydraulic valves which are housed in a common valve block;

FIGS. 39, 40, 41, 42: a functioning of the valve device in the form of hydraulic valves which are housed in separate valve blocks;

FIGS. 43, 44, 45, 46: an adjustment device in the form of a transmission rod with corresponding actuation devices;

FIGS. 47, 48, 49, 50: another adjustment device in the form of buttons;

FIG. 51: an adjustment device in the form of a dial;

FIGS. 52, 53, 54: an arrangement of a valve device in the form of a pin-shaped hydraulic valve; and FIG. 55: a structure of a valve device in the form of a pin-shaped hydraulic valve.

FIG. 1 shows an embodiment of the toilet system 1 according to the invention. The toilet system 1 comprises a toilet bowl 2, which in this embodiment is mounted on a floor 3*a*. It could also be mounted on a wall 3*b*. In this case, the toilet system 1 also comprises a cistern 8. This cistern 8 is connected to the toilet bowl 2 via an inlet pipe 12. Water is transferred via the inlet pipe 12 to flush the toilet bowl 2. The inlet pipe 12 is connected to the toilet bowl 2 for this purpose. A first end 12*a* of the inlet pipe 12 is connected to the toilet bowl 2. A second end 12*b* of the inlet pipe 12 can be connected directly or indirectly to a pressurized water supply line (which is arranged in the building). In FIG. 1, this is an indirect connection because the cistern 8 is arranged between the water supply line and the inlet pipe 12.

The toilet system 1 further comprises a toilet seat 13. The toilet seat 13 can either comprise just a seat ring 14 or a toilet lid 16 and additionally a seat ring 14. The first embodiment is often used in public toilets (e.g. in airports).

An actuator arrangement 55, a valve device 30 and a hose system 45 are also provided. The actuator arrangement 55 can be connected to the water supply line via the valve device 30 and the hose system 45.

The valve device 30 is designed to supply the pressurized water from the water supply line to the actuator arrangement 55. The actuator arrangement 55 is designed to raise the toilet seat 13 using the pressurized water. The actuator arrangement can either raise just the seat ring 14 (if no toilet lid 16 is installed) or just the toilet lid 16 or both the toilet lid 16 and the seat ring 14.

FIG. 1 also shows that the hose system 45 comprises various lines, in particular in the form of (flexible) hoses 46, 48. These hoses 46, 48 connect the valve device 30 to the actuator arrangement 55. A hose 46 is preferably designed to supply pressurized water to the actuator arrangement 55 in order to thereby raise the toilet lid 16 or the seat ring 14 (if the toilet seat 13 does not comprise a toilet lid 16). Another hose 48 is preferably designed to supply pressurized water to the actuator arrangement 55 in order to thereby raise the seat ring 14 (if the toilet seat 13 comprises a toilet lid 16).

The hose system 45 can also be used to connect the valve device 30 to the pressurized water supply line. For this purpose, the hose system 45 would comprise a supply line 44.

FIG. 2 shows a conventional cistern 8, which can be expanded in a particularly inventive manner to include the valve device 30 and the hose system 45. The cistern 8 comprises a float 9, which triggers the filling of the cistern 8 after the flushing process. After the flush button is pressed, the overflow pipe 10 rises and the flush water flows via the inlet pipe 12 towards the toilet bowl 2.

FIG. 3 shows another embodiment of the toilet system 1. The building's water supply is connected via a T-piece to both the cistern 8 and via a supply line 44 (for example supply hose) to the valve device 30. This does not affect the filling of the cistern 8 using the traditional float-controlled system. The valve device 30 will be described in more detail later.

The hose system 45, which in this embodiment includes a line 46 to the toilet lid 16 and a line 48 to the seat ring 14, runs through the inlet pipe 12 and also through the overflow pipe 10. This makes subsequent installation particularly easy.

The valve device 30 comprises a control device, via which either only the toilet lid 16 (if a toilet lid 16 is provided) can be raised or via which only the seat ring 14 (if only a seat ring 14 is provided) can be raised or via which both the toilet lid 16 and the seat ring 14 can be raised together or via which the toilet seat 13 can be lowered. The control device comprises one or more operating levers, actuating elements 34, 36, 40. In this embodiment, the toilet lid 16 can be raised via an actuating element 34 in the form of a button 34. Both the toilet lid 16 and the seat ring 14 can be raised via the actuating element 36 (e.g. button). The toilet seat 13 can be lowered via the actuating element 40 (e.g. button).

FIG. 3 also shows that the hose system 45 also leads into the cistern 8. This part is preferably a vent pipe 50 (for example in the form of a hose). This makes it possible to press the water out of the actuator arrangement 55 and to direct it back into the cistern 8 via the valve device 30. This process occurs when the button 40 is pressed and the toilet seat 13 is to be lowered.

FIG. 4 shows another embodiment of the toilet system 1. It is shown that the valve device 30 is arranged at the upper end of the cistern 8. This makes it particularly easy to operate. The actuator arrangement 55 is controlled via the hose system 45. The hose system 45 exits the inlet pipe 12 at the first end 12*a*.

It is also shown that the toilet bowl 2 comprises a flushing channel 17. The first end 12*a* of the inlet pipe 12 is connected to the flushing channel 17. The actuator arrangement 55 and the toilet seat 13 are arranged on an upper side of the toilet bowl 2. At least one through hole is provided in the toilet bowl 2, which extends from the upper side of the toilet bowl 2 into the flushing channel 17. The hose system 45 emerges from the inlet pipe 12 in the area of the first end 12*a* of the inlet pipe 12 and is guided via the flush channel 17 and the through hole to the actuator arrangement 55. In this case, the hose system 45 is hidden from the user.

This situation is shown more clearly in FIG. 5. The hose system 45, which includes, for example, a (hydraulic) hose 46 via which the toilet lid 16 can be lifted and which includes, for example, a (hydraulic) hose 48 via which the seat ring 14 can be lifted, is preferably removed from the inlet pipe 12 via an opening. This opening is sealed, in particular via an adhesive connection. In FIG. 5, the cistern 8 is a concealed cistern. The present invention can also be used for such cisterns 8.

FIG. 6 shows that after the inlet pipe 12 exits the wall, two holes are drilled through which the pipe system 45 with the (hydraulic) hoses 46, 48 are brought out. The holes are preferably provided in the area of a suspension 4 for the toilet bowl 2. The pipe system 45 is preferably guided via hollow hinge feet 26 in the direction of the actuator arrangement 55.

FIG. 7 shows an embodiment in which the cistern 8 is filled from below. In this case, the connector is inserted into the bottom of the cistern 8. Such cisterns 8 work according to the "bottom-fill" principle and are often used in Great Britain or the USA, for example. In this case, the cistern 8 is a top-mounted cistern. Here, too, a T-piece 42 could be used to feed the pipe system 45. In this case, the base of the inlet or inlet valve is drilled, with the supply line 44 (for example a supply hose) of the pipe system 45 being attached to this hole. This can be done, for example, with a sleeve 43. The (hydraulic) hoses 46, 48 of the pipe system 45 are preferably each guided through a hollow screw 47 and are glued into it in a particularly watertight manner. These hollow screws 47 are used to attach the cistern 8 to the toilet bowl 2. The (hydraulic) hoses 46, 48 of the line system 45 are guided from the hollow screws 47 to the respective hinge feet 26 and then connected to the actuator arrangement 55.

FIG. 8 shows a toilet lid 16 and seat ring 14 together with an actuator arrangement 55 in an exploded view. The toilet seat 13 is dismantled. The actuator arrangement 55 comprises a first actuator 56*a* and a second actuator 56*b*. Both actuators 56*a*, 56*b* are preferably constructed identically in terms of their functionality. The first actuator 56*a* is designed to raise or lower the toilet lid 16. The second actuator 56*b* is designed to raise or lower the seat ring 14. If there is only one seat ring 14 and no toilet lid 16, only one actuator is necessary.

The first actuator 56*a* and the second actuator 56*b* are arranged one on top of the other in this embodiment, rotated by 180°.

The first actuator 56*a* and the second actuator 56*b* each comprise a fastening section 78, which rotates clockwise or counterclockwise when the respective actuator 56*a*, 56*b* is actuated.

The toilet lid 16 comprises a first hinge arm 20*a*, which is arranged in a rotationally fixed manner on the fastening section 78 of the first actuator 56*a*. If the fastening section 78 of the first actuator 56*a* rotates, the toilet lid 16 is raised or lowered depending on the direction of rotation.

The seat ring 14 comprises a first hinge arm 18*a*, which is mounted on the fastening section 78 of the first actuator 56*a*. If the fastening section 78 of the first actuator 56*a* rotates, no torque is transmitted to the seat ring 14. The seat ring 14 therefore remains in position.

The seat ring 14 comprises a second hinge arm 18*b*, which is arranged in a rotationally fixed manner on the fastening section 78 of the second actuator 56*b*. If the fastening section 78 of the second actuator 56*b* rotates, the seat ring 14 is raised or lowered depending on the direction of rotation.

The toilet lid 16 comprises a second hinge arm 20*b*, which is mounted on the fastening section 78 of the second actuator 56*b*. If the fastening section 78 of the second actuator 56*b* rotates, no torque is transmitted to the toilet lid 16.

If a torque is to be transmitted from the first or second actuator 56*a*, 56*b* to the corresponding first or second hinge arm 20*a*, 18*b*, the corresponding hinge arm 20*a*, 18*b* comprises an opening that has a cross-sectional shape that differs from a round cross-section. The fastening section 78 comprises a cross-sectional shape corresponding thereto.

If no torque is to be transmitted from the first or second actuator 56*a*, 56*b* to the corresponding first or second hinge arm 20*b*, 18*a*, the corresponding hinge arm 20*b*, 18*a* comprises an opening that has a round cross-sectional shape. The fastening section 78 rotates in this round cross-sectional shape without transmitting a torque.

The respective hinge arm 18*a*, 18*b*, 20*a*, 20*b* of the toilet lid 16 or the seat ring 14 can also be referred to as a hinge receiving ear. In the assembled state of the hinge arm 18*a*, 18*b*, 20*a*, 20*b*, it is penetrated by an opening (ear) in the direction of a longitudinal axis 80 of the respective first or second actuator 56*a*, 56*b*.

Also shown is a fastening clip 27, which is arranged on the hinge foot 26 and serves to lock the hinge foot 26, which is passed through the toilet bowl 2. In addition to a fastening clip 27, a fastening nut could also be used.

FIG. 9 shows another view of the toilet seat 13 and the actuator arrangement 55 from FIG. 8. The hidden line routing of the house system 45 through or within the hinge feet 26 can be seen.

FIGS. 10 and 11 show the structure of the actuator arrangement 55 according to a first embodiment. The actuator arrangement 55 comprises a first actuator 56*a* in the form of a hydraulic cylinder.

The first actuator 56*a* comprises a connection 57, which can be connected or is connected to the hose system 45. The first actuator 56*a* also comprises an outer housing 24, an inner housing 72 and a piston 58. The inner housing 72 is arranged in the outer housing 24. The piston 58 is arranged in the inner housing 72. The first actuator 56*a* is designed so that when the piston 58 moves, the inner housing 72 is rotated relative to the outer housing 24. In this case, a first hinge arm 20*a* of the toilet lid 16 is also rotated.

The actuator arrangement 55 also comprises a second actuator 56*b* in the form of a hydraulic cylinder. The first actuator 56*a* and the second actuator 56*b* are preferably constructed identically in terms of their functionality.

In principle, the actuator arrangement 55 could also comprise a pressure relief valve which is designed to drain water from the actuator arrangement 55 when a certain pressure value within the actuator arrangement 55 is reached or exceeded. The pressure relief valve can be arranged on the first and/or second actuator 56*a*, 56*b*. The drained water can be directed directly into the toilet bowl 2 or back into the cistern 8.

The second actuator 56*b* comprises a connection 57 that can be connected to or is connected to the hose system 45. The second actuator 56*b* also comprises an outer housing 24, an inner housing 72 and a piston 58. The inner housing 72 is arranged in the outer housing 24. The piston 58 is arranged in the inner housing 72. The second actuator 56*b* is designed so that when the piston 58 moves, the inner housing 72 is rotated relative to the outer housing 24. In this case, a second hinge arm 18*b* of the seat ring 14 is also rotated.

If there is only a seat ring 14 and no toilet lid 16, the use of exactly one actuator 56*a* is sufficient.

The outer housing 24 is preferably formed in one piece and preferably consists of or further preferably comprises plastic. The same can also apply to the inner housing 72.

The outer housing 24 of the first actuator 56*a* comprises a first end 79*a*, which is closed off by a base 25. Pressurized water is introduced between the base 25 of the outer housing 24 and the piston 58, whereby the piston 58 can be moved along the longitudinal axis 80 of the first actuator 56*a* in the direction of a second end 79*b* of the outer housing 24 of the first actuator 56*a*. This movement path is indicated by an arrow. The piston 58 is guided both by the outer housing 24 and by the inner housing 72. The outer housing 24 is arranged stationary (during operation). The same applies to the second actuator 56*b*.

FIG. 12 shows the outer housing 24 and the piston 58. The outer housing 24 comprises a first guide 70*a*, which is formed on an inner wall of the outer housing 24. The first guide 70*a* preferably runs along the longitudinal axis 80 or parallel to the longitudinal axis 80 of the respective actuator 56*a*, 56*b*. It is also preferably straight. In this embodiment, the first guide 70*a* is a groove formed in the outer housing 24. The first guide 70*a* could also be a projection.

The piston 58 comprises a first sliding element 63*a*, which engages in the first guide 70*a*. In this case, the first sliding element 63*a* comprises several rollers 64, 66. The first sliding element 63*a* could also be a sliding block. It is also shown that the outer housing 24 comprises a second guide 70*b*, which is spaced apart from the first guide 70*a* in the circumferential direction of the outer housing 24. The second guide 70*b* is preferably arranged offset from the first guide by 180° in the circumferential direction of the outer housing 24.

Preferably, the piston 58 also comprises a second sliding element 63*b*. The second sliding element 63*b* engages in the second guide 70*b*. In this case, the second sliding element 63*b* comprises several rollers 64, 66. The second sliding element 63*b* could also comprise a roller 64 or be a sliding block.

Also shown is a channel 68 within the first or second actuator 56*a*, 56*b*, which is connected to the line system 45. When the valve device 30 is actuated, water is pressed through this channel 68 into the interior of the first or second actuator 56*a*, 56*b*. This pushes the piston 58 in the direction of the second end 79*b* of the respective actuator 56*a*, 56*b*. The first sliding element 63*a* thereby moves along the first guide 70*a* of the outer housing 24. The second sliding element 63*b* (if present) thereby moves along the second guide 70*b* of the outer housing 24.

The piston 58 preferably moves exclusively along the longitudinal axis 80 of the respective actuator 56*a*, 56*b*. The piston 58 is further preferably arranged in a rotationally fixed manner, which means that when it moves along the longitudinal axis 80 of the respective actuator 56*a*, 56*b*, it does not rotate about its own axis or about the longitudinal axis 80 of the respective actuator 56*a*, 56*b*.

FIG. 13 shows in dots how the pressed-in water flows. In principle, the connection 57 could also be attached in the area of the first end 79*a* of the outer housing 24. Preferably, the first connection 57 is mounted closer to the first end 79*a* of the outer housing 24 than to the second end 79*b* of the outer housing 24.

The axial movement of the piston 58 and the rotation of the inner housing 72 together with the fastening section 78 are shown in dashed lines.

The inner housing 72 and the piston 58 are shown in FIGS. 14, 15, 16 and 17. The piston 58 comprises a piston head 59 and a piston rod 60. The piston head 59 preferably comprises a sleeve seal, which is preferably attached to the piston head 59. The sleeve seal is preferably slightly conical in shape and dimensioned such that a clearance between the piston head 59 and an inner wall of the outer housing 24 is minimized. The clearance is just large enough for the piston 58 to move back and forth in the outer housing 24 with a resistance below a threshold value. As soon as water flows in between the base 25 and the piston head 59, the outer edge of the sleeve seal is pressed outwards against the inner wall of the outer housing 24, whereby a gap (between the piston head 59 and the inner wall of the outer housing 24) is sealed watertight.

The inner housing 72 also includes a first guide 73*a*. The first guide 73*a* on the inner housing 72 is an opening that completely penetrates the wall of the inner housing 72. The first sliding element 63*a* of the piston 58 passes through this opening on the inner housing 72 and rests on the inner housing 72. The first sliding element 63*a* is therefore mounted on both the first guide 70*a* on the outer housing 24 and on the first guide 73*a* on the inner housing 72.

In the event that the first sliding element 63*a* includes several rollers 64, 66, an (outer) roller 64 rests (preferably only) on the first guide 70*a* of the outer housing 24 and an (inner) roller 66 rests (preferably only) on the first guide 73*a* of the inner housing 72.

The first guide 73*a* on the inner housing 72 is curved. This means that it extends both in the direction of the longitudinal axis 80 (of the respective actuator 56*a*, 56*b*) and thus along the longitudinal axis of the inner housing 72 and in the circumferential direction of the inner housing 72. The first guide 73*a* of the inner housing 72 preferably runs in a spiral shape. An axial movement of the piston 58 along the longitudinal axis 80 of the respective actuator 56*a*, 56*b* then leads to the inner housing 72 being set in a rotary movement. The piston 58 moves without rotation along the longitudinal axis 80 because it is guided by the first guide 70*a* on the outer housing 24, which is arranged stationary.

The inner housing 72 preferably also comprises a second guide 73*b*. The second guide 73*b* is arranged offset from the first guide 73*a* (at least) in the circumferential direction of the inner housing 72. The second sliding element 63*b* is then mounted both in the second guide 70*b* of the outer housing 24 and in the second guide 73*b* of the inner housing 72. The second guide 73*b* on the inner housing 72 is preferably arranged offset by 180° in the circumferential direction from the first guide 73*a* on the inner housing 72. The second guide 73*b* on the inner housing 72 is preferably constructed analogously to the first guide 73*a* on the inner housing 72.

The first actuator 56*a* preferably also comprises a return spring 62. The return spring 62 is arranged or attached to the piston 56 and to the inner housing 72. The return spring 62 is designed to exert a force on the piston 56 so that it moves into a starting position in which the toilet lid 16 or the seat ring 14 (if the toilet seat 13 only comprises a seat ring 14) is lowered and finally covers the toilet bowl 2.

If the valve device 30 is in a lowering position, the return spring 62 ensures that water is pressed out of the respective first or second actuator 56*a*, 56*b*. The water is then pressed back into the pipe system 45 and flows either into the toilet bowl 2 or back into the cistern 8.

A movement of the piston 58 causes the inner housing 72 to rotate relative to the outer housing 24 by preferably 100°. In this case, the toilet lid 16 or the seat ring 14 opens by more than 90°. Deviations of approximately less than ±5°, ±10°, ±15° would also be conceivable.

The first and/or second actuator 56*a*, 56*b* preferably also comprises a locking device 75. The locking device 75 is designed to prevent movement of the inner housing 72 relative to the outer housing 74 in the direction of the longitudinal axis 80 of the respective first or second actuator 56*a*, 56*b*. The "locking" takes place when the first or second actuator 56*a*, 56*b* raises or lowers the toilet lid 16 or the seat ring 14 (if the toilet seat 13 only comprises a seat ring 14).

The return spring 62 exerts a force to push the inner housing 72 out of the outer housing 24. The inner housing 72 is thereby pushed in the direction of the second end 79*b* of the outer housing 24. The opening at the second end 79*b* of the outer housing 24 is larger than the inner housing 72 because the inner housing 72 can be inserted into the outer housing 24 via this opening. The locking device 75 is used so that the inner housing 72 remains stationary but rotatable relative to the outer housing 24 even without the seat ring 14 or toilet lid 16 installed.

For this purpose, the outer housing 24 comprises a first opening 77*a* on the peripheral wall (FIG. 11). A first groove extends from the first opening 77*a* on the inner wall of the outer housing 24 and runs (preferably only) in the longitudinal direction of the outer housing 24. The outer housing 24 preferably comprises a corresponding thickening 82 in the region of the first groove. The inner housing 72 comprises a first groove 81*a* which extends (preferably only) in the circumferential direction. In an assembly position, the inner housing 72 is pressed further into the outer housing 24 against the spring force of the return spring 62 such that the first opening 77*a* of the outer housing 24 lies above the first groove 81*a* of the inner housing 72. The first groove 81*a* of the inner housing 72 can penetrate the wall of the inner housing 72 so that the first groove 81*a* in this case comprises an opening. Furthermore, there is at least one first spherical locking element 74*a* which can be inserted in the assembly position via the first opening 77*a* in the outer housing 24. In a locking position, the inner housing 72 is pushed further out of the outer housing 24 relative to the outer housing 24 by the restoring force of the restoring spring 62, whereby the first spherical locking element 74*a* moves in the first groove of the outer housing 24, but still lies in the first groove 81*a* of the inner housing 72. The first spherical locking element 74*a* rolls in the first groove 81*a* of the inner housing 72 when the inner housing 72 rotates.

The outer housing 24 preferably also includes a second opening (not shown). The inner housing 72 preferably also includes a second groove 81*b* so that a second spherical locking element 74*b* can be inserted. The second opening on the outer housing 24 is offset from the first opening 77*a* on the outer housing 24 in the circumferential direction of the outer housing 24. The second groove 81*b* on the inner housing 72 is offset from the first groove 81*a* on the inner housing 72 in the circumferential direction of the inner housing 72.

The locking device 75 is preferably designed in the form of a ball bearing.

As can be seen from FIG. 11, for example, the inner housing 72 of the first and second actuators 56*a*, 56*b* comprises the fastening section 78. The fastening section 78 protrudes from an opening in the region of the second end 79*b* of the outer housing 24. The toilet seat 13 is fastened to the respective fastening section 78 of the first or second actuator 56*a*, 56*b*.

In order to remove the toilet seat 13, the fastening section 78 and thus the inner housing 72 can be pressed into the outer housing 24 against the spring force of the return spring 62. The toilet seat 13 can be easily pulled off in this state (with a movement vector radial to the longitudinal axis 80 of the respective first or second actuator 56*a*, 56*b*). If, however, the fastening section 78 is pushed further into the outer housing 24, the assembly position is reached in which the spherical locking element 74 can be inserted.

Thanks to the restoring force of the return spring 62, the inner housing 72 is pre-tensioned. By releasing the fastening section 78, the inner housing 72 is pushed out of the outer housing 24 and can be locked into a (new or cleaned) toilet seat 13.

The first hinge arm 20*a* of the toilet lid 16 is arranged in a rotationally fixed manner on the fastening section 78 of the first actuator 56*a*. The first hinge arm 18*a* of the seat ring 14 is only mounted on the fastening section 78 of the first actuator 56*a*. When the first actuator 56*a* is actuated, only the toilet lid 16 is raised or lowered, but not the seat ring 14. The fastening section 78 of the first actuator 56*a* comprises a cross-section that deviates from a circular cross-section in the region in which the first hinge arm 20*a* of the toilet lid 16 is arranged in a rotationally fixed manner, wherein the first hinge arm 20*a* of the toilet lid 16 has an opening corresponding thereto. Preferably, the first hinge arm 18*a* of the seat ring 14 comprises a circular opening so that the fastening section 78 on the first actuator 56*a* can rotate therein without transmitting a torque to the first hinge arm 18*a* of the seat ring 14. The fastening section 78 on the first actuator 56*a* could also comprise a circular cross-section in the region in which the first hinge arm 18*a* of the seat ring 14 is arranged. However, this is not necessary.

The second hinge arm 18*b* of the seat ring 14 is arranged in a rotationally fixed manner on the fastening section 78 of the second actuator 56*b*. The second hinge arm 20*b* of the toilet lid 16 is merely mounted on the fastening section 78 of the second actuator 56*b*. When the second actuator 56*b* is actuated, a torque is therefore transmitted from the fastening section 78 of the second actuator 56*b* to the seat ring 14. The fastening section 78 of the second actuator 56*b* comprises a cross-section that deviates from a circular cross-section in the area where the second hinge arm 20*b* of the seat ring 14 is arranged in a rotationally fixed manner, wherein the second hinge arm 20*b* of the seat ring 14 has an opening corresponding thereto. Preferably, the second hinge arm 20*b* of the toilet lid 16 comprises a circular opening so that the fastening section 78 on the second actuator 56*b* can rotate therein without transmitting a torque to the second hinge arm 20*b* of the toilet lid 16. The fastening section 78 on the second actuator 56*b* could also comprise a circular cross-section in the area in which the second hinge arm 20*b* of the toilet lid 16 is arranged. However, this is not necessary.

The outer housing 24 of the first actuator 56*a* and the outer housing 24 of the second actuator 56*b* are preferably formed in a common manufacturing process as a one-piece outer housing 24. A receiving space which is delimited by the outer housing 24 of the first actuator 56*a* is separated by a base 25 from a receiving space which is delimited by the outer housing 24 of the second actuator 56*b*.

FIGS. 18 and 19 show a further embodiment of the actuator arrangement 55. In this case, freewheeling is also possible. This means that the user can lift the toilet lid 16 and the seat ring 14 without the inner housing 72 twisting within the first or second actuator 56*a*, 56*b*. In this case, torque is only transmitted during the opening movement from the actuator arrangement 55 to the toilet seat 13 and not from the toilet seat 13 in the direction of the actuator arrangement 55.

The fastening section 78 of the first actuator 56*a* has a driver 78*a* which comes into contact with a projection on the first hinge arm 20*a* of the toilet lid 16, whereby a torque can be transmitted from the first actuator 56*a* to the toilet lid 16. A rotation of the fastening section 78 (during the opening movement) leads to a rotation of the first hinge arm 20*a* (around the axis of rotation) of the toilet lid 16 and thus to an opening of the toilet lid 16. Preferably, the first driver 78*a* only comes into contact with the projection on the first hinge arm 20*a* when rotating in one direction of rotation, so that only a torque can be transmitted from the first actuator 56*a* to the toilet lid 16 during the opening movement. This allows the user to lift the toilet lid 16 manually. A first hinge arm 18*a* of the seat ring 14 is only mounted on the fastening section 78 of the first actuator 56*a*.

The same can also apply to the seat ring 14. The fastening section 78 of the second actuator 56*b* has a driver 78*a* which comes into contact with a projection on the second hinge arm 18*b* of the seat ring 14, whereby a torque can be transmitted from the second actuator 56*b* to the seat ring 14. A rotation of the fastening section 78 (during the opening movement) leads to a rotation of the second hinge arm 18*b* (about the axis of rotation) of the seat ring 14 and thus to an opening of the seat ring 14. Preferably, the first driver 78*a* only comes into contact with the projection on the second hinge arm 18*b* when rotating in one direction of rotation, so that only a torque can be transmitted from the second actuator 56*b* to the seat ring 14 during the opening movement. This allows the user to lift the seat ring 14 manually. A second hinge arm 20*b* of the toilet lid 16 is merely mounted on the fastening section 78 of the second actuator 56*b*.

Furthermore, the actuator arrangement 55 comprises a common housing 24*a*. In this case, both the outer housing 24 of the first actuator 56*a* and the outer housing 24 of the second actuator 56*b* comprise a further common part 24*a*, which can also be referred to as a common housing 24*a*. The pistons 59 of the first and second actuators 56*a*, 56*b* move within the common housing 24*a*.

The actuator arrangement 55 also includes a base plate 110, which is screwed and/or locked to the toilet bowl 2. It would be possible for the first actuator 56*a* and the second actuator 56*a* to be locked to the base plate 110 via a snap connection and/or connected via a pin-secured holder. In this exemplary embodiment, however, the common housing 24*a*, which surrounds the first actuator 56*a* and the second actuator 56*b*, is connected to the base plate 110. In this case, this is done via a pin-secured holder.

A distribution device 111 is also provided. The first actuator 56*a* is arranged with its first end 79*a* on a first side 111*a* of the distribution device 111 and the second actuator 56*b* is arranged with its first end 79*a* on a second side 111*b* of the distribution device 111. The distribution device 111 comprises two connections 57 (see FIG. 20), each connection 57 being connected to the hose system 45, wherein water that can be supplied to the first connection 57 can be supplied to the first actuator 56*a* at its first end 79*a* via the distribution device 111 and wherein water that can be supplied to the second connection 57 can be supplied to the second actuator 56*b* at its first end 79*a* via the distribution device 111. The water is now supplied to the respective piston 59 at the front. The distribution device 111 is preferably arranged in the region of the center of the actuator arrangement 55. The distribution device 111 represents the base for the first actuator 56*a* and the second actuator 56*b*.

Furthermore, the outer housing 24 preferably does not comprise any thickening in this case. To install the spherical locking element 74*a*, in an installation position, the inner housing 72 is pressed further into the outer housing 24 against the spring force of the return spring 62 in such a way that the first groove 81*a* of the inner housing 72 protrudes beyond the front side of the outer housing 24. The spherical locking element 74*a* is inserted between the front side of the outer housing 24 and the first groove 81*a* and is clamped in place after the outer housing 24 is released. The front side of the outer housing 24 is the front side that is arranged closer to the distribution device 111. In this case, the outer housing 24 does not require a corresponding first opening 77*a*.

FIG. 20 shows the assembled actuator arrangement 55 of FIGS. 18 and 19. Only the base plate 110 is not shown. The first actuator 56*a* and the second actuator 56*b* comprise an opening accessible from outside the first and second actuators 56*a*, 56*b*. Preferably pin-shaped locking means 127 are introduced into the openings of the first and second actuators 56*a*, 56*b*, with the respective fastening section 78 being pressed into the respective outer housing 24. The locking means 127 are designed so that the respective fastening section 78 of the first and second actuators 56*a*, 56*b* remains in the pressed-in position. The toilet lid 16 and seat ring 14 are then mounted and the locking means 127 are removed. After the locking means 127 are removed, the pre-tensioned fastening sections 78 spring out and snap into openings in the toilet lid 16 and seat ring 14.

Furthermore, two fastening parts 115 are shown on the common housing 24*a*, which can be connected to the base plate 110. These fastening parts 115 are part of a pin-secured connection, in this case to connect the common housing 24*a* to the base plate 110.

FIG. 21 shows the actuator arrangement 55 in a partially exploded view with the first actuator 56*a* removed. Locking pins 125 of the pin-secured connection are shown. Each fastening part 115 is connected to the base plate via a locking pin 125, whereby the actuator arrangement 55 is protected against being pulled off the toilet bowl 2. The locking pins are preferably inserted into the actuator arrangement 55 in the axial direction relative to the movement of the first and second actuators 56*a*, 56*b*. In doing so, they pass through openings in the fastening part 115 and the base plate 110. The locking pins 128 are preferably arranged closer to the surface of the toilet bowl 2 than the fastening sections 78. One end of each locking pin 128 protrudes from the actuator arrangement 55 when a pin-secured connection is established. The locking pins 125 can therefore be pulled off, whereby the actuator arrangement 55 with the mounted toilet seat 13 can be removed from the toilet bowl 2. The locking pins 125 are preferably the locking means 127 from FIG. 20.

FIG. 22 shows how the toilet lid 16 can be pre-tensioned so that automatic lowering can be initiated. The toilet system 1 comprises a return device 116 which has at least one spring 125. The at least one spring 125 is arranged in an opening of the toilet lid 16 of the toilet seat 13. In this case, the spring 125 is arranged in an opening of the second hinge arm 20*b* of the toilet lid 16. One end of the at least one spring 125 protrudes from the toilet lid 16 of the toilet seat 13 in the direction of the actuator arrangement 55. The at least one spring 125 is designed to come into contact with a projection 120 on the actuator arrangement 55 when the toilet lid 16 is opened, as a result of which the return device 116 can be pre-tensioned. The projection 120 is in this case formed on the base plate 110 of the actuator arrangement 55. The return device 116 is particularly designed to rotate the toilet seat 13 into a position such that an angle between the toilet seat 13 and the surface of the toilet bowl 2 is less than 90° or less than 80°. As soon as such an angle is reached, gravity assists the closing process. The return device 116 is preferably designed to rotate the toilet seat 13 from an angle that corresponds to approximately 115°, over 90° in the direction of 80°. The return device 116 is preferably arranged in the hinge arm 20*a*, 20*b* of the toilet lid 16, which is only mounted on the corresponding actuator 56*a*, 56*b*. Preferably, only the toilet lid 16, but not the seat ring 14, is preloaded by such a spring 125.

It is also shown that the base plate 110 of the actuator arrangement 55 has fastening openings 121, via which the base plate 110 can be fastened to through holes in the toilet bowl 2. In particular, the fastening can be carried out by a screw connection that passes through the fastening openings 121. The fastening openings 121 of the actuator arrangement 55 are preferably elongated holes, so that the actuator arrangement 55 can be fastened to the toilet bowl 2 even if the through holes in the toilet bowl 2 are at different distances from one another. This means that conventional toilet systems that already have appropriately drilled through holes can be easily retrofitted.

FIG. 23 shows how a toilet lid 16 and a toilet seat 14 are mounted on the actuator arrangement 55. The base plate 110 is not shown in this embodiment.

FIG. 24 shows an embodiment of the valve device 30. The valve device 30 is designed in the form of a ball valve. The valve device 30 comprises a line connection 85 which can be connected to the supply line 44. Pressurized water from the water supply line can be fed to the valve device 30 via the supply line 44.

The valve device 30 also comprises an output connection 86. Water from the actuator arrangement 55 can be fed back into the cistern 8 (as shown in FIG. 24) or directly into the toilet bowl 2 via the output connection 86. This can be achieved, for example, by using the vent line 50. The vent line 50 can also be part of the line system 45.

The valve device 30 also comprises a first actuator connection 87, which is connected to the actuator arrangement 55 and in this to the first actuator 56*a*.

The valve device 30 also comprises a second actuator connection 88, which is connected to the actuator arrangement 55 and in this to the second actuator 56*b*.

The valve device 30 also comprises an adjustment device, which can be designed, for example, in the form of an operating lever 32 or in the form of actuating elements 34, 36, 40, e.g. in the form of buttons or buttons. In this embodiment, the operating lever 32 can be rotated. This causes the ball valve to rotate accordingly.

The valve device 30 is preferably a 4-way/5-position ball valve. The 4-way valves include the line connection 85, the output connection 86, the first actuator connection 87 and the second actuator connection 88. An L-bore or an L-shaped bore is provided in the ball valve. This L-bore or L-shaped bore comprises two channels 89*a*, 89*b* which are provided in the ball (e.g. through a bore) and meet at an angle of preferably 90°.

The desired five positions or actions can be selected using the operating lever 32. These are "Lift lid", "Lift seat ring", "Lower seat ring", "Lower everything" and "Neutral (N)". The valve device 30 is designed in particular in such a way that the operating lever 32 always automatically falls back into its neutral position "Neutral".

FIG. 24 shows the "neutral position". All connections 85, 86, 87, 88 are separated from one another in this position.

Figure 25:
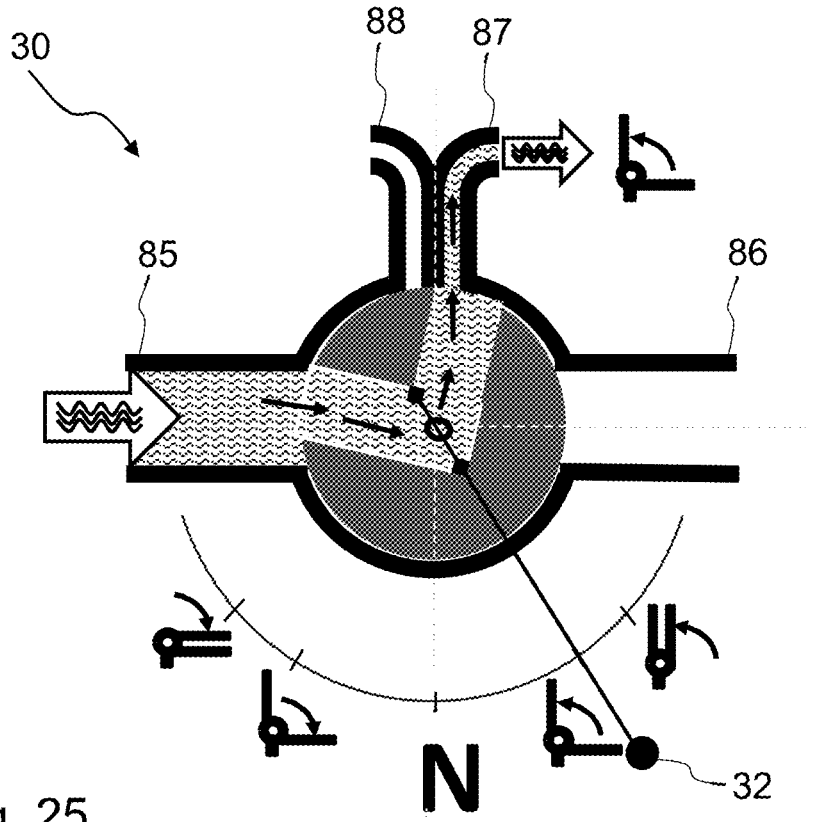

FIG. 25 shows a "first lifting position". The first channel 89*a* is connected to the first actuator connection 87 and the second channel 89*b* to the supply line connection 85. In this case, pressurized water flows from the supply line connection 85 to the first actuator connection 87 and from the first actuator connection 87 to the first actuator 56*b*. The toilet lid 16 is raised.

Figure 26:
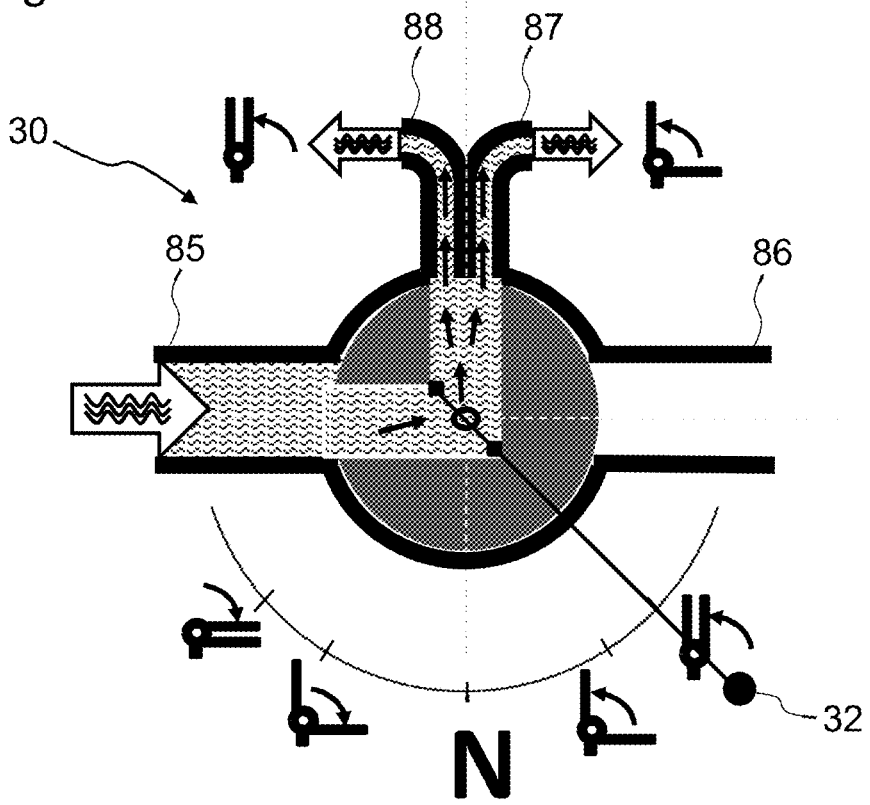

FIG. 26 shows a "second lifting position". The first channel 89*a* is connected to the first actuator port 87 and also to the second actuator port 88 and the second channel 89*b* to the pipe port 85. In this case, pressurized water flows from the pipe port 85 to the first actuator port 87 and to the second actuator port 88. The toilet lid 16 and the seat ring 14 are raised.

Figure 27:
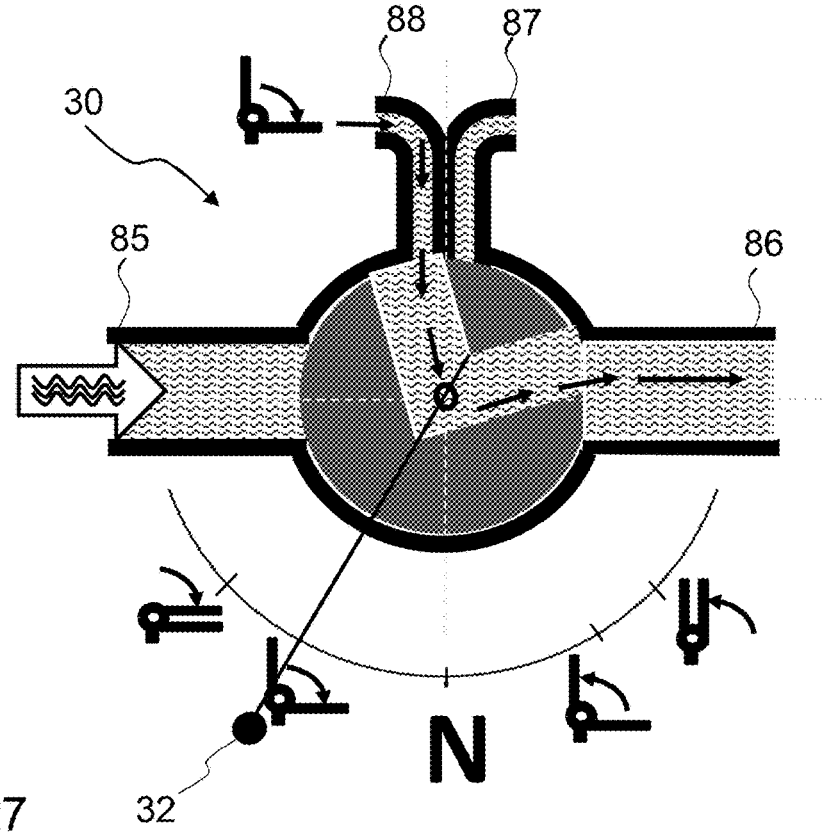

FIG. 27 shows a "further lowering position". In this further lowering position, only the second actuator port 88 is connected to the output port 86. Therefore, water flows from the second actuator 56*b* towards the output port 86 and only the seat ring 14 lowers.

Figure 28:
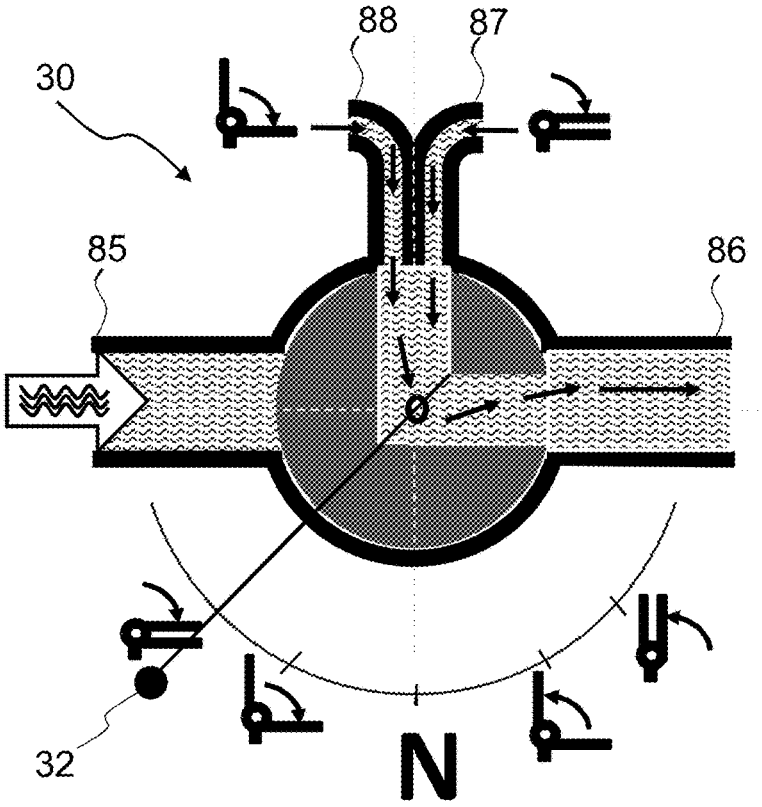

FIG. 28 shows a "lowering position". In the lowering position, at least the first actuator connection 87 is connected to the output connection 86. Exactly one first actuator connection 87 is used when only a seat ring 14 and no toilet lid 16 is provided. Preferably, the second actuator connection 88 is also connected to the output connection 86. This situation is shown in FIG. 28. In this case, both a seat ring 14 and a toilet lid 16 are provided. In this case, water flows from the actuator arrangement 55 in the direction of the output connection 86, which is preferably connected to the cistern 8 via the pipe system 45. The return spring 62 helps to press the water out of the actuator arrangement 55. The seat ring 14 and toilet lid 16 are lowered.

Preferably, the operating lever 32 moves back to the "neutral position" as soon as the user lets go of it. The water from the actuator arrangement 55 and the pipe system 45 cannot escape. The toilet lid 16 and the seat ring 14 remain in the current (e.g. fully or partially raised) position.

FIG. 29 shows another embodiment of the valve device 30. The valve device 30 comprises a first, a second and a third valve unit 91, 92, 93. The first, second and third valve units 91, 92, 93 each comprise an actuating element. The actuating elements 34, 36 are shown in this embodiment in the form of buttons 34, 36. The valve units 91, 92, 93 can be housed in housings spaced apart from one another.

The valve units 91, 92, 93 are 3-way/2-position valves. The first valve unit 91 is connected to the line connection 85 and the first actuator connection 87. The second valve unit 92 is connected to the line connection 85 and the second actuator connection 88. If the actuating element 34 of the first valve unit 91 is actuated, water flows from the supply line 44 in the direction of the first actuator 56*a*, whereby the toilet lid 16 begins to lift. The first valve unit 91 is in a first switching position in FIG. 29. If the button 36 of the second valve unit 92 is actuated, water flows from the supply line 44 in the direction of the second actuator 56*b*, whereby the seat ring 14 begins to lift. The second valve unit 92 is in a first switching position in FIG. 29.

The third valve unit 93 is connected to the output connection 86. The first and second valve units 91, 92 are connected to the third valve unit 93. If the first and second valve units 91, 92 are in a second switching position, water can flow from the respective first or second actuator 56*a*, 56*b* via the corresponding first or second valve unit 91, 92 to the third valve unit 93. Depending on the switching position, the third valve unit 93 can direct this water in the direction of the cistern 8 or into the toilet bowl 2 or interrupt such a connection. The first and second valve units 91, 92 move to the second switching position via corresponding return springs if the buttons 34, 36 are not actuated. If only the button 34 of the first valve unit 91 is actuated, the valve device 30 is in the "first lifting position". If the button 36 of the second valve unit 92 is also actuated, the valve device 30 is in the "second lifting position". If the first and second valve units 91, 92 are not actuated and the third valve unit 93 is also not actuated, the valve device 30 is in the "neutral position". If the third valve unit 93 is actuated and the first and second valve units 91, 92 are not actuated, the valve device 30 is in the "lowering position". If, on the other hand, the first and third valve units 91, 93 are actuated and the second valve unit 92 is not actuated, the valve device 30 is in the "further lowering position". It would be conceivable for a pressure relief valve to be integrated in the first, second and/or third valve units 91, 92, 93.

FIGS. 30, 31 and 32 show the exemplary structure of a valve unit 91, 92, 93. The valve unit 91, 92, 93 has a pressure connection P through which the pressurized water is supplied. There is also a connection A to which the first or second actuator 56*a*, 56*b* is connected. In addition, there is an output connection E through which the water from the first or second actuator 56*a*, 56*b* can be drained. FIG. 30 shows the unactuated state. Water can flow from the first or second actuator 56*a*, 56*b* in the direction of the output connection E. This situation is shown by the arrow.

FIG. 31 shows the actuated state. Water can flow from the pressure connection P in the direction of the connection A and thus to the first or second actuator 56*a*, 56*b*.

The first, second and third valve units 91, 92, 93 each comprise a piston 58 which is arranged in a receiving chamber 95. The return spring 62 is preferably also arranged in the receiving chamber 95. The return spring 62 ensures that the respective first, second and third valve units 91, 92, 93 return to the non-actuated state if they are not actuated.

Figure 33:
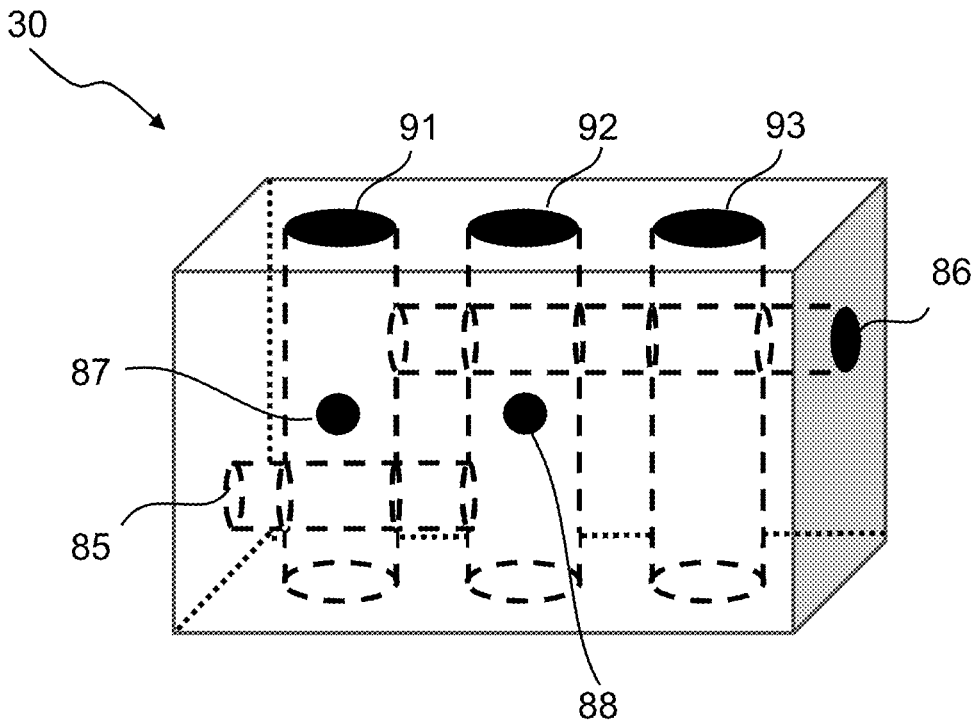

FIG. 33 shows a further embodiment of the valve device 30. In this case, the valve units 91, 92 and 93 are arranged in a common valve block. Three piston receiving bores for the three pistons 58 are made on a first side. This forms the valve units 91, 92, 93. The valve units 91, 92, 93 are all connected to one another by a fourth bore. The outlet of this fourth bore on the valve block forms the output connection 86 (preferably on a second side). A fifth bore connects the first and second valve units 91, 92. The outlet of this fifth bore on the valve block forms the line connection 85 (preferably on a third side). A sixth bore opens into the receiving chamber 95 of the first valve unit 91. The outlet of this sixth bore on the valve block forms the first actuator connection 87 (preferably on a fourth side). A seventh bore opens into the receiving chamber 95 of the second valve unit 92. The outlet of this seventh bore on the valve block forms the second actuator connection 88 (preferably on the fourth side). The second and third sides are preferably arranged opposite one another. The fourth side is preferably arranged perpendicular to the first, second and third sides.

In this case, the valve device 30 is formed by seven bores. The receiving chamber 95 of the first valve unit 91 is preferably connected directly to the line connection 85. The receiving chamber 95 of the second valve unit 92 could also be connected directly to the line connection 85. Preferably, however, the receiving chamber 95 of the second valve unit 92 is connected to the line connection 85 via the first valve unit 91. The receiving chamber 95 of the second valve unit 92 is connected directly to the third valve unit 93. The receiving chamber 95 of the first valve unit 91 could also be connected directly to the third valve unit 93. Preferably, however, the receiving chamber 95 of the first valve unit 91 is connected to the third valve unit 93 via the second valve unit 92.

Figure 34:
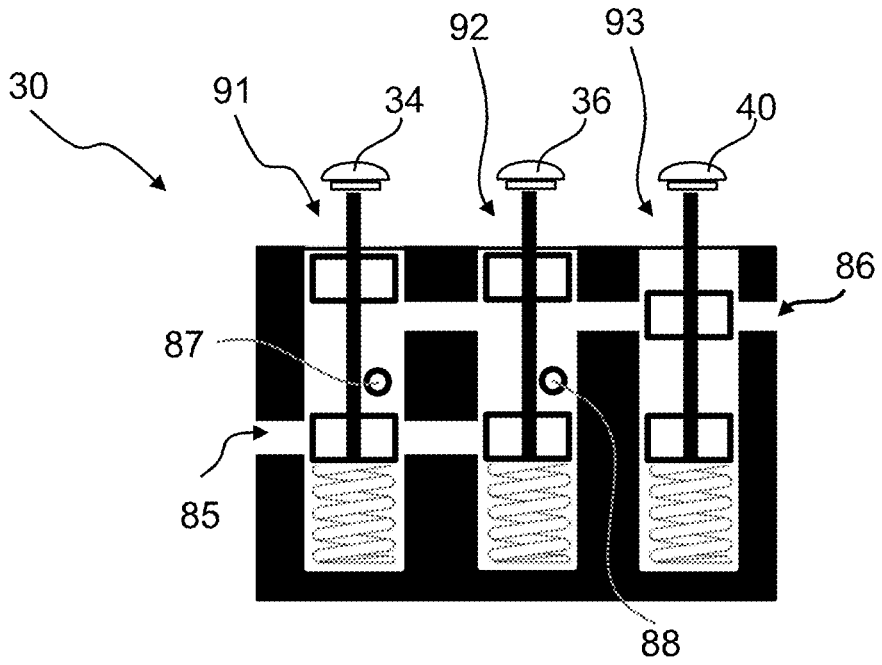

FIG. 34 shows a longitudinal section through the valve block to clarify the explanations for FIG. 33.

Figure 35:
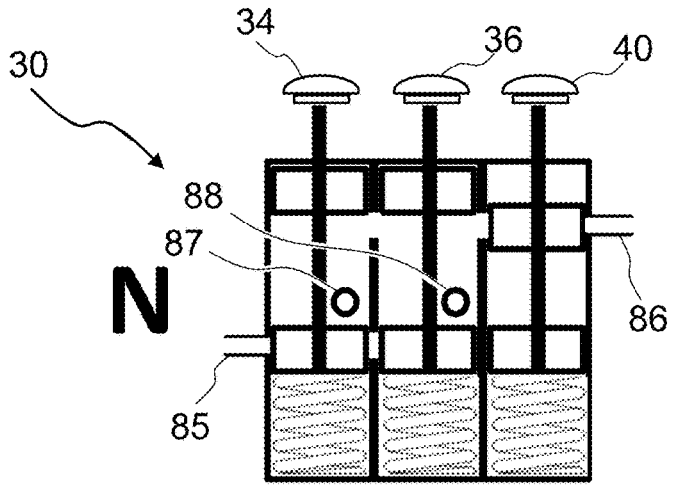

FIGS. 35, 36, 37 and 38 show the operation of the valve device 30 in the form of the valve block. In FIG. 35, all valve units 91, 92, 93 are in the unactuated state. Pressurized water can neither flow into one of the receiving chambers 95 via the line connection 85, nor can water flow out of the actuator arrangement 55 via the output connection 86. The valve device 30 assumes the "neutral position".

Figure 36:
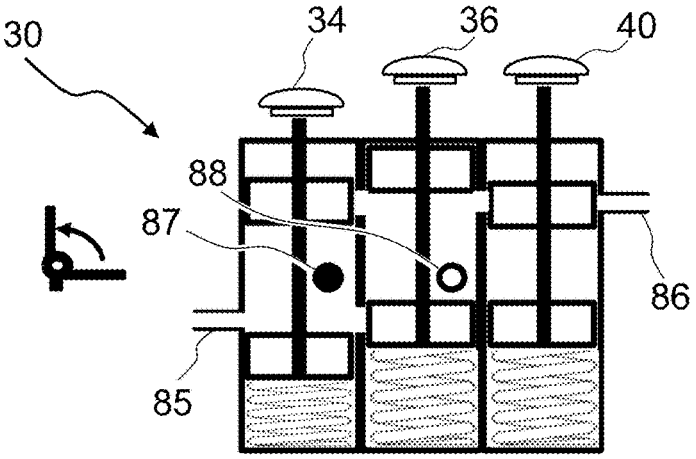

In FIG. 36, the first valve unit 91 is actuated (by pressing the button 34). In this case, pressurized water can flow into the receiving chamber 95 of the first valve unit 91 via the line connection 85. From there, the pressurized water is then fed to the first actuator connection 87. The first actuator connection 87 is connected to the first actuator 56*a*, so that in this case the toilet lid 16 is raised. The valve device 30 assumes the "first lifting position".

Figure 37:
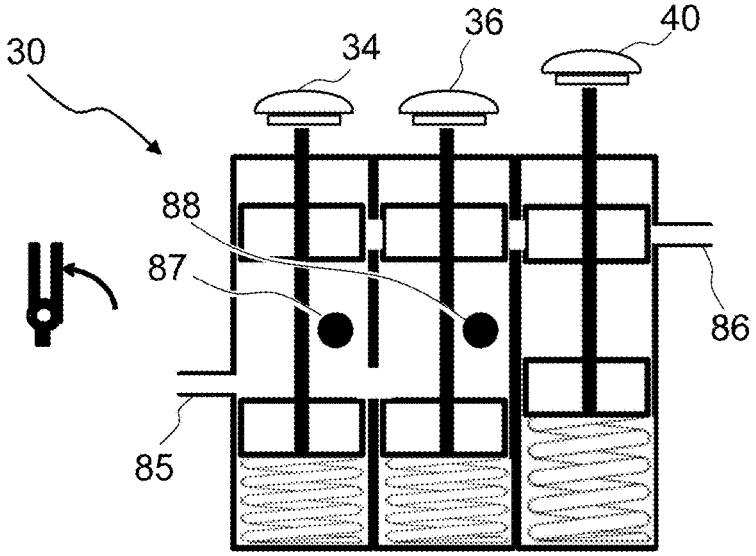

In FIG. 37, both the first valve unit 91 and the second valve unit 92 are actuated (by pressing the actuating elements 34, 36). In this case, pressurized water can flow into the receiving chamber 95 of the first valve unit 91 via the line connection 85. From there, the pressurized water is then fed to the first actuator connection 87. From the receiving chamber 95 of the first valve unit 91, the water also flows further into the receiving chamber 95 of the second valve unit 92. From the receiving chamber 95 of the second valve unit 92, the pressurized water is then fed to the second actuator connection 88. The second actuator connection 88 is connected to the second actuator 56*b*, so that in this case the seat ring 14 also rises. The valve device 30 assumes the "second lifting position".

In FIGS. 36 and 37 the third valve unit 93 is not actuated.

Figure 38:
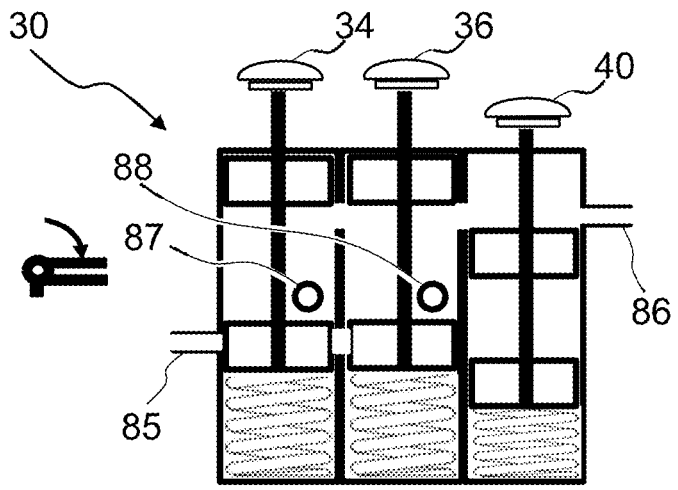

In FIG. 38 the first and second valve units 91, 92 are not actuated. The third valve unit 93, on the other hand, is actuated. In this case, pressurized water can flow from the first actuator 56*a* and the second actuator 56*b* via the output connection 86 of the third valve unit 93. The receiving chamber 95 of the first valve unit 91 is connected to the output connection 86 in the third valve unit 93 via the receiving chamber 95 of the second valve unit 92. The line connection 85 is separated from the first and second valve units 91, 92. In this case the toilet seat 13 is lowered. The valve device 30 assumes the "lowering position".

Figure 39:
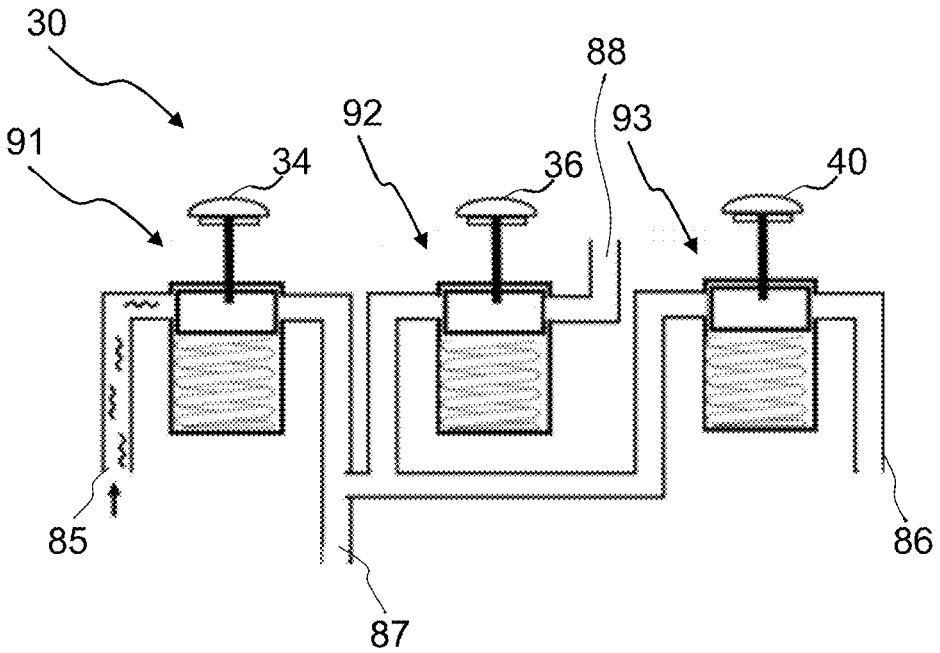

FIGS. 39, 40, 41 and 42 illustrate once again the functioning of the valve device 30 in the form of hydraulic valves which are housed in separate valve blocks. In FIG. 39, all valve units 91, 92, 93 are in the unactuated state. Pressurized water can neither flow into one of the receiving chambers 95 via the line connection 85, nor can water flow out of the actuator arrangement 55 via the output connection 86. The valve device 30 assumes the "neutral position".

Figure 40:
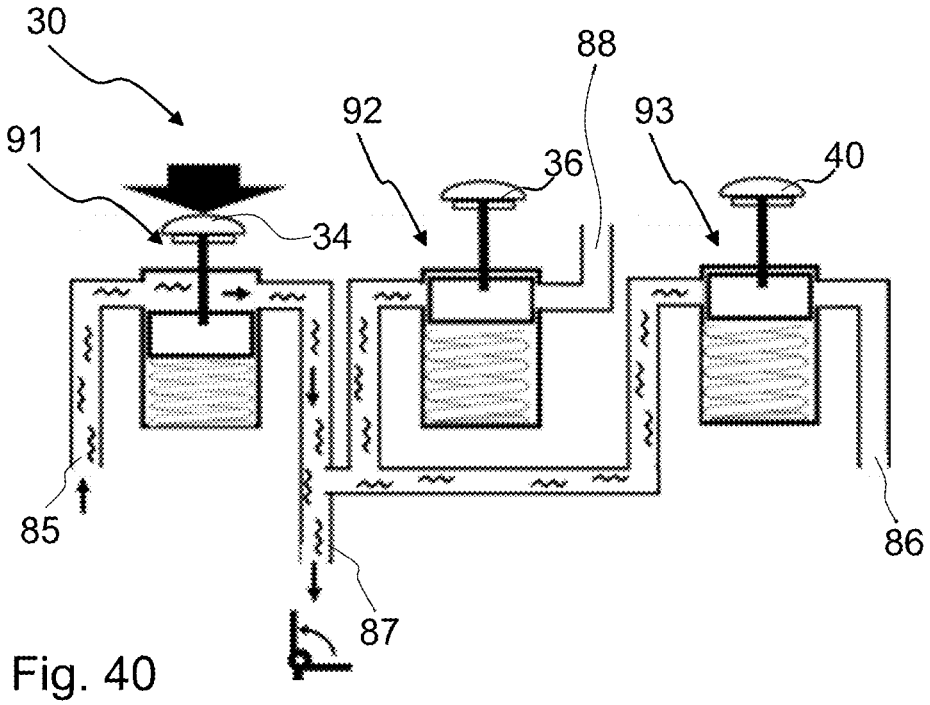

In FIG. 40, the first valve unit 91 is actuated (by pressing the actuating element 34). In this case, pressurized water can flow into the receiving chamber 95 of the first valve unit 91 via the line connection 85. From there, the pressurized water is then fed to the first actuator connection 87. The first actuator connection 87 is connected to the first actuator 56*a*, so that in this case the toilet lid 16 is raised. The valve device 30 assumes the "first lifting position".

Figure 41:
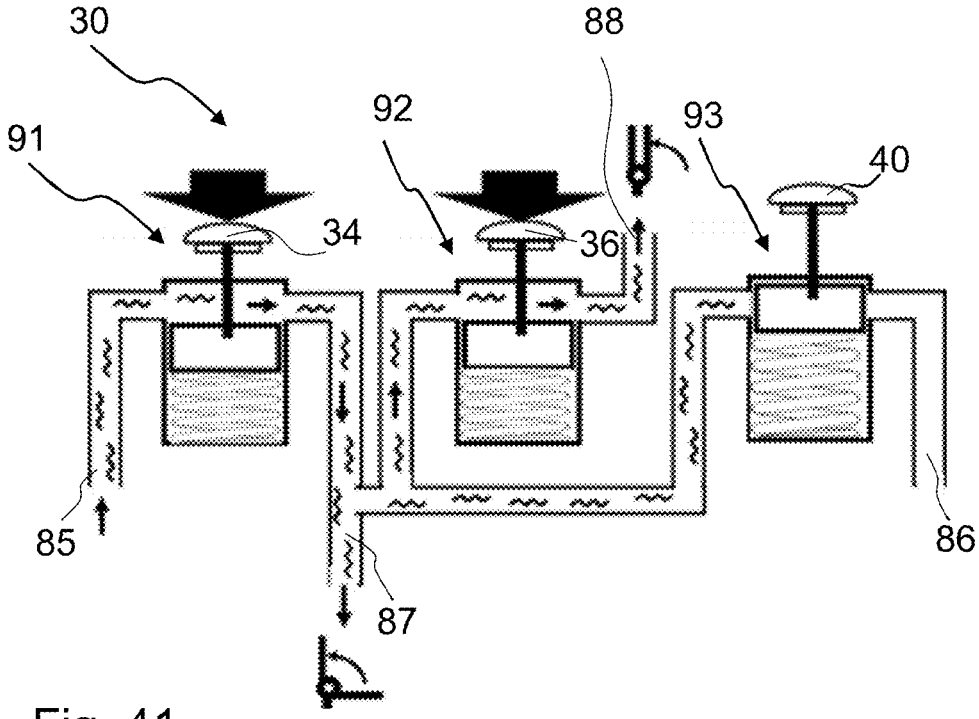

In FIG. 41, both the first valve unit 91 and the second valve unit 92 are actuated (by pressing the actuating elements 34, 36). Both the toilet lid 16 and the seat ring 14 are raised. The valve device 30 assumes the "second lifting position".

Figure 42:
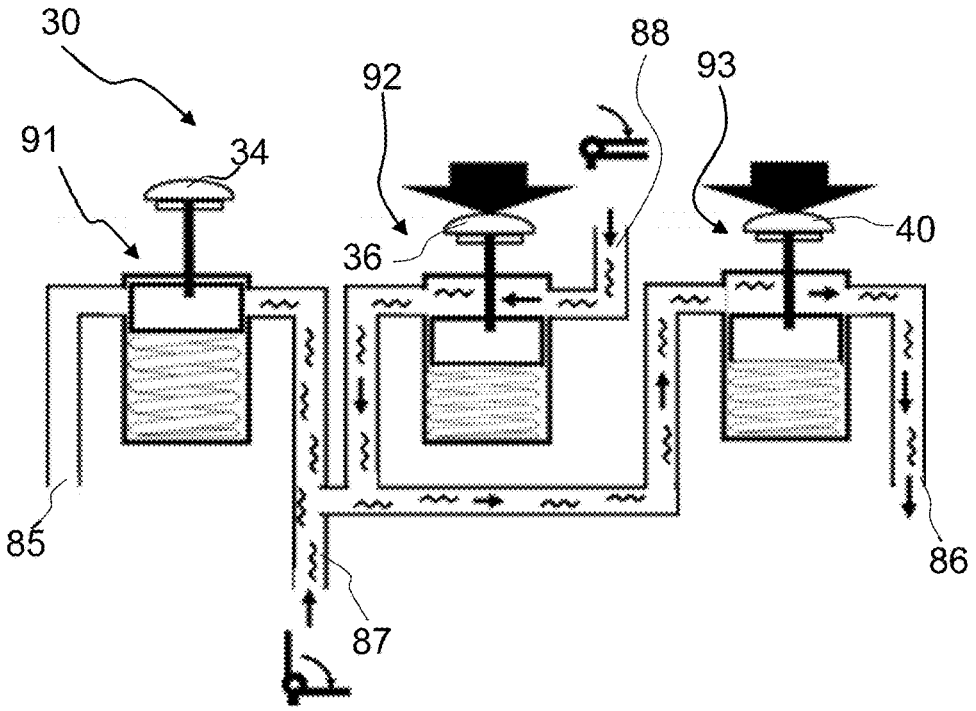

In FIG. 42, the first valve unit 91 is not actuated. The second and third valve units 93, 92, however, are actuated. In this case, pressurized water can flow out of the first actuator 56*a* and the second actuator 56*b* via the output connection 86 of the third valve unit 93. The line connection 85 is separated from the first and second valve units 91, 92. In this case, the toilet seat 13 is lowered. The valve device 30 assumes the "lowering position".

FIGS. 43, 44, 45 and 46 describe how the valve device 30 from FIGS. 39, 40, 41 and 42 can be operated.

Figure 43:
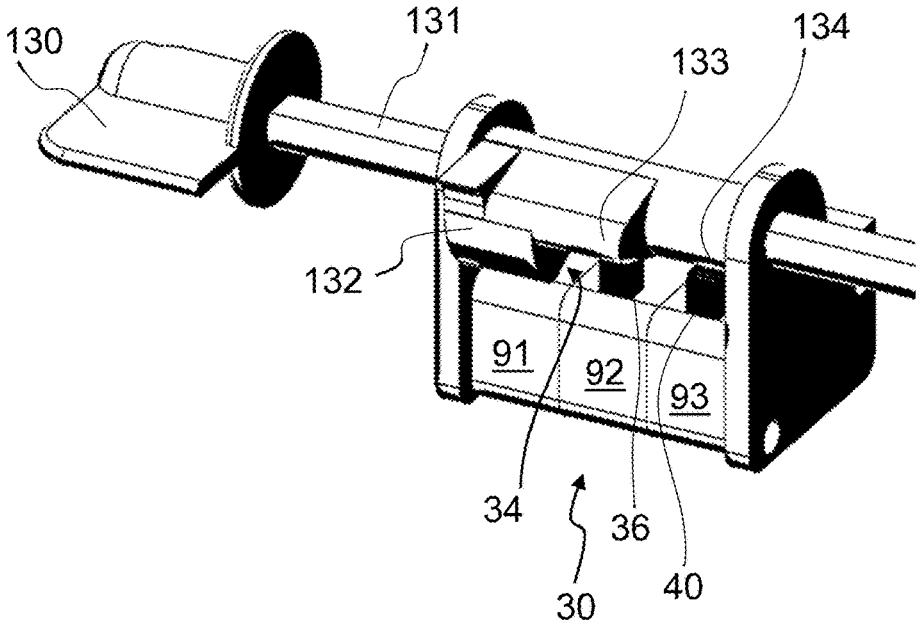

FIG. 43 shows one way in which the valve device 30 can be operated alternatively. The valve device 30 comprises an adjustment device. The adjustment device comprises an actuating element 130 and a transmission rod 131, wherein the actuating element 130 is connected to one end of the transmission rod 131 and wherein first, second and third actuating devices 132, 133, 134 are formed on the transmission rod 131. In FIG. 43, neither the first, second nor the third actuating device 132, 133, 134 come into contact with the actuating elements 34, 36, 40 of the first, second and third valve units 91, 92, 93, respectively. The valve device 30 assumes the "neutral position". The adjustment device is preferably preloaded by a spring device such that it moves into the "neutral position" and remains there without being actuated by a user.

Figure 44:
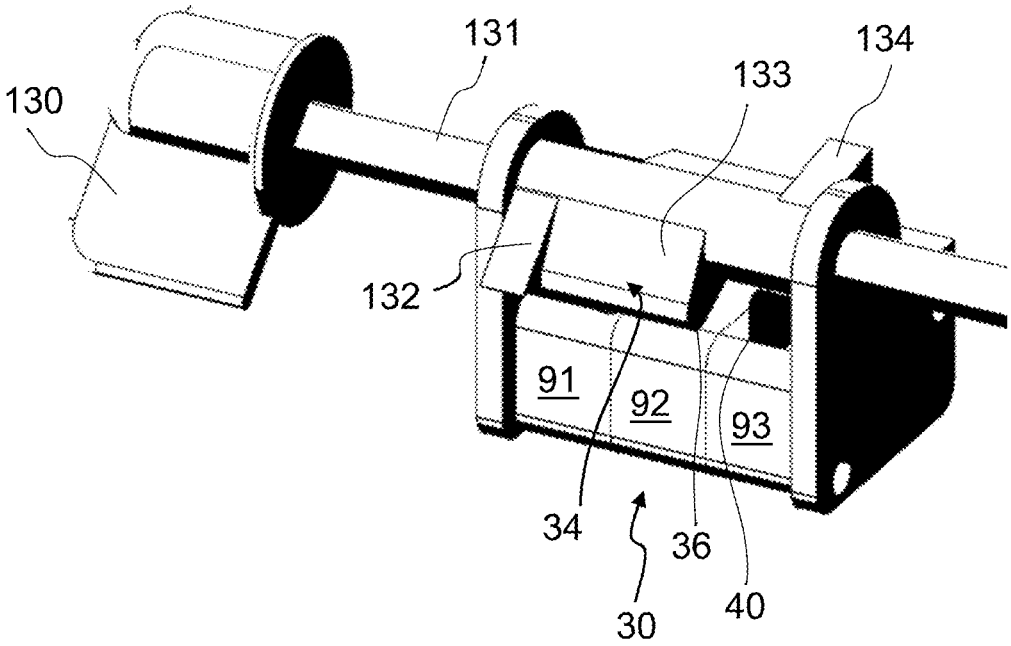

In a first rotational angle position, which is shown in FIG. 44, the first actuating device 132 contacts the actuating element 34 of the first valve unit 91. The "first lifting position" is assumed. The toilet lid 16 is raised.

Figure 45:
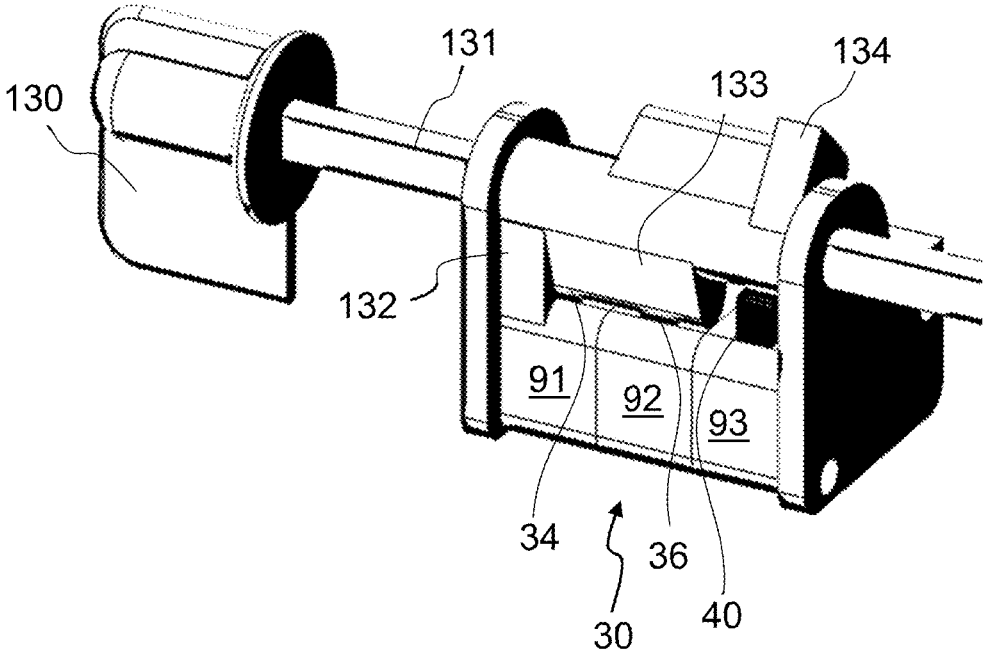

In a second rotational angle position, which is shown in FIG. 45, the first actuating device 132 contacts the actuating element 34 of the first valve unit (91) and the second actuating device 133 contacts the actuating element 36 of the second valve unit 92. The "second lifting position" is assumed. Both the toilet lid 16 and the seat ring 14 are raised.

Figure 46:
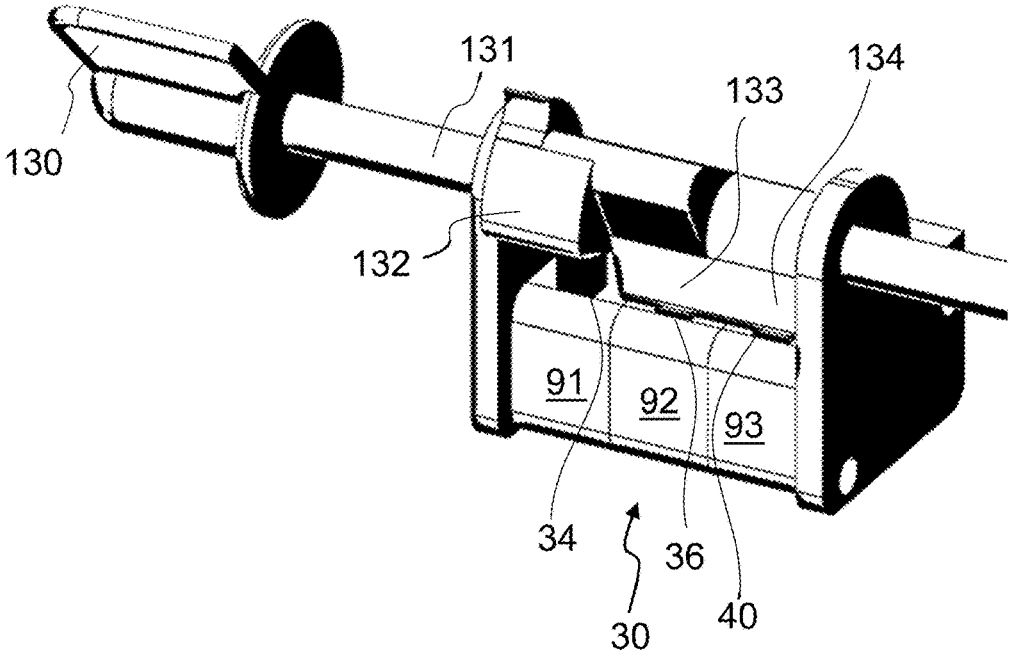

In a third rotational angle position, which is shown in FIG. 46, the actuating element 34 of the first valve unit 91 is out of contact with the first actuating device 132, the second actuating device contacts the actuating element 36 of the second valve unit 92 and the third actuating device 134 contacts the actuating element 40 of the third valve unit 93. The "lowering position" is assumed. Toilet lid 16 and seat ring 14 are lowered.

Preferably, the adjusting device is designed as a single piece and consists of or further preferably comprises metal or a metal alloy. In particular, the transmission rod 131 is designed as a single piece with the actuating devices 132, 133, 134 and consists of or further preferably comprises metal or a metal alloy.

The actuating devices 132, 133, 134 are preferably formed by an enlarged circumference of the transmission rod 131. The actuating devices 132, 133, 134 are preferably not radially symmetrical, but only extend over part of the circumference of the transmission rod 131. The actuating devices 132, 133, 134 are preferably arranged spaced apart from one another along the transmission rod 131.

FIGS. 47, 48, 49 and 50 show one way in which the valve device 30 can be operated alternatively. The valve device 30 comprises an adjustment device. The adjustment device comprises a first, second and third button 140, 141, 142. The first button 141 comprises a touch field 143 and a transmission rod 144, wherein the touch field 143 is arranged at one end of the transmission rod 144 and wherein the transmission rod 144 is designed to actuate the actuating element 34 of the first valve unit 91 when the touch field 143 is pressed. The second button 141 comprises a touch field 145 and a transmission rod 146, wherein the touch field 145 is arranged at one end of the transmission rod 146 and wherein the transmission rod 146 is designed to actuate the actuating element 36 of the second valve unit 92 when the touch field 145 is pressed. The third button 142 comprises a touch field 147 and a transmission rod 148, wherein the touch field 147 is arranged at one end of the transmission rod 148 and wherein the transmission rod 148 is designed to actuate the actuating element 40 of the third valve unit 93 when the touch field 147 is pressed.

Figure 47:
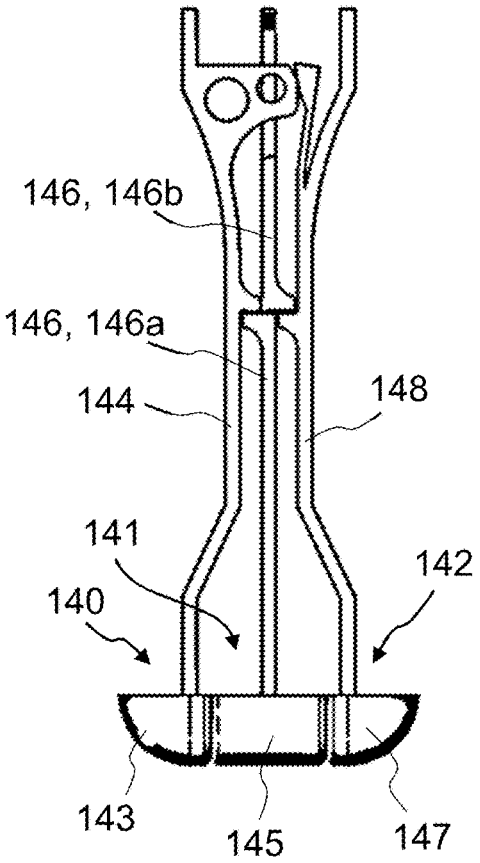

In FIG. 47, neither the first, second nor the third button 140, 141, 142 come into contact with the actuating elements 34, 36, 40 of the first, second and third valve units 91, 92, 93, respectively. The valve device 30 assumes the "neutral position". The adjustment device is preferably preloaded by a spring device such that it moves into the "neutral position" and remains there without being actuated by a user.

Figure 48:
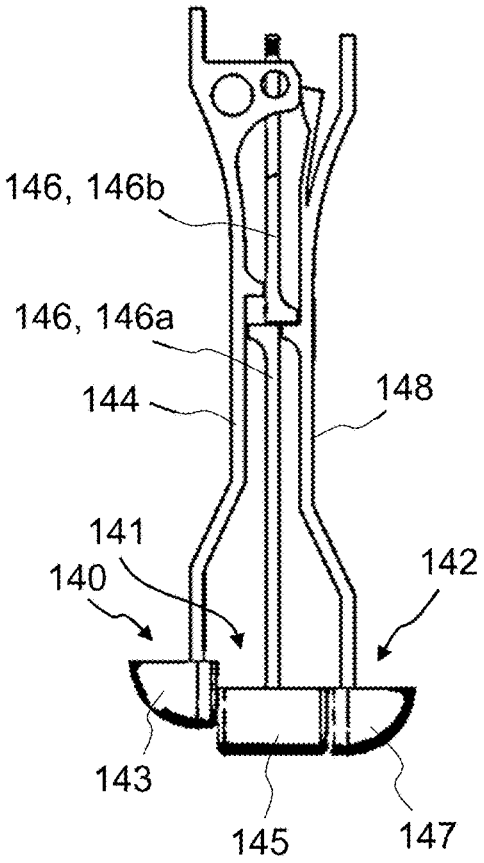

FIG. 48 shows that the first button 140 is actuated. The first button 140 comes into contact with the actuating element 34 of the first valve unit 91 through its transmission rod 144. The toilet lid 16 rises. The "first lifting position" is assumed.

Figure 49:
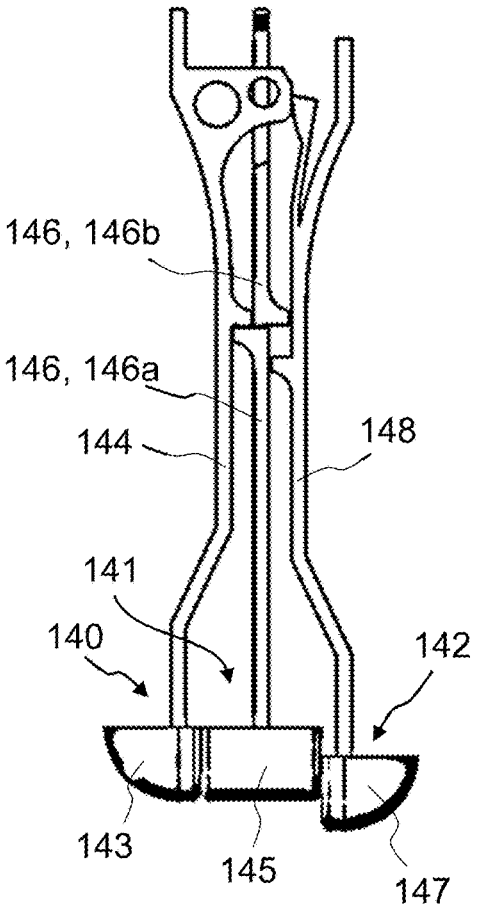

FIG. 49 shows that the first button 140 and the second button 141 are actuated. The first button 140 comes into contact with the actuating element 34 of the first valve unit 91 through its transmission rod 144. The second button 141 comes into contact with the actuating element 36 of the second valve unit 92 through its transmission rod 146. The toilet lid 16 and the seat ring 14 rise. The second button 141 is preferably designed to also actuate the actuating element 34 of the first valve unit 91 when it is actuated. This is achieved by the transmission rod 146 of the second button 141 coming into contact with the transmission rod 144 of the first button 140 and also moving this (axially) so that the transmission rod 144 of the first button 140 comes into contact with the actuating element 34 of the first valve unit 91. The "second lifting position" is assumed.

Figure 50:
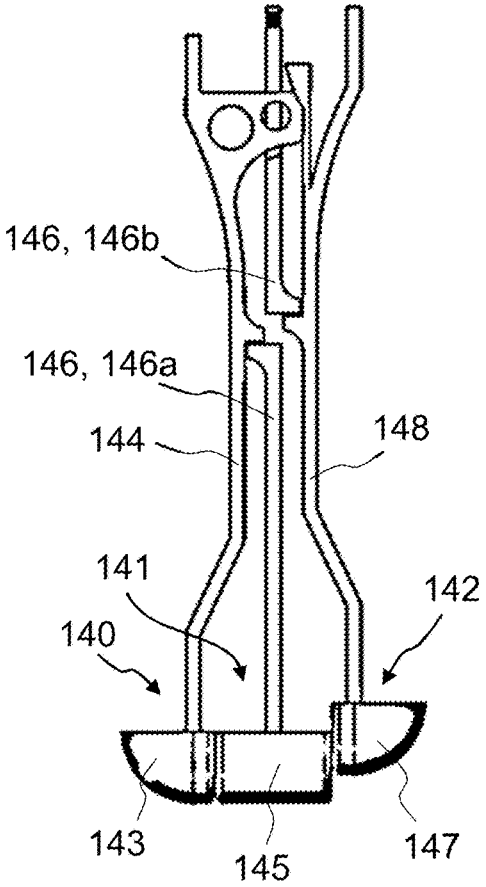

FIG. 50 shows that the third button 142 is actuated. The third button 142 comes into contact with the actuating element 40 of the third valve unit 93 through its transmission rod 148. The third button 142 is designed to actuate only the actuating elements 36, 40 of the second and third valve units 92, 93 when it is actuated and to leave the actuating element 34 of the first valve unit 91 unactuated. This is achieved, for example, by the fact that the transmission rod 146 of the second button 141 is constructed in two parts. When the touch field 145 of the second button 141 is actuated, both parts 146*a*, 146*b* of the transmission rod 146 of the second button 141 are moved (axially). The first part 146*a* of the transmission rod 146 of the second button 141 is arranged on the touch field 145 of the second button 141 and the second part 146*b* of the transmission rod 146 of the second button 141 can be brought into contact with the actuating element 36 of the second valve unit 92. When the second button 141 is actuated, the first part 146*a* of the transmission rod 146 of the second button 141 also comes into contact with the transmission rod 144 of the first button 140 and moves it. When the third button 142 is actuated, the transmission rod 148 of the third button 142 only comes into contact with the second part 146*b* of the transmission rod 146 of the second button 141 and moves this second part 146*b* of the transmission rod 146, but not the first part 146*a* of the transmission rod 146 of the second button 141. The two-part structure of the transmission rod 146 of the second button 141 makes it possible for the actuating elements 36 and 40 of the second and third valve units 92 and 93 to be actuated when the third button 142 is actuated, whereas the actuating element 34 of the first valve unit 91 remains unactuated. The toilet lid 16 and seat ring 14 are lowered. The "lowering position" is assumed.

FIG. 51 shows one way in which the valve device 30 can be operated alternatively. The valve device 30 comprises an adjustment device which has a dial 96. The dial 96 is arranged adjacent to the actuating elements 34, 36, 40, which in this case are buttons. The dial 96 comprises elevations 97 which are directed in the direction of the actuating elements 34, 36, 40 of the first, second and third valve units 91, 92, 93 and can be brought into contact with these actuating elements 34, 36, 40. Depending on the angular position of the dial 96, all actuating elements 34, 36, 40 are arranged without contact with the elevations 97, whereby the "neutral position" is assumed. If the dial 96 is rotated by a certain angular position, only the actuating element 34 of the first valve unit 91 comes into contact with a protrusion 97, whereby the "first lifting position" is assumed. If the dial 96 is rotated to a different angular position, only the actuating elements 34, 36 of the first and second valve units 91, 92 come into contact with the protrusions 97, whereby the "second lifting position" is assumed. If the dial 96 is rotated to a different angular position, only the actuating element 40 of the third valve unit 93 comes into contact with a protrusion 97, whereby the "lowering position" is assumed. An operating lever 32 can also be arranged on the dial 96 in order to facilitate the adjustment of the dial 96. The dial 96 can also have a return spring 31 which is arranged and pre-tensioned in such a way that the dial 96 returns to the angular position in which the valve device 30 assumes the "neutral position" when it is not operated by a user. The adjustment device from FIG. 51 is particularly suitable for operating the valve device as described in FIGS. 33 to 38.

FIGS. 52, 53, 54 show another embodiment of the valve device 30. FIG. 52 shows the use of the valve device 30 in a top-mounted cistern and FIG. 53 in a concealed cistern.

The valve device 30 comprises a valve housing 100 which surrounds a receiving space 101. A piston 58 is arranged in the receiving space 101 so as to be displaceable in the longitudinal direction of the receiving space 101. The line connection 85, the output connection 86, the first actuator connection 87 and, in this embodiment, also the second actuator connection 88 are connected to the receiving space 101. The connections 85, 86, 87, 88 are arranged offset from one another in the longitudinal direction of the receiving space 101 and open into the receiving space 101 from outside the valve housing 100. The piston 58 comprises a piston head 59. The piston 58 also comprises a piston rod 60. One end of the piston rod 60 is attached to the piston head 59 or is formed in one piece with the piston head 59. Another end protrudes from the valve housing 100 and forms the operating lever 32. The piston rod 60 has thickenings 102 on its circumference, which are arranged at a distance from one another in the longitudinal direction and lie flush against an inner wall of the valve housing 100 and thus divide the receiving space 101 into different chambers.

The left illustration of FIG. 55 shows the "neutral position" of the valve device 30. The piston 58 is arranged such that the line connection 85, the output connection 86, the first actuator connection 87 and the second actuator connection 88 open into separate chambers. This wording also includes the fact that a thickening 102 blocks the outlet of the connection 85, 86, 87, 88 into the receiving space 101. Therefore, no water under pressure can flow from the line connection 85 to the first actuator connection 87 because a corresponding thickening 102 is in the way.

The illustration to the right (second from left) shows the "first lifting position" of the valve device 30. The piston 58 is arranged such that the line connection 85 and the first actuator connection 87 open into a common chamber. Therefore, water under pressure can flow from the line connection 85 to the first actuator connection 87.

The illustration to the right (third from the left) shows the "second lift position" of the valve device 30. The piston 58 is arranged such that the line connection 85, the first actuator connection 87 and the second actuator connection 88 open into a common chamber. Therefore, pressurized water can flow from the line connection 85 to the first actuator connection 87 and to the second actuator connection 88.

The illustration to the far right shows the "lower position" of the valve device 30. The piston 58 is arranged such that the first actuator connection 87, the second actuator connection 88 and the output connection 86 open into a common chamber. Therefore, pressurized water can flow from the first actuator connection 87 and the second actuator connection 88 into the output connection 87.

The valve device 30 also includes a return spring 31. The return spring 31 is arranged between the piston head 59 of the piston 58 and a closed end of the valve housing 100. The return spring 31 is preloaded in such a way that it wants to push the piston 58 out of the receiving space 101. In order to get from the "neutral position" to the "first lifting position", the piston 58 must preferably be pushed further into the receiving space 101 against the spring force of the return spring 31. In order to get to the "second lifting position", the piston 58 must preferably be pushed even further into the receiving space 101 against the spring force of the return spring 31. In order to get from the "neutral position" to the "lowering position", the piston 58 must preferably be pulled further out of the receiving space 101.

The return spring 31 is preferably pre-tensioned such that when the operating lever 32 is released, the piston 58 goes into the "neutral position". To ensure that the piston 58 is not pushed beyond the "neutral position" (if the "neutral position" is not the outermost position), there is also a locking device 33. The locking device 33 comprises a spring and a locking element, such as a ball. The locking element is pressed in the direction of the piston rod 60 via the spring. The piston rod 60 comprises a corresponding groove, which preferably extends along the entire circumference of the piston rod, wherein the locking element is pressed into this groove in the "neutral position". The spring force of the return spring 31 is not strong enough to apply a force to thereby push the locking element back, which could push the piston rod 60 further out of the receiving space 101. Only with an increased effort from the user can the operating lever 32 be pulled further out of the receiving space 101 (in the direction of the "lowering position") or only with an increased effort can the operating lever be pushed further into the receiving space (in the direction of the "first lifting position").

In principle, the toilet seat 13 should lower slowly in the "lowering position" and not hit the toilet bowl 2 with a "bang". This is achieved, for example, via the cross-section of the vent hose 50 of the line system 45. The cross-section of the vent hose 50 is preferably smaller than the cross-section of the (hydraulic) hose 46, 48 to the first actuator 56*a* or the second actuator 56*b*. As a result, the water only flows out of the actuator arrangement 55 at a certain speed and the toilet seat 13 lowers at a precisely defined speed. In principle, the cross-section of the (hydraulic) hose 46, 48 to the first actuator 56*a* or the second actuator 56*b* can also be dimensioned accordingly so that a certain line resistance is established and the water does not flow out of the actuator arrangement 55 too quickly.

It is particularly advantageous that the lifting of the toilet lid 16 and/or the seat ring 14 can be initiated without having to touch the toilet lid 16 and/or the seat ring 14. The same applies to the lowering of the toilet lid 16 and/or the seat ring 14. It is also particularly advantageous that the toilet seat 13 closes automatically, in a braked and controlled manner and does not "bang" on the toilet bowl 2. The user only has to initiate the lowering process and can leave immediately without having to wait for the lowering process to be completed. As soon as the lowering process is initiated, the actuator arrangement 55 remains disconnected from the water supply. There is no risk of water damage occurring if a line in the line system 45 bursts. The supply line 44 is preferably arranged exclusively in the cistern 8 or above the cistern 8. The latter is the case when the valve device 30 is arranged above the cistern 8. If the valve device 30 is in the "neutral position" and the supply line 44 were to burst, the water would only run into the cistern 8.

The toilet system 1 advantageously comprises the following features:

- the outer housing 24 and the inner housing 72 each comprise a second guide 70*b*, 73*b;*
- the respective second guide 70*b*, 73*b* on the outer housing 24 and inner housing 72 is arranged at a distance from the respective first guide 70*a*, 73*a* on the outer housing 24 and inner housing 72 in the circumferential direction of the respective outer housing 24 and inner housing 72;
- a second sliding element 63*b* on the piston 58 is guided both by the second guide 70*b* on the outer housing 24 and by the second guide 73*b* on the inner housing 72.

Advantageously, the toilet system 1 comprises the following feature:

- a spring force of the return spring 62 of the first actuator 56*a* is smaller than a force that the pressurized water exerts on the first actuator 56*a*, so that the toilet lid 16 is raised when the pressurized water rests on the first actuator 56*a*.

Advantageously, the toilet system 1 comprises the following features:

- the outer housing 24 preferably comprises a round inner diameter or is approximated to a round inner diameter; and/or
- the inner housing 72 preferably comprises a round outer diameter or is approximated to a round outer diameter.

The toilet system 1 advantageously comprises the following features:

- the outer housing 24 comprises a second opening on the peripheral wall, with a second groove 81*b* extending on the inner wall of the outer housing 24 starting from the second opening, which runs in the longitudinal direction of the outer housing 24; —the second opening is arranged offset from the first opening 77*a* at least in the circumferential direction;
- the second groove 81*b* of the inner housing 72 is arranged spaced apart from the first groove 81*a* in the circumferential direction;
- in an assembly position, the inner housing 72 is pressed further into the outer housing 24 against the spring force of the return spring 62 such that the second opening of the outer housing lies above the second groove 81*b* of the inner housing 72 in order to insert at least a second spherical locking element 74*b* via the second opening in the outer housing 24;
- in a locking position, the inner housing 72 is pushed further out of the outer housing 24 relative to the outer housing 24 by the restoring force of the restoring spring 62, whereby the second spherical locking element 74*b* lies in the second groove of the outer housing 24 and in the second groove 81*b* of the inner housing 72, wherein the second spherical locking element 74*b* rolls in the second groove 81*b* of the inner housing 72 during a rotational movement of the inner housing 72.

The toilet system 1 advantageously comprises the following feature:

- the first hinge arm 20*a* of the toilet lid 16 is arranged closer to the free end of the fastening section 78 of the inner housing 72 protruding from the outer housing 24 of the first actuator 56*a* than the first hinge arm 18*a* of the seat ring 14.

The toilet system 1 advantageously comprises the following features:

- the line system 45 comprises a supply line 44 which can be connected to the water line and which is connected to the valve device 30;
- the supply line 44 is arranged in and/or above the cistern 8 so that if the supply line 44 leaks, water flows from the supply line 44 into the cistern 8.

The toilet system 1 advantageously comprises the following features:

- the valve device 30 is arranged closer to the second end 12*b* of the inlet pipe 12 than to the first end 12*a* of the inlet pipe 12;
- the line system 45 connects the valve device 30 to the actuator arrangement 55.

The toilet system 1 advantageously comprises the following features:

- the actuator arrangement 55 comprises a first actuator 56*a* in the form of a hydraulic cylinder;
- the first actuator 56*a* comprises a connection 57 which is connected to the line system 45;
- the first actuator 56*a* comprises an outer housing 24, an inner housing 72 and a piston 58;
- the inner housing 72 is arranged in the outer housing 24 and the piston 58 is at least partially arranged in the inner housing 72;
- the first actuator 56*a* is designed such that when the piston 58 moves, the inner housing 72 is rotated relative to the outer housing 24, wherein a first hinge arm 18*a*, 20*a:*
  - a) of the toilet lid 16; or
  - b) the seat ring 14, if the toilet seat 13 only comprises a seat ring 14, is non-rotatably attached to the inner housing 72, so that a rotation of the inner housing 72 causes a rotation of the first hinge arm 20*a* of the toilet lid 16 or the first hinge arm 18*a* of the seat ring 14, which results in the toilet lid 16 or the seat ring 14 being raised or lowered.

The toilet system 1 advantageously comprises the following features:

the outer housing 24 comprises a first end 79*a* with a base 25, wherein pressurized water can flow in between the base 25 of the outer housing 24 and the piston 58, whereby the piston 58 can be moved along a longitudinal axis 80 of the first actuator 56*a* in the direction of a second end 78*b* of the outer housing 24;

the piston 58 is guided through both the outer housing 24 and the inner housing 72;

the outer housing 24 is arranged stationary;

a first guide 73*a* on the inner housing 72 is curved, in particular spiral-shaped, which is why an axial movement of the piston 58 along the longitudinal axis 80 of the first actuator 56*a* is converted into a rotary movement of the inner housing 72.

The toilet system 1 advantageously comprises the following features:

a first guide 70*a* on the outer housing 24 is formed on an inner wall of the outer housing 24;

the first guide 70*a* on the outer housing 24 is a projection or a groove;

the first guide 73*a* on the inner housing 72 is an opening that completely penetrates the wall of the inner housing 72;

a first sliding element 63*a* on the piston 58 passes through the opening on the inner housing 72 and rests on the wall on the inner housing 72 and on the projection or the groove on the outer housing 24.

The toilet system 1 advantageously comprises the following features:

the first sliding element 63*a* comprises one or more rollers 64, 66.

The toilet system 1 advantageously comprises the following features:

the first actuator 56*a* comprises a return spring 62;

the return spring 62 is arranged on the piston 58 and on the inner housing 72 and is designed to exert a force on the piston 58 so that it moves into a starting position in which:

a) the toilet lid 16; or b) the seat ring 14, if the toilet seat 13 only comprises a seat ring 14, is lowered and finally covers the toilet bowl 2.

The toilet system 1 advantageously comprises the following features:

a locking device 75 is provided, wherein the locking device 75 is designed to prevent movement of the inner housing 72 relative to the outer housing 24 in the longitudinal direction of the outer housing 24 when the first actuator 56*a* raises or lowers:

a) the toilet lid 16; or b) the seat ring 14, if the toilet seat 13 only comprises a seat ring 14.

The toilet system 1 advantageously comprises the following features:

the return spring 62 exerts a force to push the inner housing 72 out of the outer housing 24;

the outer housing 24 comprises a first opening 77*a* on the peripheral wall, with a first groove extending on the inner wall of the outer housing 24 starting from the first opening 77*a*, which runs in the longitudinal direction of the outer housing 24;

the inner housing 72 comprises a first groove 81*a*, which extends in the circumferential direction;

in an assembly position, the inner housing 72 is pressed further into the outer housing 24 against the spring force of the return spring 62 such that the first opening 77*a* of the outer housing 24 lies above the first groove 81*a* of the inner housing 72 in order to insert at least a first spherical locking element 74*a* via the first opening 77*a* in the outer housing 24;

in a locking position, the inner housing 72 is pushed further out of the outer housing 24 relative to the outer housing 24 by the restoring force of the restoring spring 62, whereby the first spherical locking element 74*a* lies in the first groove of the outer housing 24 and in the first groove 81*a* of the inner housing 72, wherein the first spherical locking element 74*a* rolls in the first groove 81*a* of the inner housing 72 during a rotational movement of the inner housing 72.

The toilet system 1 advantageously comprises the following features:

the first hinge arm 18*a* of the seat ring 14 comprises a circular opening in which the fastening section 78 of the inner housing 72 of the first actuator 56*a* is rotatably mounted without transmitting a torque; and/or the fastening section 78 of the inner housing 72 of the first actuator 56*a:* a) comprises, in the area where the first hinge arm 20*a* of the toilet lid 16 is arranged in a rotationally fixed manner, a cross-section that deviates from a circular cross-section, wherein the first hinge arm 20*a* of the toilet lid 16 has an opening corresponding thereto; and/or b) is screwed to the first hinge arm 20*a* of the toilet lid 16 and/or locked to form a plug connection.

The toilet system 1 advantageously comprises the following features:

the first actuator 56*a* and the second actuator 56*b* are arranged one on top of the other, rotated by 180°.

The toilet system 1 advantageously comprises the following features:

the outer housing 24 of the first actuator 56*a* and the outer housing 24 of the second actuator 56*b* are formed as a one-piece outer housing 24 in a common manufacturing process;

a receiving space which is delimited by the outer housing 24 of the first actuator 56*a* is separated by a base 25 from a receiving space which is delimited by the outer housing 24 of the second actuator 56*b*.

The toilet system 1 advantageously comprises the following features:

the valve device 30 comprises an adjustment device;

the adjustment device comprises a dial 96 which is arranged adjacent to the actuating elements 34, 36, 40 of the first, second and third valve units 91, 92, 93;

the dial 96 comprises elevations 97 which are directed in the direction of the actuating elements 34, 36, 40 of the first, second and third valve units 91, 92, 93 and can be brought into contact with these actuating elements 34, 36, 40;

depending on the angular position of the dial 96:

a) all actuating elements 34, 36, 40 are arranged without contact with the elevations 97, whereby the neutral position is assumed;

b) only the actuating element 34 of the first valve unit 91 comes into contact with an elevation 97, whereby the first lifting position is assumed;

c) only the actuating elements 34, 36 of the first and second valve units 91, 92 come into contact with the elevations 97, whereby the second lifting position is assumed;

d) only the actuating element 40 of the third valve unit 93 comes into contact with a projection 97, whereby the lowering position is assumed.

The toilet system 1 advantageously comprises the following features:

the valve device 30 comprises a valve housing 100 which surrounds a receiving space 101 in which a piston 58 is arranged so as to be displaceable in the longitudinal direction of the receiving space 101;

the line connection 85, the first actuator connection 87 and the output connection 86 are connected to the receiving space 101, with the connections 85, 86, 87 opening into the receiving space 101 offset from one another in the longitudinal direction;

the piston 58 has thickenings 102 on its circumference which are arranged at a distance from one another in the longitudinal direction and lie flush against an inner wall of the valve housing 100 and divide the receiving space 101 into different chambers;

in the neutral position, the piston 58 is arranged such that the line connection 85, the first actuator connection 87 and the output connection 86 open into separate chambers or are separated from each other;

in the first lifting position, the piston 58 is arranged such that the line connection 85 and the first actuator connection 87 open into the same chamber;

in the lowering position, the piston 58 is arranged such that the first actuator connection 87 and the output connection 86 open into the same chamber.

The toilet system 1 advantageously comprises the following features:

the second actuator connection 88 is connected to the receiving space 101, the connections 85, 86, 87, 88 opening into the receiving space 101 offset from one another in the longitudinal direction;

in the second lifting position, the piston 58 is arranged such that the line connection 85, the first actuator connection 87 and the second actuator connection 88 open into the same chamber;

in the lowering position, the piston 58 is arranged such that the first actuator connection 87, the second actuator connection 88 and the output connection 86 open into the same chamber.

Advantageously, the toilet system 1 comprises the following features:

the valve device 30 comprises a reset device 31 which is designed to move the valve device 30 into the neutral position;

the valve device 30 comprises a pre-tensioned locking device 33 with a latching element;

in the neutral position, the locking element engages in a groove on the circumference of the piston 58 in such a way that the force of the return device is too low to bring the locking element of the locking device out of engagement with the groove, whereby the piston 58 remains in the neutral position.

The toilet system 1 advantageously comprises the following feature:

the valve device 30 is arranged inside the cistern 8.

The toilet system 1 advantageously comprises the following features:

the first actuator 56*a* comprises an outer housing 24, an inner housing 72 and a piston 58; the inner housing 72 is arranged in the outer housing 24 and the piston 58 is at least partially arranged in the inner housing 72; the first actuator 56*a* is designed so that when the piston 58 moves, the inner housing 72 is rotated relative to the outer housing 24, wherein a first hinge arm 20*a* of the toilet lid 16 is fixedly attached to the inner housing 72 in a rotationally fixed manner, so that a rotation of the inner housing 72 causes a rotation of the first hinge arm 20*a* of the toilet lid 16, which leads to a raising or lowering of the toilet lid 16;

the second actuator 56*b* comprises an outer housing 24, an inner housing 72 and a piston 58;

the inner housing 72 is arranged in the outer housing 24 and the piston 58 is at least partially arranged in the inner housing 72;

the second actuator 56*b* is designed so that when the piston 58 moves, the inner housing 72 is rotated relative to the outer housing 24, wherein a second hinge arm 18*b* of the seat ring 14 is attached to the inner housing 72 in a rotationally fixed manner when the toilet seat 13 comprises a toilet lid 16, so that a rotation of the inner housing 72 causes a rotation of the second hinge arm 18*b* of the seat ring 14, which results in the seat ring 14 being raised or lowered.

The toilet system 1 advantageously comprises the following feature:

the first, second and third valve units 91, 92, 93 comprise separate housings.

The invention is not limited to the described embodiments. Within the scope of the invention, all described and/or drawn features can be combined with one another as desired.

The invention claimed is:

1. Toilet system for use with a toilet seat comprising a) a seat ring; or b) a toilet lid and a seat ring, the toilet system comprising:

a toilet bowl which can be mounted on a floor or on a wall;

a cistern and an inlet pipe, wherein a first end of the inlet pipe is connected to the toilet bowl;

a second end of the inlet pipe connected to the cistern and can be connected via the cistern to a pressurized water supply line via which water can be drawn for flushing;

the cistern comprises an overflow pipe, wherein the overflow pipe extends the inlet pipe in an inoperative state of the toilet system in such a way that no water flows from the cistern into the inlet pipe;

the toilet system further comprising:

an actuator arrangement, a valve device, and a hose system;

the actuator arrangement configured to be connected to the water supply line via the valve device and the hose system;

the valve device being designed to supply the pressurized water from the water supply line to the actuator arrangement, and the actuator arrangement being designed to raise the toilet seat by means of the pressurized water, wherein the hose system runs inside the inlet pipe.

2. Toilet system according to claim 1, wherein:

the toilet bowl comprises a flushing channel;

the first end of the inlet pipe is connected to the flushing channel;

the actuator arrangement and the toilet seat are arranged on an upper side of the toilet bowl;

at least one through hole is provided in the toilet bowl, which extends from the upper side of the toilet bowl into the flushing channel; and the hose system emerges from the inlet pipe in a region of the first end of the inlet pipe and is guided via the flushing channel and the at least one through hole to the actuator arrangement.

3. Toilet system according to claim 1, wherein:

the actuator arrangement is configured to direct water in the direction of the valve device in order to thereby lower the toilet seat; and the valve device is configured to direct water coming from the actuator arrangement into the cistern.

4. Toilet system according to claim 1, wherein:

the actuator arrangement comprises a pressure relief valve which is designed to drain water from the actuator arrangement when a certain pressure value within the actuator arrangement is reached or exceeded.

5. Toilet system according to claim 1, wherein:

the actuator arrangement comprises an automatic lowering mechanism which is designed to lower the toilet seat in a braked manner; and the automatic lowering mechanism comprises a return spring arrangement which is configured to press the water out of the actuator arrangement, whereby the braked lowering can be initiated.

6. Toilet system according to claim 1, wherein:

the actuator arrangement is configured to rotate the toilet lid in an opening movement about a rotation axis by means of the pressurized water, whereby the toilet lid rotates from a closed position in which it rests on the seat ring to an open position; and torque is transmitted in the opening movement only from the actuator arrangement to the toilet lid and not from the toilet lid in the direction of the actuator arrangement, so that a manual opening movement of the toilet lid does not lead to any rotation of the actuator arrangement, whereby freewheeling of the toilet lid is possible at least in the opening movement.

7. Toilet system according to claim 1, further comprising:

a return device for the toilet lid, wherein the return device comprises at least one spring, wherein the at least one spring is arranged in an opening of the toilet lid of the toilet seat; and one end of the at least one spring protrudes from the toilet lid of the toilet seat in the direction of the actuator arrangement;

wherein the at least one spring is designed to come into contact with a projection on the actuator arrangement when the toilet lid is opened, whereby the spring can be prestressed.

8. Toilet system according to claim 1, wherein:

the toilet bowl defines a plurality of through holes that emerge on an upper side of the toilet bowl on which the toilet seat is arranged;

the actuator arrangement comprises a plurality of fastening openings through which the actuator arrangement can be fastened to the toilet bowl via the plurality of through holes; and the fastening openings are elongated holes, so that the actuator arrangement can be fastened to the toilet bowl even if the through holes are at different distances from one another.

9. Toilet system according to claim 1, wherein:

the actuator arrangement comprises at least one actuator in the form of a hydraulic cylinder which is designed to lift the toilet lid and/or the seat ring, wherein:

the actuator arrangement comprises a base plate;

the base plate is screwed and/or locked to the toilet bowl; and the at least one actuator is connected to the base plate via a pin-secured holder or locked via a snap connection; or a common housing which surrounds the at lest one actuator is connected to the base plate via a pin-secured holder or locked via a snap connection.

10. Toilet system according to claim 1, wherein:

the actuator arrangement comprises a first actuator in the form of a hydraulic cylinder which is designed to lift the toilet lid;

the actuator arrangement comprises a second actuator in the form of a hydraulic cylinder which is designed to lift the seat ring;

the first actuator comprises a first end and a second end, wherein the toilet lid is attached to the second end of the first actuator;

the second actuator comprises a first end and a second end, wherein the seat ring is attached to the second end of the second actuator;

a distribution device is provided;

the first actuator is arranged with its first end on a first side of the distribution device and the second actuator is arranged with its first end on a second side of the distribution device; and the distribution device comprises two-first and second connections, each connection being connected to the pressurized water supply line, water which can be supplied to the first connection being able to be supplied to the first actuator at its first end via the distribution device and water which can be supplied to the second connection being able to be supplied to the second actuator at its first end via the distribution device.

11. Toilet system according to claim 10, wherein:

the actuator arrangement comprises a common housing in the form of a tube, wherein the first actuator, the second actuator and the distribution device are arranged in this common housing.

12. Toilet system according to claim 1, wherein:

the actuator arrangement comprises a first actuator in the form of a hydraulic cylinder, which is designed to lift the toilet lid of the toilet seat and a second actuator in the form of a hydraulic cylinder, which is designed to lift the seat ring of the toilet seat;

the first actuator and the second actuator each comprise an outer housing, an inner housing and a piston, wherein the piston and the inner housing are arranged in the outer housing and wherein a movement of the piston leads to a rotation of the inner housing relative to the outer housing;

the inner housing of the first actuator and the inner housing of the second actuator comprise a fastening section, wherein the fastening section protrudes from an opening in the respective outer housing;

both the toilet lid and the seat ring are fastened to these fastening sections;

the fastening section of the first actuator can be pressed into the outer housing of the first actuator and the fastening section of the second actuator can be pressed into the outer housing of the second actuator, whereby the toilet seat with the toilet lid and the seat ring can be pulled off the fastening section; and the inner housing of the first and second actuators is pre-tensioned, whereby the respective fastening section is pressed out of its outer housing after being released and can be latched into the toilet lid and the seat ring of the toilet seat.

13. Toilet system according to claim 12, wherein:

the first actuator comprises an opening accessible from outside the first actuator;

the second actuator comprises an opening accessible from outside the second actuator; and a lock can be inserted into the openings of the first and second actuators when the respective fastening section is pressed into the respective outer housing, wherein the lock is designed so that the respective fastening section of the first and second actuators remains in a pressed-in position.

14. Toilet system according to claim 12, wherein:

a first hinge arm of the toilet lid of the toilet seat is arranged in a rotationally fixed manner on the fastening section of the first actuator; and the seat ring of the toilet seat comprises a first hinge arm, wherein the first hinge arm of the seat ring is merely mounted on the fastening section of the first actuator, whereby when the first actuator is actuated, only the toilet lid but not the seat ring is raised or lowered.

15. Toilet system according to claim 1, wherein:

the actuator arrangement comprises a first actuator and a second actuator, wherein the first actuator is designed to raise and lower the toilet lid and wherein the second actuator is designed to raise and lower the seat ring;

the valve device comprises a line connection that can be connected to the pressurized water line;

the valve device comprises an output connection;

the valve device comprises a first actuator connection, wherein the first actuator connection is connected to the first actuator;

the valve device comprises a second actuator connection, the second actuator connection being connected to the second actuator;

the valve device is designed in a neutral position to separate all connections from one another;

the valve device is designed in a first lifting position to connect the first actuator connection to the line connection;

the valve device is designed in a second lifting position to connect the first actuator connection to the line connection and to connect the second actuator connection to the line connection; and the valve device is designed in a lowered position to connect the first actuator connection to the output connection and the valve device is designed in the lowered position to connect the second actuator connection to the output connection.

16. Toilet system according to claim 15, wherein:

the valve device comprises a reset device which is designed to move the valve device into the neutral position.

17. Toilet system according to claim 15, wherein:

the valve device comprises a first, second and third valve unit, each of which comprises a piston, wherein the respective pistons are movable in a respective receiving chamber within the first, second and third valve unit;

the first, second and third valve unit each comprise an actuating element which is connected to the respective piston, so that pressing the actuating element causes the piston to be displaced within the respective receiving chamber of the valve unit;

the receiving chamber of the first valve unit is connected to the line connection and the first actuator connection;

the receiving chamber of the second valve unit is connected to the second actuator connection and connected directly or via the receiving chamber of the first valve unit to the line connection;

the receiving chamber of the third valve unit is connected to the output connection; and the valve device is designed such that:

a) when the actuating element of the first valve unit is actuated, the first actuator connection can be connected to the line connection, whereby the toilet lid is raised;

b) when the actuating element of the first valve unit is actuated, the first actuator connection can be connected to the line connection, and when the actuating element of the second valve unit is actuated, the second actuator connection can be connected to the line connection, as a result of which the toilet lid and the seat ring are raised; and c) when the actuating element of the first valve unit is not actuated and when the actuating element of the third valve unit is actuated, the first and second actuator connections can be connected to the output connection, as a result of which the toilet lid and the seat ring are lowered.

18. Toilet system according to claim 17, wherein:

the valve device comprises an adjustment device;

the adjustment device comprises a first, second and third button;

the first button comprises a touch panel and a transmission rod, wherein the touch panel is arranged at one end of the transmission rod and wherein the transmission rod is designed to actuate the actuating element of the first valve unit when the touch panel is pressed;

the second button comprises a touch panel and a transmission rod, wherein the touch panel is arranged at one end of the transmission rod and wherein the transmission rod is designed to actuate the actuating element of the second valve unit when the touch panel is pressed;

the third button comprises a touch panel and a transmission rod, wherein the touch panel is arranged at one end of the transmission rod and wherein the transmission rod is designed to actuate the actuating element of the third valve unit when the touch panel is pressed;

the second button is designed to also actuate the actuating element of the first valve unit when it is actuated; and the third button is designed to only actuate the actuating elements of the second and third valve units when it is actuated and to leave the actuating element of the first valve unit unactuated.

19. Toilet system according to claim 17, wherein:

the valve device comprises an adjustment device;

the adjustment device comprises an actuating element and a transmission rod, wherein the actuating element is connected to one end of the transmission rod and wherein first, second and third actuating devices are formed on the transmission rod;

in a first rotational angle position, the first actuating device contacts the actuating element of the first valve unit;

in a second rotational angle position, the first actuating device contacts the actuating element of the first valve unit and the second actuating device contacts the actuating element of the second valve unit; and in a third rotational angle position, the actuating element of the first valve unit is out of contact with the first actuating device, the second actuating device contacts the actuating element of the second valve unit and the third actuating device contacts the actuating element of the third valve unit.

20. Building with a toilet system, the toilet system being constructed according to claim 1, wherein:

the toilet bowl is mounted on the wall or on the floor of the building;

the building comprises a pressurized water supply line; and a second end of the inlet pipe is connected directly or indirectly to the pressurized water supply line.

21. The toilet system of claim 1 wherein the hose system runs through the overflow pipe.

* * * * *